US007021731B2

(12) United States Patent
Mizoguchi et al.

(10) Patent No.: US 7,021,731 B2
(45) Date of Patent: Apr. 4, 2006

(54) INK-JET PRINTING APPARATUS AND RECOVERY TREATMENT METHOD THEREOF

(75) Inventors: Yoshito Mizoguchi, Kanagawa (JP); Isao Ebisawa, Tokyo (JP); Shinichi Sato, Kanagawa (JP); Yoshihide Aikawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 160 days.

(21) Appl. No.: 10/619,212

(22) Filed: Jul. 15, 2003

(65) Prior Publication Data

US 2004/0012648 A1 Jan. 22, 2004

(30) Foreign Application Priority Data

| | | |
|---|---|---|
| Jul. 16, 2002 | (JP) | 2002-207552 |
| Dec. 2, 2002 | (JP) | 2002-349384 |
| Dec. 2, 2002 | (JP) | 2002-349386 |
| Jul. 8, 2003 | (JP) | 2003-272069 |

(51) Int. Cl.
*B41J 2/195* (2006.01)
*B41J 2/17* (2006.01)

(52) U.S. Cl. ..... 347/7; 347/84

(58) Field of Classification Search ..... 347/84–87, 347/6–7, 17, 23, 30, 89
See application file for complete search history.

(56) References Cited

U.S. PATENT DOCUMENTS

| | | | | |
|---|---|---|---|---|
| 3,891,121 | A * | 6/1975 | Stoneburner | 222/1 |
| 4,007,684 | A * | 2/1977 | Takano et al. | 101/366 |
| 4,714,931 | A * | 12/1987 | Erskine et al. | 347/7 |
| 6,398,351 | B1 * | 6/2002 | Blum et al. | 347/84 |
| 6,471,345 | B1 * | 10/2002 | Yoshino et al. | 347/86 |
| 6,536,885 | B1 * | 3/2003 | Kuribayashi et al. | 347/85 |
| 2002/0063759 | A1 | 5/2002 | Hirano et al. | 347/85 |

FOREIGN PATENT DOCUMENTS

| | | |
|---|---|---|
| JP | 2000-334982 | 12/2000 |

* cited by examiner

*Primary Examiner*—Thinh Nguyen
(74) *Attorney, Agent, or Firm*—Fitzpatrick, Cella, Harper & Scinto

(57) ABSTRACT

An ink-jet printing apparatus according to the present invention has a main tank storing ink, a sub-tank releasably connectable with the main tank through an ink supply passage and a printing head for ejecting ink supplied from the sub-tank, for performing printing by ejecting ink from the printing head to a printing medium. The apparatus includes an ink supply controller for supplying ink from the main tank to the sub-tank through the ink supply passage during a period after completion of printing at a preceding time and before starting printing at a next time, and an ink draining controller for performing ink draining of at least a part of ink remaining in the sub-tank during the period after completion of printing at the preceding time and before starting printing at the next time and in advance of ink supply by the ink supply controller.

21 Claims, 30 Drawing Sheets

WITH DRAINING INK
B400
B402
B401
B122
UPON COMPLETION OF PRINTING

AFTER INK DRAINING

AFTER EVAPORATION OF INK

UPON REFILLING OF INK FOR NEXT TIME

WITHOUT DRAINING INK
B400
B402
B401
B122
UPON COMPLETION OF PRINTING

AFTER EVAPORATION OF INK

UPON REFILLING OF INK FOR NEXT TIME

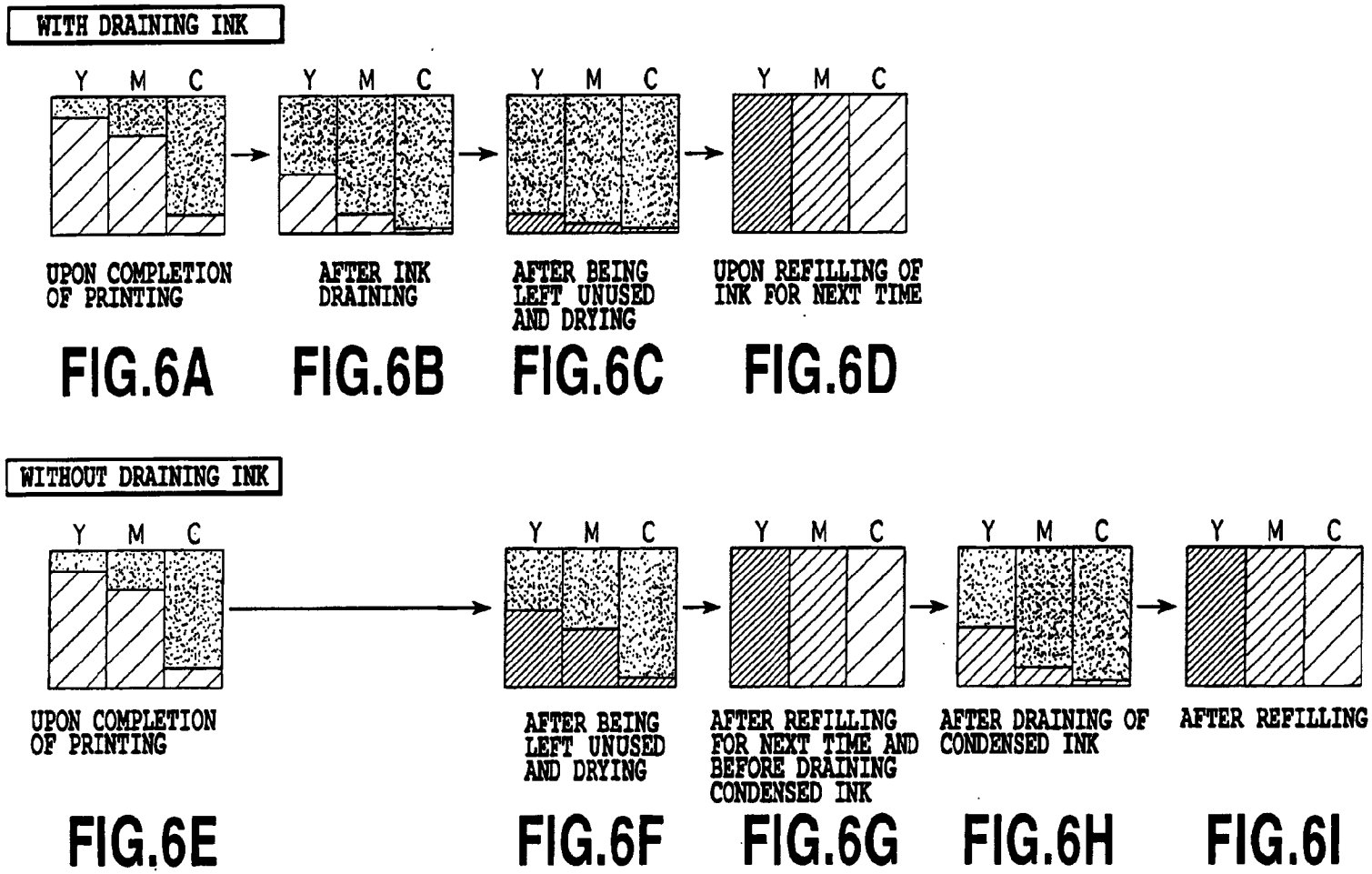
WITH DRAINING INK
Y M C
UPON COMPLETION OF PRINTING
FIG.6A
Y M C
AFTER INK DRAINING
FIG.6B
Y M C
AFTER BEING LEFT UNUSED AND DRYING
FIG.6C
Y M C
UPON REFILLING OF INK FOR NEXT TIME
FIG.6D
WITHOUT DRAINING INK
Y M C
UPON COMPLETION OF PRINTING
FIG.6E
Y M C
AFTER BEING LEFT UNUSED AND DRYING
FIG.6F
Y M C
AFTER REFILLING FOR NEXT TIME AND BEFORE DRAINING CONDENSED INK
FIG.6G
Y M C
AFTER DRAINING OF CONDENSED INK
FIG.6H
Y M C
AFTER REFILLING
FIG.6I

WITHOUT DRAINING INK
Y M C
AFTER COMPLETION OF PRINTING

Y M C
AFTER DRAINING INK (AFTER FIRST DRAINING)

Y M C
AFTER BEING LEFT UNUSED AND DRYING

Y M C
AFTER REFILLING FOR NEXT TIME AND BEFORE DRAINING CONDENSED INK

Y M C
AFTER DRAINING CONDENSED INK

Y M C
REFILLING

| NON-USE PERIOD COUNT VALUE (X) | INK DRAINING AMOUNT |
|---|---|
| $0 < X \leqq T1$ | 0(INK DRAINING NOT PERFORMED) |
| $T1 < X \leqq T2$ | L1 |
| $T2 < X$ | L2 |

FIG.17

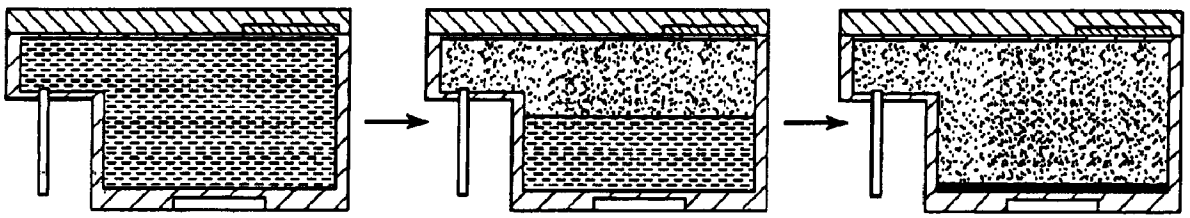
FIG.21A
FIG.21B
FIG.21C
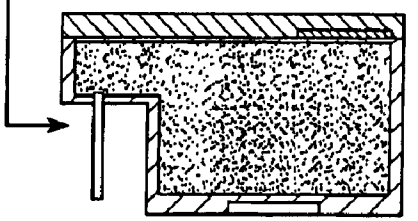
FIG.21D
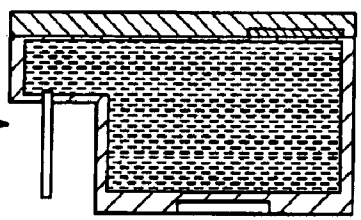
FIG.21E

INK-JET PRINTING APPARATUS AND RECOVERY TREATMENT METHOD THEREOF

This application claims priority from Japanese Patent Application Nos. 2002-207552 filed Jul. 16, 2002, 2002-349386 filed Dec. 2, 2002, 2002-349384 filed Dec. 2, 2002 and 2003-272069 filed Jul. 8, 2003, which are incorporated hereinto by reference.

BACKGROUND OF THE INVENTION

1. Field of the Invention

The present invention relates to an ink-jet printing apparatus and a recovery treatment method in the ink-jet printing apparatus mainly for stabilizing color reproduction ability of an output image.

2. Description of the Related Art

As the conventional ink-jet printing apparatus, there is so-called serial scan type ink-jet printing apparatus exchangeably mounting a printing head as printing means and ink tanks as ink containers on a carriage movable in a primary scanning direction. This printing system sequentially performs printing on printing mediums by repeating primary scan of the carriage mounting the printing head and the ink tank and auxiliary scan (feeding) of the printing mediums.

Considering realizing a micro-printer applicable for PDAs (Personal Digital Assistants) or s cameras, since the size of the carriage must be small, the storage capacity of ink containers to be mounted on the carriage has to be extremely small. If storage capacity of the ink tank on the carriage is extremely small, frequency of exchange of the ink tanks would become high, and exchange of the ink tanks during a single printing operation would become necessary.

In order to solve the problem, Japanese Patent Application Laid-Open No. 2000-334982 discloses an ink-jet printing apparatus employing an ink supply system, in which each time when the carriage is moved to a predetermined stand-by position, ink is supplied from a separately provided ink receptacle member (hereinafter referred to as a main tank which is normally of much greater volume than the ink tank on the carriage) to the ink tank on the carriage (hereinafter referred to as a sub-tank) at a given appropriate timing (also referred to as pit-in ink supply method).

In this apparatus, at every occasion of printing an image on one printing medium for example, the carriage has to be moved to the predetermined stand-by position and the sub-tank and the main tank are connected with each other by a joint member at an appropriate timing for filling the ink from the main tank to the sub-tank. Accordingly, the problem due to quite small ink storage capacity of the sub-tank on the carriage can be solved.

However, in the construction set forth above, the inventors have gotten the following finding as a result of extensive study. When the ink-jet printing apparatus is left in a non-use state for a relatively long period and thereafter used for printing, the color tone of the image could become unnatural. Also, when the same image is printed for a number of times, color tones between images of a plurality of sheets could be different.

Such unnatural color tone or inconsistency of color between the printed products of the same image is particularly not favorable as a printer for cameras for printing photographs.

Such a phenomenon is caused due to condensation of the ink in the sub-tank by leaving the printing apparatus in a low humidity environment for a long period of time. This problem can be reduced by providing a mechanism closing an opening portion of the sub-tank as required, selecting material of the sub-tank to the one having smaller gas permeability or increasing thickness of the sub-tank.

However, these measures cannot be ultimate solutions unless evaporation becomes zero. Also, such measures could cause an increase of costs and enlargement of sizes of the sub-tanks to hinder down-sizing.

On the other hand, according to further extensive study made by the inventors, it has been found that when the ink-jet printing apparatus is left in the non-use state for a relatively long period of time, viscosity of the ink in the sub-tank is significant to reach the ink viscosity far beyond the ink viscosity of the ink normally used in the ink-jet printer to make it impossible to recover nozzles of the printing head.

FIGS. 19A to 19D are schematic representations for explaining a relationship between the sub-tank and remaining amount of ink in the sub-tank in time series. At first, FIG. 19A shows a state where ink is filled in the sub-tank in a pit-in ink supply system. When printing is completed, a state is reached where the ink amount used for printing is consumed, as shown in FIG. 19B. It should be noted that, in the case of application of the pit-in ink supply system to a compact printer, the sub-tank has a quite small capacity. For example, ink storage amount per color is 0.4 ml (=400 μl). In FIG. 19A, 0.4 ml of ink is filled. In FIG. 19B, 0.2 ml, which is half of ink filled in the sub-tank, is consumed and 0.2 ml of ink remains.

As left in the state shown in FIG. 19B, volatile components, such as water, in the ink are evaporated from the sub-tank. While the evaporation speed of the volatile components is variable depending upon material and thickness of the sub-tank, and material, structure and so on of the cap for preventing ink in the nozzle of the printing head from drying, the volatile components are nevertheless evaporated at a certain rate. For example, assuming that the evaporation speed in each color of ink is 0.002 ml per day (=2 μl/day), about 100 μl is evaporated in fifty days, and an evaporation rate from the initial weight becomes 50%. After being left for an even longer period, while the evaporation speed can be lowered slightly, it finally reaches a state where the volatile solvent components in the ink are completely evaporated (state shown in FIG. 19C). It should be noted that the evaporation rate or speed referred to herein is the evaporation rate under conditions where drying is most significant among operation guaranteed environmental conditions.

As an ink composition to be used in the typical ink-jet printing apparatus, a coloring component such as non-volatile dye or pigment is less than or equal to about 10%, the amount of solvent having low volatility (e.g. glycerin, ethylene glycols) is about 15% to 40%, and the remaining contents are volatile water or alcohols. Strictly, the solvent having low volatility evaporates in a little amount. However, since the evaporation amount of such solvent having low volatility is far smaller than that of water or the like, such coloring component and solvent having low volatility is hereinafter referred to as "non-volatile solvent" for the purpose of explanation, and the ratio is assumed to be 25%. Then, in the foregoing example, the ink remaining amount 200 μl×volatile component ratio 0.75=150 μl can be evaporated. Assuming that 2 μl is evaporated per day, the volatile component such as water can be completely evaporated in about seventy-five days. This point will be referred to as the evaporation limit (in practice, further evaporation is continued even after the evaporation limit since the solvent having low volatility evaporates a little amount gradually).

While depending upon the composition of the ink, the viscosity of such ink is about 2.0 mPas in a non-evaporated state and 10.0 mPas in a 50% evaporated state in a case of the ink in the sixth embodiment of the present invention, which will be discussed later. In contrast to this, the viscosity of the ink evaporated up to a 75% of evaporation limit reaches greater than or equal to about 400 mPas, which is greater than or equal to about two hundreds times the ink viscosity in a normal, non-evaporated state.

When such ink of high viscosity is present in the nozzle, ink cannot be sucked by a suction recovery method of the conventional ink-jet printing apparatus, whereby ejection failure can be caused in the nozzle. It should be appreciated that such phenomenon is a problem specifically found in the pit-in ink supply system using the sub-tank of small capacity, in which condensation of ink becomes high over time, thereby leaving a small amount of ink in the sub-tank.

SUMMARY OF THE INVENTION

The present invention intends to solve the problems set forth above. It is an object of the present invention to reduce a problem of condensation of ink in a sub-tank caused in a pit-in ink supply method using the sub-tank of small capacity.

Another object of the present invention is to reduce unnatural color tone of an image associated with condensation of ink even when condensation of ink has occurred.

A further object of the present invention is to reduce a difference of color tone between a plurality of sheets of images associated with condensation of ink even when condensation of ink has occurred.

A still further object of the present invention is to permit prevention of ejection failure of nozzles and to obtain good quality images even when the sub-tank is left in a non-use state for a long period of time.

A yet further object of the present invention is to make reproductivity of color high even when condensation of ink has occurred.

In the first aspect of the present invention, there is provided an ink-jet printing apparatus having a main tank storing ink, a sub-tank releasably connectable with the main tank through an ink supply passage and a printing head for ejecting ink supplied from the sub-tank, for performing printing by ejecting ink from the printing head to a printing medium, comprising:

ink supply means for supplying ink from the main tank to the sub-tank through the ink supply passage within a period after completion of printing at a preceding time and before starting printing at a next time; and ink draining means for performing ink draining for draining at least a part of ink remaining in the sub-tank within the period after completion of printing at the preceding time and before starting printing at the next time and in advance of ink supply by the ink supply means.

In the second aspect of the present invention, there is provided an ink-jet printing apparatus having a plurality of main tanks storing inks, and a plurality of sub-tanks connected to a printing head and releasably connectable with the plurality of main tanks through respective ink supply passages, comprising:

calculating means for calculating a remaining ink amount in each sub-tank at completion of a printing operation; and draining control means for controlling draining of ink from each sub-tank on the basis of results of calculation by the calculating means so that remaining ink amounts in the plurality of sub-tanks are substantially equal with each other.

The above and other objects, effects, features and advantages of the present invention will become more apparent from the following description of embodiments thereof taken in conjunction with the accompanying drawings.

BRIEF DESCRIPTION OF THE DRAWINGS

FIGS. 6A to 6I are schematic representations of fluctuation of condensation ratios of respective colors;

FIG. 17 is a table showing a relationship between a range of a time count value X and an ink drainage amount;

FIGS. 21A to 21E are schematic representations explaining an effect of the fifth embodiment of the present invention, relative to the prior art shown in FIGS. 19A to 19D;

DETAILED DESCRIPTION OF PREFERRED EMBODIMENTS

The present invention will be discussed hereinafter in detail with reference to the drawings. In advance of disclosure of the preferred embodiments, a construction of an ink-jet printing apparatus, to which the present invention is applied, will be discussed. While the following discussion will be given in terms of an ink-jet printing apparatus integrated with a camera portion, it is not necessary to provide a camera portion in the ink-jet printing apparatus according to the present invention.

[Basic Structure]

Firstly, a basic structure of a device according to the present invention will be explained in view of FIGS. 1 to 4. The device explained in the present embodiments is constituted as an information processing apparatus comprising a photographing section for optically photographing an image and then converting the photographed image into electric signals (hereinafter, also referred to as a "camera section") and an image recording section for recording image on the basis of the thus obtained electric signals (hereinafter, also referred to as a "printer section"). Hereinafter, the information processing apparatus in the following embodiments will be referred to as a "printer-built-in camera".

Figure 1:
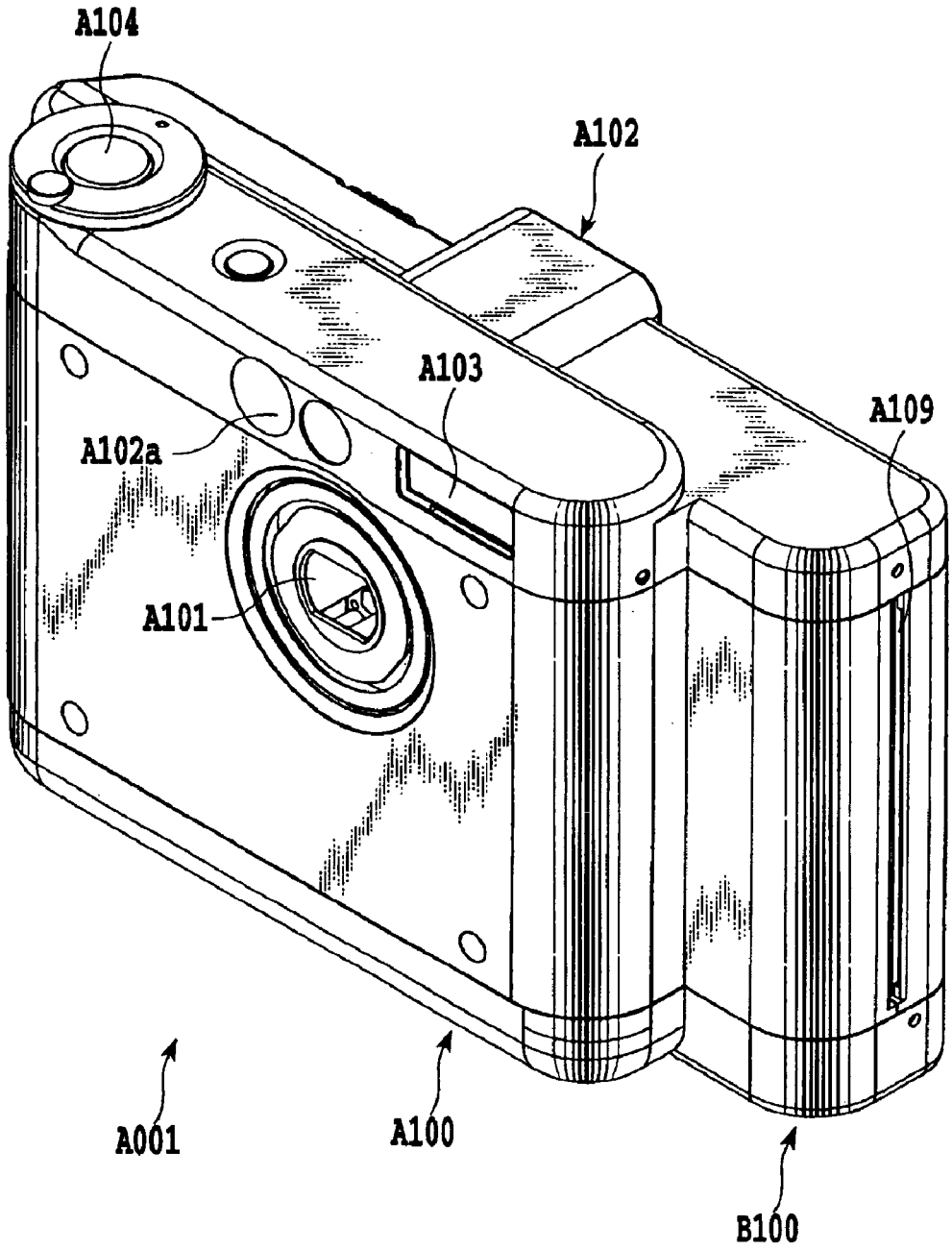
FIG. 1 is a front elevation view of a camera with a built-in printer, to which the present invention is applicable.

In FIG. 1, in a main body A001 there is incorporated a printer section (recording apparatus section) B100 at the backside of a camera section A100 in an integral manner. The printer section B100 records an image by using inks and printing mediums which are supplied from a medium pack C100 shown in FIG. 2. In the present structure, the medium pack C100 is inserted to the printer section B100 at a slot located at the right hand side as shown in FIG. 1, and finished printed matter is output from a printed matter outlet A109.

In the case of performing recording by the printer section B100, the main body A001 can be placed with a lens A101 facing downward. In this recording position, a recording head B120 of the printer section B100, which will be described below, is made to be positioned to eject inks in the downward direction. The recording position can alternatively be made to be the same position as that of the photographing position by the camera section A100 and thus is not limited to the recording position as mentioned above. However, in view of a stability of a recording operation, the recording position capable of ejecting the inks in the downward direction is preferred.

There follows the explanations of the basic mechanical structure according to the present embodiment under the headings of 1 as "Camera Section", 2 as "Medium Pack", 3 as "Printer Section" and 4 as "Electric Control System".

1: Camera Section

The camera section A100, which basically constitutes a conventional digital camera, constitutes the printer-built-in digital camera having an appearance in FIG. 1 by being integrally incorporated into the main body A001 together with a printer section B100 described below. In FIG. 1, A101 denotes a lens; A102 denotes a viewfinder; A102*a* denotes a window of the viewfinder; A103 denotes a flash; and A104 denotes a shutter release button. A liquid crystal display section (outer display section) is provided at a side of the body opposite to the lens. The camera section A100 performs processing of data photographed by a CCD, recording of images to a solid state memory card (e.g., CF card), display of the images and a transmission of various kinds of data with the printer section B100. A109 denotes a discharge part for discharging a printing medium C104 on which the photographed image is recorded. A battery (not shown) is used as a power source for the camera section A100 and the printer section B100.

2: Medium Pack

Figure 2:
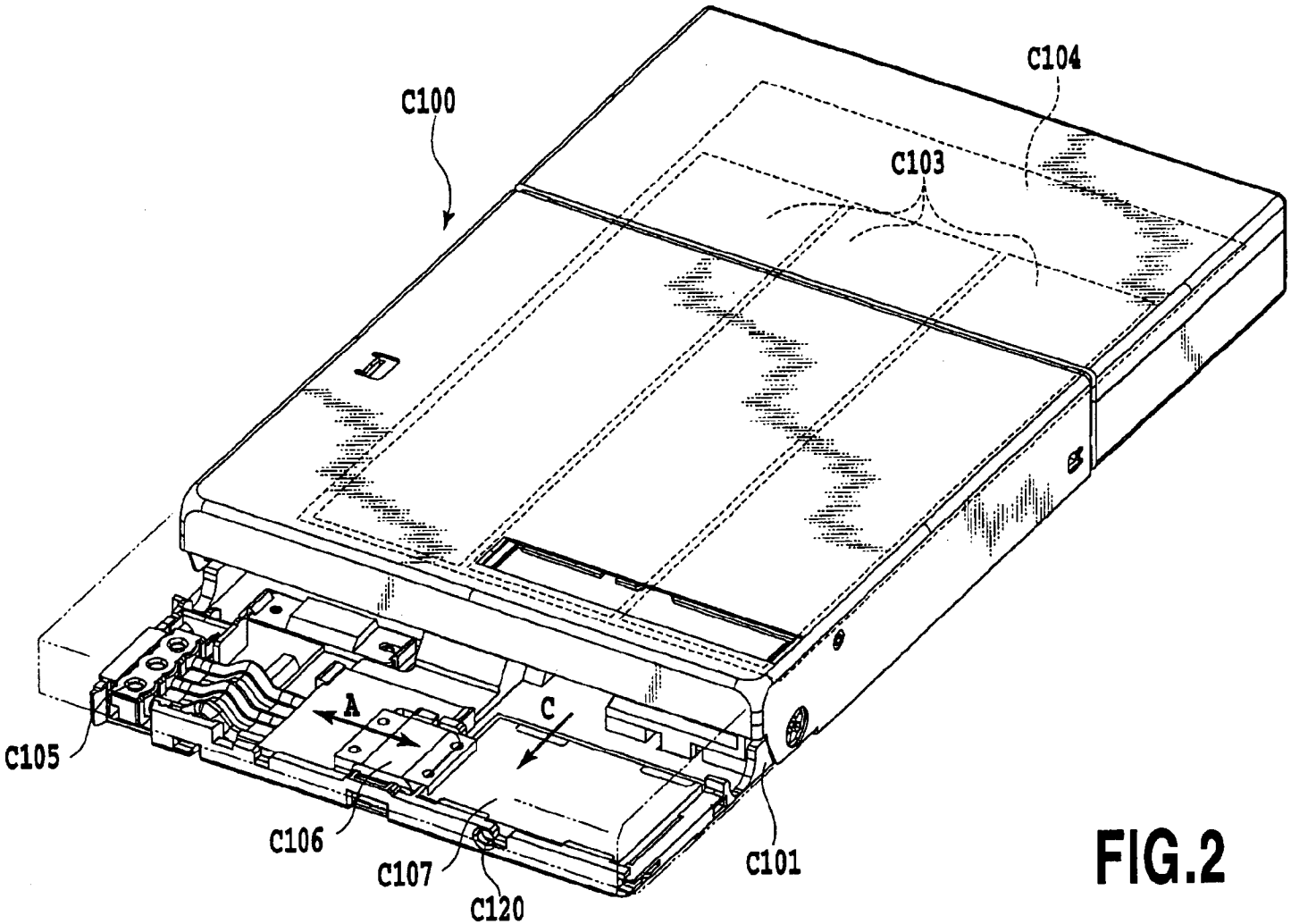
FIG. 2 is a perspective view of a media pack which can be loaded in the camera of FIG. 1.

A medium pack C100 is detachable relative to the main body A001 and, in the present apparatus, is inserted through a slot (not shown) of an inserting section of the main body A001, thereby being placed in the main body A001. The inserting section is closed when the medium pack C100 is not inserted therein, and is opened when the medium pack is inserted therein. FIG. 2 illustrates a status wherein a cover is removed from the main body A001

The pack body C101 contains ink packs C103 corresponding to the main tank (i.e., ink bags), and printing mediums C104 (i.e., ink jet printing mediums). In FIG. 2, the ink packs C103 are held below the printing mediums C104. In the case of the present embodiment, three ink packs C103 are provided so as to separately hold the inks of Y (yellow), M (magenta) and C (cyan), and about twenty sheets of the printing mediums C104 are stored in a stack. A combination of those inks and the printing mediums C104 suitable for recording an image is selected to be stored within the medium pack C100.

Accordingly, various medium packs C100, each having a different combination of the inks and the printing mediums (for example, medium packs for super high-quality image; for normal image; for stickers; and for partitioned stickers), are prepared and, according to a kind of images to be recorded and purposes of use of the printing medium on which an image is to be formed, a medium pack C100 is selectively inserted in the main body A001, thereby being able to perform an ensured recording of the images in compliance with the purposes by employing the most suitable combination of the ink and the printing medium. Further, each medium pack C100 is equipped with an EEPROM (mentioned below) to which is recorded identification data, such as kinds or remaining amounts of the inks and the printing mediums contained in the medium pack.

Figure 3:
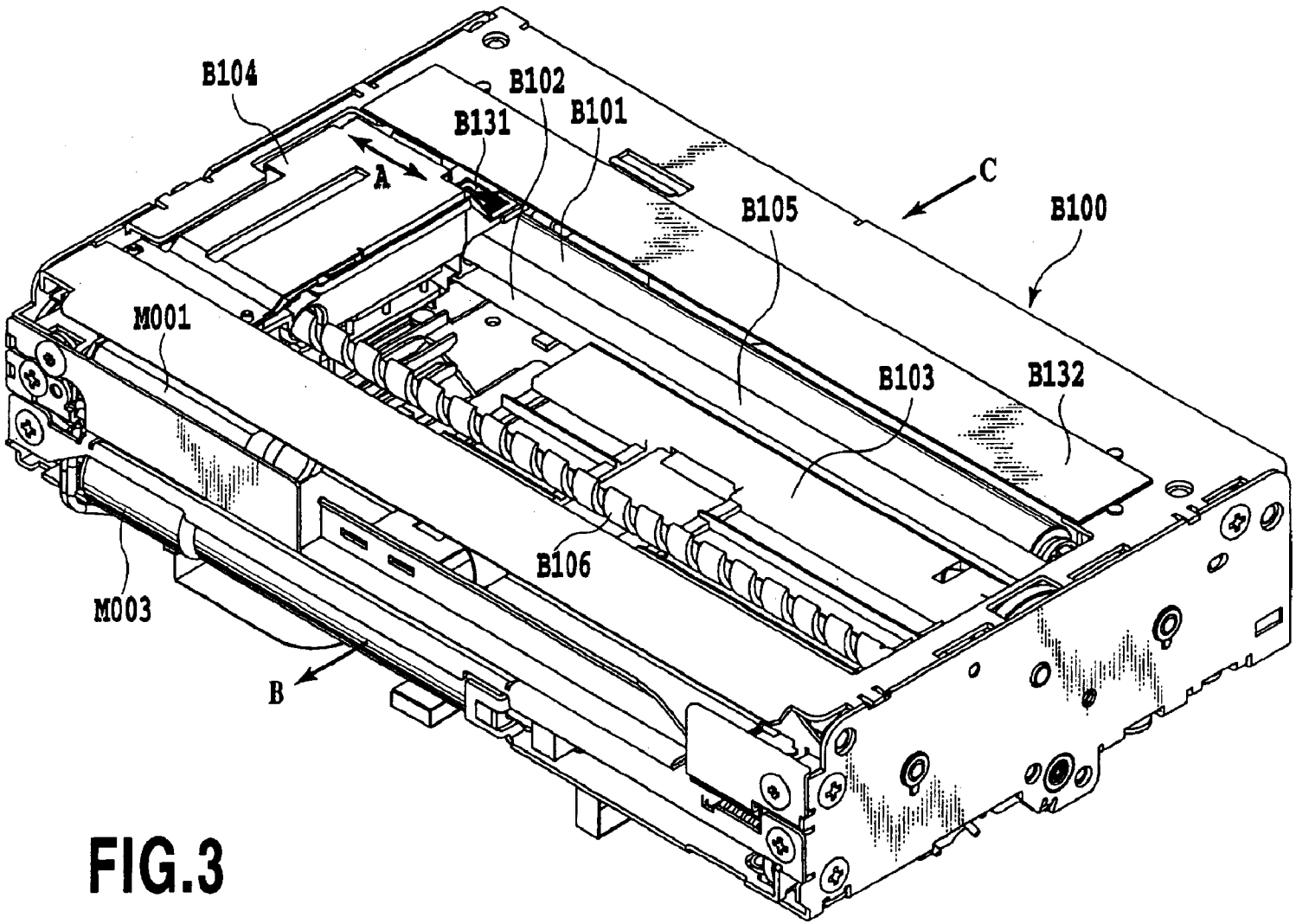
FIG. 3 is a perspective view showing an arrangement of main components within the printer of FIG. 1.

When the medium pack C100 is inserted in the main body A001 (as shown in FIG. 3: inserted to printer section B100 from a direction of an arrow C), the ink pack C103 is connected to an ink supplying system in the main body A001, through three joints C105 each corresponding to ink of Y, M or C. On the other hand, the printing mediums C104 are separated one by one using a separating mechanism which is not shown, and then sent in a direction of an arrow C by a paper feeding roller equipped inside the main body.

Further, the pack body C101 comprises a wiper C106 for wiping a recording head of the printer section, and an ink absorption body C107 for absorbing the spent inks discharged from the printer section.

3: Printer Section

FIG. 3 shows the printer section B100 according to the present embodiment which is a serial type apparatus employing an ink jet recording head. This printer section B100 is explained under the headings of 3-1 "Printing Operating Section"; and 3-2 "Ink Supplying System", respectively.

3-1: Printing Operating Section

FIG. 3 is a perspective view of the printer section B100 without its outer casing.

To the main body of the printer section B100, the medium pack C100 is inserted from the direction of an arrow C as shown in FIG. 3. The printing medium C104 sent in the direction of an arrow C from the medium pack C100, while being sandwiched between a LF roller B101 and a LF pinch roller B102 of the below-mentioned printing medium carrying system, is carried on a pressure plate B103 in a sub-scanning direction indicated by an arrow B. B104 denotes a carriage which reciprocates in a main scanning direction indicated by an arrow A along a guiding shaft BIOS and a leading screw B106.

Inside a bearing of the carriage B104 for the leading screw B106, a protruding screw pin is fixed with a spring. An engagement of a tip of the screw pin B109 with a helical thread formed on the outer circumference of the leading screw B106 converts a rotation of the leading screw B106 to a reciprocating movement of the carriage B104.

The carriage B104 is equipped with an ink jet recording head B120 (shown in FIG. 4) capable of ejecting the inks of Y, M and C as explained later, and a sub-tank for reserving or storing inks to be supplied to the recording head B120. Formed on the recording head B120 are a plurality of ink ejection openings B121 (see FIG. 4), which are aligned in a direction crossing with the main scanning direction indicated by the arrow A. The ink ejection openings B121 form nozzles capable of ejecting inks supplied from the sub-tank. As a generating means of energy for discharging the inks, an electro-thermal converting element equipped with each of the nozzles may be used. Each electro-thermal converting element generates a bubble in the ink within the nozzle by heating and thus generated foaming energy causes an ejection of an ink droplet from the ink ejection opening B121.

The sub-tank has a capacity smaller than the ink packs (main tanks) C103 contained in the media pack C100, and is made to be a size sufficient for storing a required amount of ink for recording an image corresponding to at least one sheet of printing medium C104. In the sub-tank, there are ink reserving or storing sections for each of the inks of Y, M and C, on each of which is formed the ink supplying section and the negative pressure introducing sections, wherein those ink supplying sections are individually connected to the corresponding three hollow needles B122 (see FIG. 4) and their negative pressure introducing sections can be connected to a common air suction opening B123 (see FIG. 4). As will be mentioned below, sub-tanks are supplied with inks from the ink packs (main tanks) C103 in the medium pack C100 when the carriage B104 moves to a home position.

A movement position of the carriage B104 is detected by an encoder sensor B131 on the carriage B104 and a linear scale B132 on the main body of the printer section B100. Also, that the carriage B104 has moved to the home position is detected by a HP sensor on the main body of the printer section B100.

A controlling mechanism (not shown) controls a height of the carriage 104, thereby achieving an adjustment of a distance between the recording head B120 and the printing medium C104 on the pressure plate B103. The leading screw B106 is rotatably driven by a carriage motor M001 through a screw gear, an idler gear and a motor gear. A flexible cable electrically connects the recording head B120 to an electrical circuit board in the main body.

The recording head B120 moves together with the carriage B104 in the main scanning direction indicated by the arrow A and concurrently ejects the inks from the ink ejection openings B121 in accordance with the image signals, thereby recording an image corresponding to one band on the printing medium on the pressure plate B103. An alternate repeat of a recording operation of an image corresponding to one band by such recording head B120 and a conveying operation of the predetermined amount of the printing medium toward the sub-scanning direction indicated by the arrow B by means of the below-mentioned printing medium conveying system enables a sequential recording of the images on the printing medium.

3-2: Ink Supplying System

Figure 4:
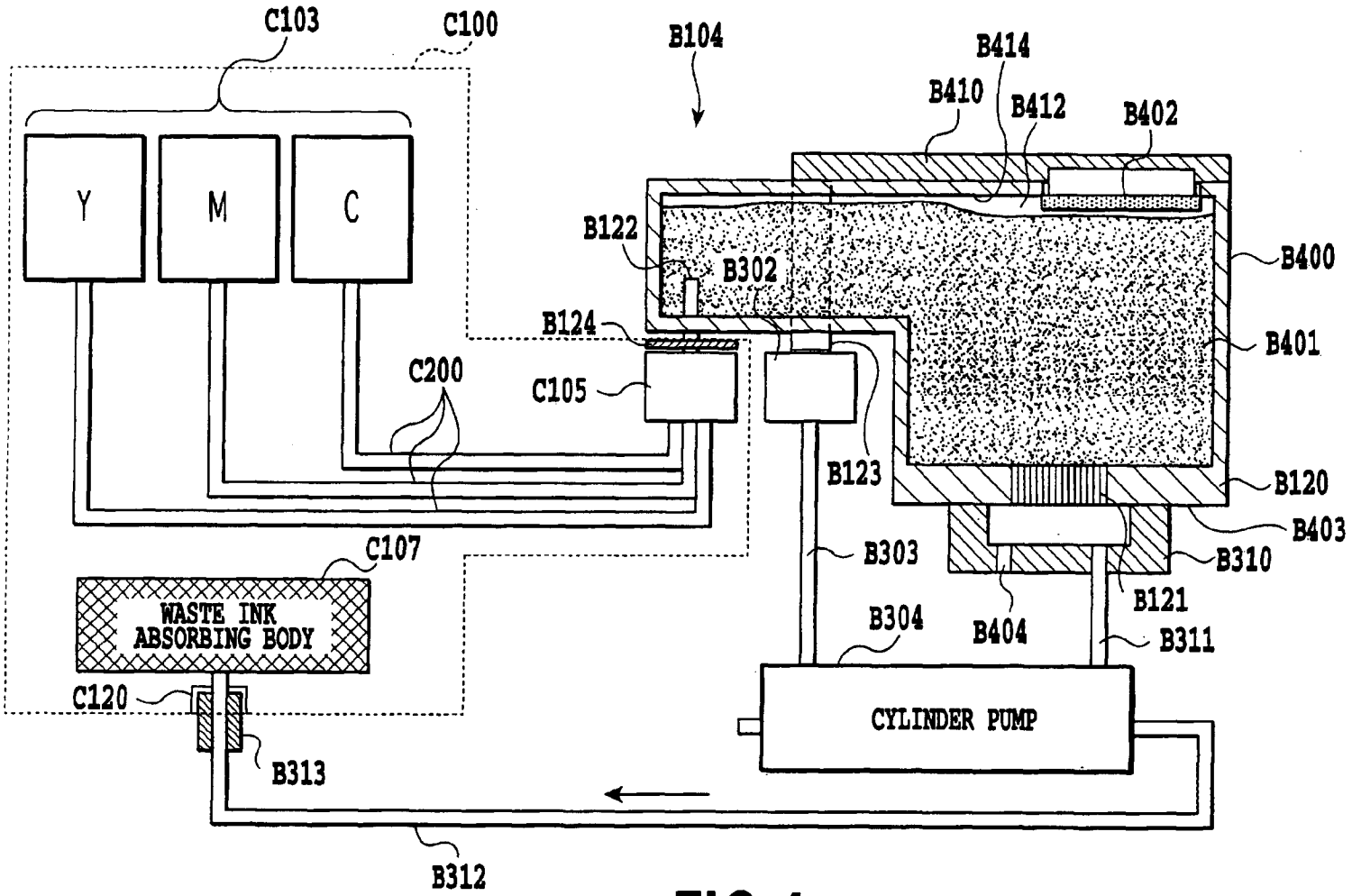
FIG. 4 is a schematic representation of an ink supply recovery system.

FIG. 4 is a perspective view showing a component part of an ink supplying system of the printer section B100.

A joint C105 of the medium pack C100 installed to the printer section B100 is positioned below the needles B122 on the carriage B104 moved to a home position. The main body of the printer section B100 is equipped with a joint fork B301 (not shown) positioned below a joint C105, and an upward movement of the joint C105 caused by the joint fork establishes a connection of the joint C105 to the needles B122. As a result thereof, an ink supplying path is formed between the ink packs C103 in the medium pack C100 and the ink supplying sections on the sub-tank B400 on the carriage B104.

Further, the main body of the printer section B100 is equipped with a suction joint B302 for connecting with an air suction opening B123 of the carriage B104 moved to the home position. This suction joint B302 is connected to a cylinder pump B304 of a pump serving as a negative pressure generating source, through a suction tube B303. The suction joint B302 is connected to the air suction opening B123 on the carriage B104 according to the upward movement caused by a joint lifter (not shown). In light of the foregoing, a negative pressure introducing path, between a negative pressure introducing section of the sub-tank on the carriage B104 and the cylinder pump B304, is formed.

The joint lifter makes the joint fork B301 and the joint C105 move up and down together with the suction joint B302 by a driving force of the joint motor M003. Thus, the formation of ink supply path and the formation of the negative pressure introducing path are accomplished at the same time.

The negative pressure introducing section of the sub-tank is equipped with a gas-liquid partition member B402 which allows a passing through of air but prevents a passing through of the inks. The gas-liquid partition member allows a passing through of the air in the sub-tank to be suctioned through the negative pressure introducing path, thereby forcing an ink to be supplied to the sub-tank from the medium pack C100. Then, when the ink is sufficiently supplied to the extent that the ink in the sub-tank reaches the gas-liquid partitioning member, the gas-liquid partitioning member prevents the passing through of the inks, thereby automatically stopping a supply of the inks. The gas-liquid partitioning member is situated at the ink supplying section in the ink storing sections for the respective inks in the sub-tank, and thus the ink supply is automatically stopped with respect to each ink storing section.

The main body of the printer section B100 is further equipped with a suction cap B310 capable of capping the recording head B120 on the carriage B104 which moved to the home position. Negative pressure is introduced into the suction cap B310 from the cylinder pump B304 through suction tube B311, so that the inks can be suctioned and emitted (suction recovery processing) from the ink ejection openings B121 of the recording head B120. Further, the recording head B120, as required, ejects the ink which does not contribute to a recording of an image into the suction cap B310 (preliminary ejection processing). The ink within the suction cap B310 is discharged into the ink absorption body C107 in the medium pack C110 from the cylinder pump B304 through a waste water liquid tube B312 and a waste liquid joint B313.

The cylinder pump B304 is driven by a pump motor M004. The pump motor M004 also functions as a driving source by which the joint lifter and the wiper lifter are moved up and down. The wiper lifter makes the wiper C106 of the medium pack C100 placed in the printer section B100 move upwardly, thereby displacing the wiper C106 to a position capable of wiping of the recording head B120.

It should be noted that for tubes such as B303, B311, and B312, valves (not shown) may be provided as required. Upon each operation of the pump motor M003, those valves are opened and closed so that they selectively perform suction for each individual color of ink or suction for two or more colors of inks in a lump or batch, but do not affect suction or draining operation of other colors of ink during operation for lifting up and down.

The cylinder pump B304 is placed in stand-by state on the HP side of the pump in a stand-by state of the printer, with a pump HP sensor (not shown) detecting that the operating position of the pump is at its home position.

Here, discussion is given for a camera with a built-in printer, in which a camera portion A100 and a printer portion B100 are integrated together. However, it is also possible in the present invention to construct the camera portion A100 and the printer portion B100 as separate units and to connect these separate units through an interface to achieve the same functions.

(Detailed Description of Ink Supply Recovery System)

The foregoing is a general discussion of the ink supply recovery system employing the typical pit-in supply system. Detail of the ink supply recovery system will be discussed hereinafter. FIG. 4 is a schematic representation of the ink supply recovery system similar to the above. While there are some overlapping explanations, a sequence of the operation will be discussed with reference to FIGS. 2 and 4.

In FIG. 2, received in the media pack 100 are three ink packs (main tanks) C103 respectively filled with three colors, i.e., Y (yellow), M (magenta) and C (Cyan), of inks. These three ink packs C103 are connected to three joints (ink joints) via three ink supply passages C200.

In FIG. 4, mounted on the carriage B104 are sub-tanks (also referred to as carriage tanks) B400 respectively storing Y, M and C inks, and a printing head B120 having a plurality of ink ejection openings (nozzles) B121 for ejecting three groups (Y, M, C) of inks supplied from respective carriage tanks B400.

In each of ink receptacle portions (ink supply portions) of the sub-tanks B400, ink absorbing bodies (sponges) B401 formed from a porous body, including a foamed body and a fibrous body formed from, e.g., polypropylene fibers, are disposed in a state substantially filling up the receptacle portions of respective sub-tanks B400. On the other hand, in respective receptacle portions (ink supply portions) for respective inks in the sub-tanks B400, needles (ink introducing portion) B122 having downwardly projecting through-holes are provided respectively, as shown in FIG. 4. These three needles B122 respectively become connectable with three rubber joints C105 of the media pack C100. At the tip end portions of the needles B122, a lateral hole is formed for enabling ink supply. Tip ends of the needles are closed with sharply tilted end faces.

In upper portions of respective ink supply portions is of the sub-tanks B400, vacuum pressure introducing portions B410 are formed. In these vacuum pressure introducing portions B410, porous membranes (ink full valves) B402, provided with water repellent and oil repellent treatment for serving as vapor-liquid separating members allowing air to permeate and blocking ink, are provided respectively. Since ink is blocked with such porous membranes B402, refilling of ink is automatically stopped when the liquid surface of the ink in the sub-tank B400 reaches the porous membrane B402. If water repellent and oil repellent treatment is not provided, the porous membrane is easily wetted by ink. Particularly, after a period of time, ink may penetrate into pores of the vapor-liquid separation membrane in easily wetted portions for substantially not achieving a vapor-liquid separation effect to lower air introduction efficiency and whereby to lower ink supply performance.

Each vacuum pressure introducing portion B410 of the sub-tank B400 is communicated with an air suction opening B123 common for three colors and formed on the lower surface side of the carriage B104 as explained above. The air suction opening B123 becomes communicable with a vacuum supply joint B302 provided on a main body side of the printer portion B100 when the carriage B104 is moved to the home position so that the air suction opening B123 is connectable with one of cylinder chambers of a cylinder pump B304 of a pump unit B315 via the vacuum supply joint B302 and the vacuum supply tube B303.

On the side of the printer portion B100, a suction cap B310 is provided for capping, when the carriage B104 is moved to the home position, a nozzle face (ink ejection openings forming surface) B403 of the printing head B120 formed with a plurality of ink ejection openings (nozzles) B121 for three groups of Y, M, and C. In the suction cap B310, atmosphere communicating opening B404 is formed. The atmosphere communicating opening B404 can be opened and closed by an atmosphere communication valve (not shown).

The suction cap B310 is connected to the other cylinder chamber of the cylinder pump B304 through a suction tube B311. The cylinder pump B304 has three ports respectively connected to the vacuum supply tube B303, the suction tube B311 and a waste liquid tube B312.

In the carriage B104 of FIG. 4, B124 denotes a needle cover, which is moved to a position protecting the lateral hole of the needle B122 from deposition and/or penetration of dirt or dust, by a force of a spring when the needle B122 and the joint C105 are not connected. Also, the needle cover B124 releases protection of the needle B122 when pushed upward (in the drawing) against the force of the spring when the needle B122 and the joint C105 are connected together.

On the other hand, as shown in FIG. 4, it is preferred that the gas permeating member B402, provided on the inner surface of the sub-tank B400, and the ink absorbing body B401 be placed in a non-contact arrangement defining a space B412 therebetween. When contacted with ink for a long period of time, vapor-liquid separation performance of the vapor-liquid separation membrane B402 can be lowered. However, in the shown embodiment, by defining the space B412 between the vapor-liquid separating membrane B402 and the ink absorbing body B401 for avoiding direct contact therebetween, ink may not contact with the vapor-liquid separation membrane B402 except upon refilling of ink. Accordingly, lowering of the function of the vapor-liquid separating membrane B402 can be prevented. On the other hand, it is preferred that deposition of ink on the inner wall surface of the space B412 (the surface identified by B414, for example) is restricted as much as possible by appropriate surface treatment (such as water repellent treatment).

When ink is supplied from the main tank C103 to the sub-tank B400, the rubber joint C105 and the needle B122, and the vacuum supply joint B302 and the air suction opening B123, respectively, are joined by the foregoing joint lifter (or joint fork) for supplying ink from the main tank to the sub-tank by sucking air in the sub-tank B400 by the cylinder pump B304 through the vacuum introducing portion B410 and the vapor-liquid separating membrane B402.

After supplying ink to the sub-tank, the rubber joint C105 and the needle B122, and the vacuum supply joint B302 and the air suction opening B123 are separated, respectively. Then, if necessary, the ink in the sub-tank is sucked by the cylinder pump B304 through the suction cap B310. Here, it is preferred to suck the ink at least to the extent of the ink amount residing in the ink needle. From other viewpoint, the ink is passed through the printing head B120, suction is performed to the extent of removing bubbles present in the vicinity of the nozzle (or possibly admixed with ink), and thereafter, a printing operation is performed.

4. "Electric Control System"

Next, a construction of an electric control system of the shown apparatus will be discussed with reference to FIG. 7.

Figure 7:
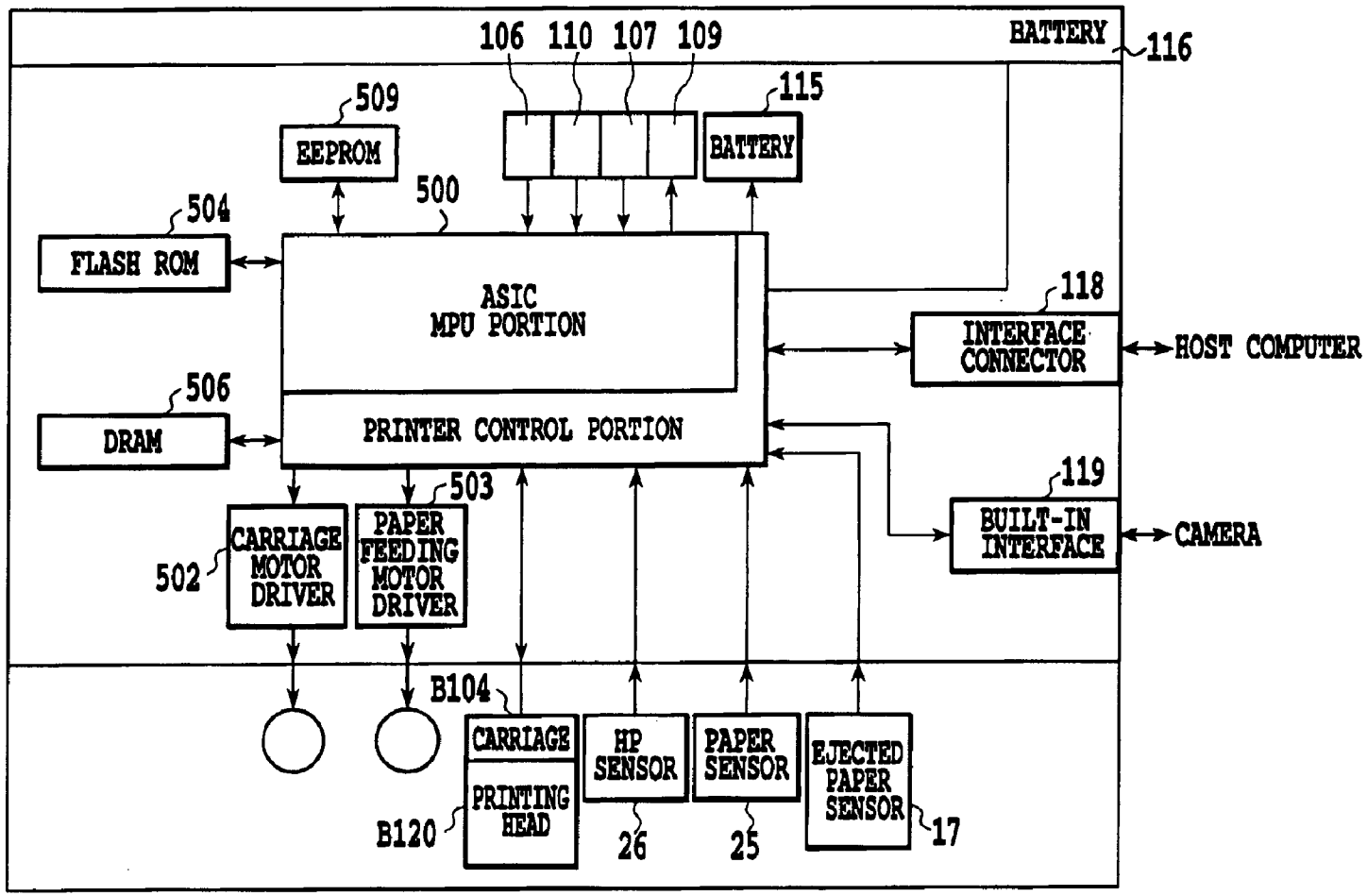
FIG. 7 is a schematic block diagram of an electric system of an ink-jet printing apparatus.

FIG. 7 is a block diagram of an electrical construction of the present apparatus. In FIG. 7, the reference numeral 500 denotes an ASIC in which an MPU portion and a printer-control portion are integrated. Reference numeral 504 denotes a flash ROM storing a program for controlling the overall apparatus, and 506 denotes a DRAM used as a work area of the ASIC and a buffer of the printing image. Reference numeral 509 denotes an EEPROM. The EEPROM is a rewritable ROM, the content of which is not erased even when power is not supplied. In EEPROM 509, setting information set by a user during an ON state of the power source, a used ink amount, an ink amount residing in the sub-tank and so forth are written. The ASIC further includes a controller for heat pulse generation and generates and transmits a control signal for the printing head to the printing head B120. On the other hand, the ASIC performs control of carriage and paper feeding, I/O with another power source, an LED and various sensors, exchange of data with the camera side, and exchange of data with the computer.

Reference numeral 502 denotes a carriage motor driver for performing driving of the carriage B104, and 503 denotes a paper feeding motor driver for driving a paper feeding roller. The carriage motor driver 502 and the paper feeding motor driver 503 perform control of motors by control signals output from the ASIC.

The camera portion and the printer portion of the shown apparatus are driven by a battery 116. In the apparatus, another power source 115 is provided to be used for holding date information while the power source of the camera is OFF, measurement and so forth. The reference numeral 106 denotes a power source switch for turning on the power source of the main body, 107 denotes an error release switch, 110 denotes a power lamp and 109 denotes an error lamp.

The reference numeral 118 denotes an interface connector for performing external signal communication with the host computer and so forth, for example. The interface connector 118 is connected to the host computer by wiring. The reference numeral 119 denotes a built-in interface. Here, the built-in interface 119 performs exchange of data with the camera portion of the printer integrated with the camera.

An HP sensor 26 is a sensor of a photo interrupter type for detecting the home position of the carriage B104. On the other hand, a paper sensor 25 and a paper ejection sensor 17 are contact type sensors that detect presence and absence of printing paper in the printing apparatus.

It should be noted that the present invention should not be limited to the embodiments employing a media pack C100, in which an ink pack (main tank) C103 and a printing medium C104, are contained. Namely, it is not necessary that the ink pack (main tank) and the printing medium are contained in the same container. For example, for general printers, it is possible to construct the apparatus to permit insertion of the printing medium from outside of the apparatus, and the main tank may be constructed to be loaded on the apparatus independently. It should be noted that the sub-tank may have a size to contain ink in an amount necessary for printing an image on at least one sheet of printing medium.

(Characteristic features of the Present Invention)

In the present invention, one of the characteristic features is to perform an ink drainage process for draining at least a part of remaining ink in the sub-tank before performing pit-in ink supply (also referred to as second pit-in ink supply) for a next printing operation. Hereinafter, this feature of the present invention will be discussed in terms of the first to twenty-fourth embodiments.

In the first to nineteenth embodiments, the foregoing ink drainage process is performed at a point of time before initiation of printing. Throughout the disclosure and claims, the "point of time before initiation of printing" is, for example, any one of a point of time triggered by turning ON of the power source (ON-set of power source), a point of time triggered by reception of a print start signal for initiating the printing operation, or a point of time triggered by reception of an initial print start signal for initiating the initial printing operation after turning ON of the power source.

On the other hand, throughout the disclosure and claims, the "left period" or "non-use period" is, for example, any one of a period in which the power source is in an OFF state during a period from termination of printing at the preceding time to initiation of printing at the next time, or a period from turning OFF of the power source at the preceding time to initiation of printing at the next time, a period from termination of printing at the preceding time to initiation of printing at the next time or a period from completion of the recovery process (suction recovery) at the preceding time to initiation of printing at the next time.

(First Embodiment)

The first embodiment is characterized in that it performs an ink drainage process for draining of remaining ink in the sub-tank before pit-in ink supply for supplying ink to be used in printing operation to the sub-tank (hereinafter pit-in ink supply for a (next) printing operation or pit-in ink supply for a (next) printing). Here, particularly, discussion will be given for the case where ink remaining in the sub-tank is drained from the printing head by sucking the ink from the printing head in the condition where the printing head is in close contact with the suction cap. In the first embodiment, the ink drainage process is performed at a point of time before initiation of printing.

Figures 14A, 14B, 14C, 14D, 14E:
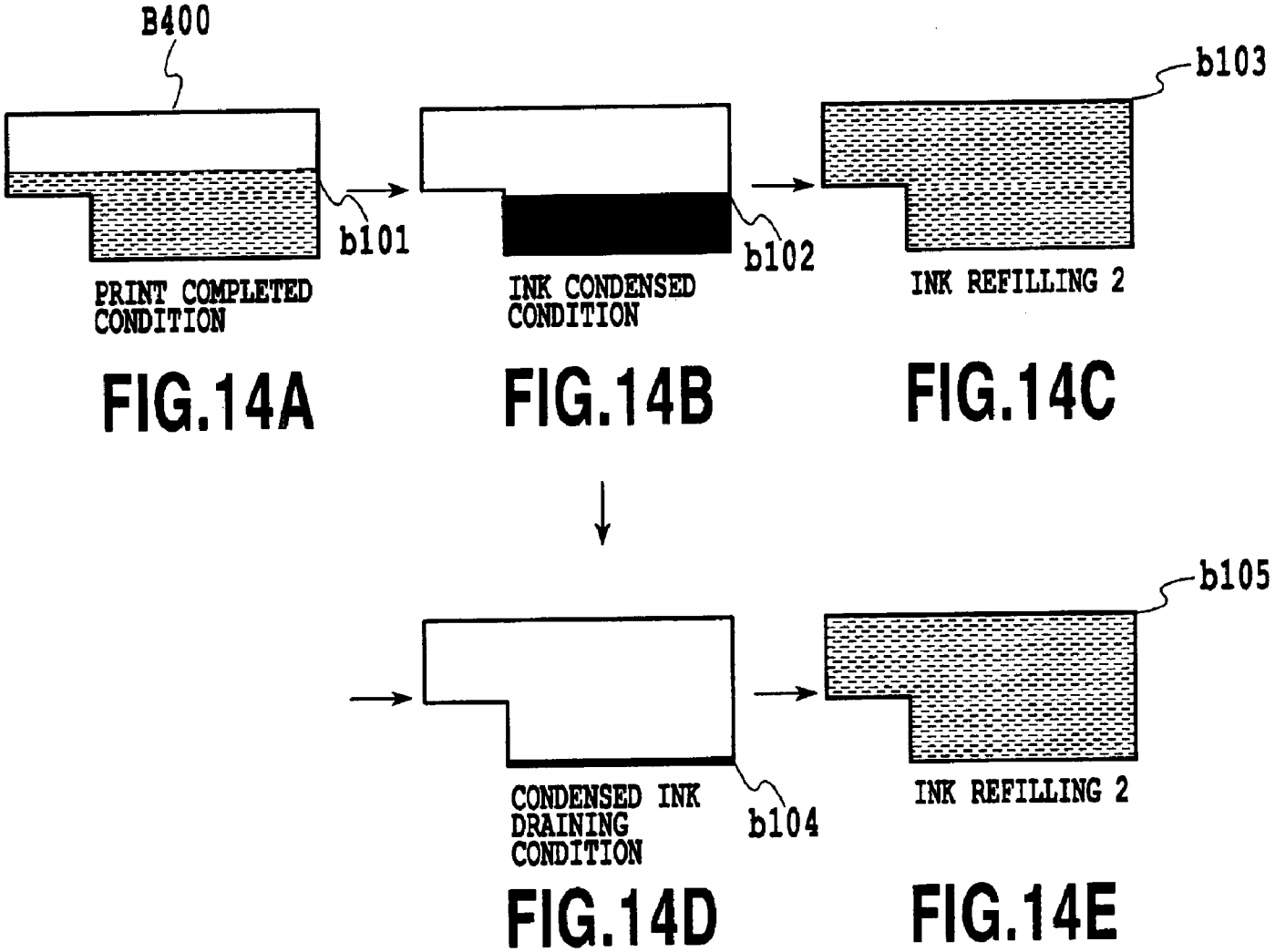
FIGS. 14A to 14E are schematic representations showing states of ink in the sub-tank for explaining the first embodiment.

FIGS. 14A to 14E are schematic representations showing a state of the ink in the sub-tank for explaining the first embodiment. FIG. 14A shows a state of the remaining ink in the sub-tank when a printing operation is completed. There is illustrated a state in reduction of ink down to level b101 through a printing operation, which originally was in a state where the ink is fully filled up in the sub-tank B400.

As set forth above, since the sub-tank is provided with portions communicated with atmosphere, such as needle and air suction opening, when it is left in a low humidity environment for a long period of time, the water component in the ink can be evaporated from the sub-tank as water vapor to increase the density of the coloring agent in the ink for condensation of the internal ink down to level b102 (FIG. 14B). When a pit-in ink supply is performed from this condition, even if fresh ink is supplied to make the sub-tank full, newly supplied ink is mixed with condensed ink remaining in a relatively large amount, and therefore, the density of the mixed ink becomes higher than that of the initial ink density (FIG. 14C). Then, when printing is performed again with ink in the state of FIG. 14C, the printed density becomes higher than that of the case where printing is performed with the ink of the initial density (density before condensation) to cause fluctuation of color tone upon color printing in subtractive mixing. In other words, color tone of the printed image becomes unnatural, or variation of color tone can be generated between a plurality of sheets of printed images, which are adverse effects of the condensed ink.

In contrast to this, in this embodiment, as shown in FIG. 14D, condensed ink remaining in the sub-tank is drained by a suction operation down to the level of b104 at a timing before initiation of printing. Of course, the shown level is an example for the purpose of explanation and the level to which to drain may be appropriately determined depending upon the remaining amount of ink, the kind of ink and other factors, and thus should not be limited to the shown example. For improvement of color tone, it is the most effective to drain substantially all of the remaining condensed ink. However, it is still effective for partly draining the remaining condensed ink. On the other hand, draining only a part of the remaining condensed ink is advantageous in terms of conserving ink.

In FIG. 14D, the amount of the remaining condensed ink is quite small. Accordingly, when pit-in ink supply is performed in this state, since the amount of fresh ink supplied for the remaining condensed ink is sufficiently large, there is little increase of ink density, thus permitting normal printing.

With the first embodiment set forth above, before initiation of printing, fresh ink is supplied to the sub-tank by pit-in ink supply after once draining the remaining condensed ink in the sub-tank left in non-use state for a relatively long period of time. Therefore, printing can be performed with ink having density relatively close to the initial density, and as a result of this, drift of color tone from the original version can be reduced, and also, a difference of density of color between plural pages can be reduced.

(Second Embodiment)

The second embodiment is characterized by determining whether the draining process for draining remaining ink in the sub-tank is to be performed or not on the basis of a time period of leaving the sub-tank in non-use state (for example, an elapsed period from completion of printing operation at the preceding time). More particularly, when the non-use period is longer than or equal to a predetermined period, the draining process for draining the remaining ink in the sub-tank is performed, and on the other hand, when the non-use period is shorter than the predetermined period, control is effected so as not to perform the draining process for draining remaining ink in the sub-tank.

A reason to perform such a switching control of draining process is summarized as follows. When the non-use period is relatively short, evaporation of ink in the sub-tank is not progressed in a substantial amount. Accordingly, a significant increase of density as discussed in connection with the first embodiment has not yet been caused, and thus, no substantial problem would arise in practice. In such a case, the draining process of remaining ink shall not be performed prior to a pit-in ink supply for printing operation. With such an operation, unnecessary consumption of ink could be avoided. In a certain environment, since the evaporation rate of ink in the sub-tank can be estimated based on the period of time to be left in a non-use condition, a switching control of the draining process can be made by measuring (time counting) of the non-use period.

Discussion will be given for the second embodiment of the present invention with reference to the flowchart shown in FIG. 15. At first, a time count X is initialized in response to a power source OFF signal of the printer. At step S1501, counting of the non-use period is started. In the shown embodiment, the time count value X is incremented each time a given period has elapsed. For example, the time count value X is incremented by one per one second. In the alternative, it is also possible to increment the time count value X by one per one minute, to increment the time count value X by one per one hour or to increment the time count value X by one per day. At step S1502, when the power source is turned ON, the time count value X at this time is compared with a predetermined threshold value $\alpha$ (step S1503).

If the value of the time count X is smaller than the threshold value $\alpha$ at step S1503, a judgment is made that evaporation ink in the sub-tank has not progressed significantly, and the sequence is advanced to step S1505 skipping step S1504. On the other hand, when the value X is greater than or equal to the threshold value $\alpha$, the process is advanced to step S1504 for reducing the degree of condensation of ink. At step S1504, a suction operation is performed to drain ink from the sub-tank. It should be noted that the draining amount of ink may be similar to that of the first embodiment. Subsequently, the process is advanced to step S1505 to initialize the time count value X. When the power source OFF signal arrives, the process is returned to step S1501. Otherwise, as long as the state is maintained, the printer is held in a printing stand-by state. It should be noted that, when the printing start signal is input during the printing stand-by state, pit-in ink supply to the sub-tank is performed accordingly, and a subsequent printing is initiated.

Figure 15:
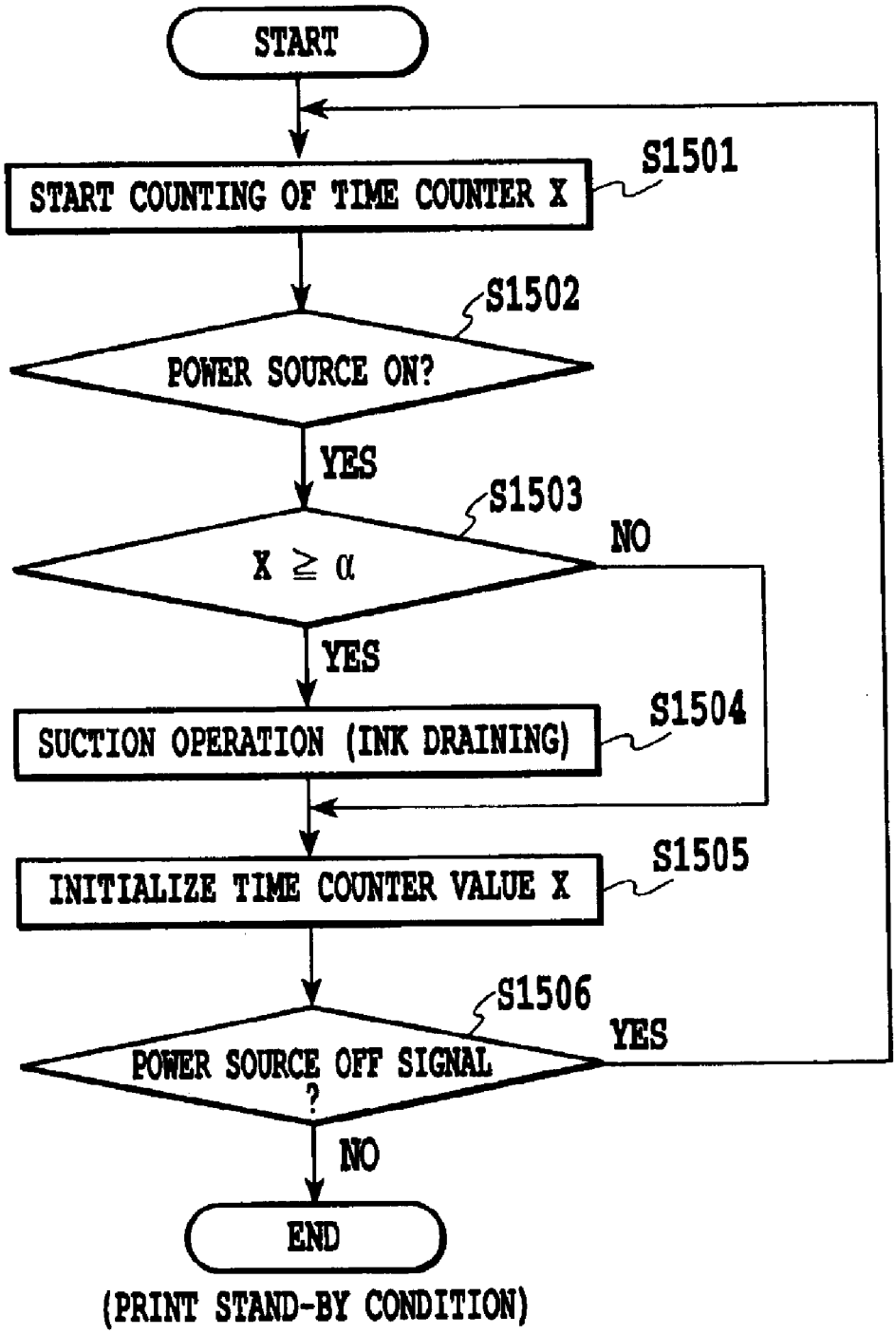
FIG. 15 is a flow chart explaining a sequence to perform an ink draining process according to the second embodiment of the present invention.

As set forth above, in the embodiment shown in FIG. 15, judgment is made as to whether the ink draining process is to be performed or not before pit-in ink supply for initially performing the printing operation after turning ON of the power supply. However, it should be appreciated that the point of time to make judgment whether the ink draining process is to be performed or not is not limited to the point of time of turning ON of the power supply and is only required to be performed before starting printing. For example, judgment may be performed upon receipt of the print start signal. On the other hand, while the time count value X is taken as an elapsed time from turning OFF of the power source in the preceding time in FIG. 15, the period to be measured as a parameter for determining whether the draining process is to be performed or not is not limited to the period elapsed from a turning OFF of the power source in the preceding time, but can be a period elapsed from completion of a printing operation. Hereinafter discussion will be given for the case where the judgment point of time as to whether the ink draining process is to be performed or not is upon reception of the print start signal, and the time count value X is the period elapsed from completion of the printing operation in the preceding time with reference to FIG. 16.

A flowchart shown in FIG. 16 will be discussed herein. At first, at step S1601, when the print start signal is received, judgment is made as to whether the time count value X is greater than or equal to the threshold value $\alpha$ or not at step S1602. Here, the time count value X is the elapsed time from completion of the printing operation in the preceding time. If judgment is made that the value X is less than the threshold value $\alpha$, the ink draining process (step S1603) is not performed, and the process is advanced to step S1604. On the other hand, when judgment is made that the value X is greater than or equal to $\alpha$ at step S1602, the ink draining process is performed at step S1603. Subsequently, the process is advanced to step S1604. It should be noted that the draining amount in the ink draining process may be similar to that of the first embodiment. At step S1604, fresh ink is supplied to the sub-tank by pit-in ink supply, and then, at step S1605, an ordinary recovery operation (suction operation) is performed. Thereafter, the printing operation is started at step S1606.

Figure 16:
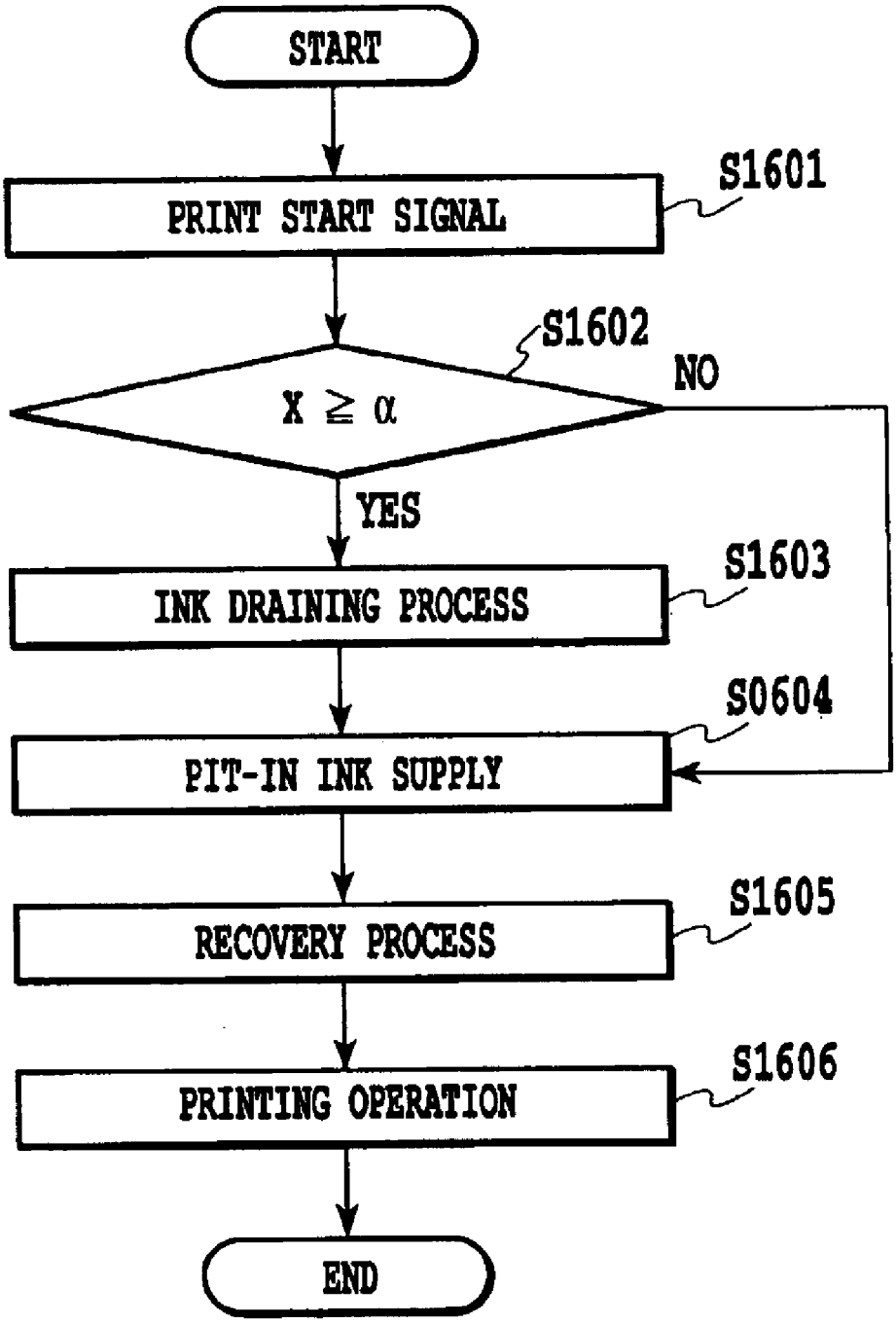
FIG. 16 is an illustration for explaining a sequence to perform an ink draining process according to the second embodiment of the present invention.

It should be noted that the process shown in the flowchart of FIG. 16 may be performed each time of reception of the print signal, or in the alternative, only upon reception of the first print start signal after turning ON of the power source.

With the second embodiment discussed above, when the non-use period is long, the ink density is estimated as high to perform pit-in ink supply after performing the ink draining process, and on the other hand, when the non-use period is short, the ink density is estimated as low to perform pit-in ink supply without performing ink draining process. Therefore, in addition to the effect of the first embodiment (reduction of drift of color tone and reduction of difference of density between a plurality of pages), saving of ink consumption can be achieved. In other words, with this embodiment, problems associated with condensation of ink can be reduced while restricting the ink draining amount.

(Third Embodiment)

The third embodiment is characterized by realization of further restriction of ink draining amount by controlling the ink draining amount by dividing ink draining amounts into a plurality of levels with small step amounts when the ink draining process in the second embodiment is performed. Specifically, this embodiment is characterized in that it changes the amount of ink drainage depending on the non-use time.

As set forth above, it becomes necessary to perform an ink draining process when the degree of ink condensation reaches an extent to cause color tone drift. It is desirable to set the ink draining amount in the ink draining process to be a constant amount, irrespective of the non-use period when simplification of control is considered important.

On the other hand, when importance is given for reduction of the ink draining amount, it is desirable to differentiate the ink draining amount depending upon the non-use period. In greater detail, since there is a tendency that a longer non-use period results in a higher ink condensation degree, the ink draining amount is made greater for a longer non-use period and is made smaller for a shorter non-use period. For example, consideration is given for the case where the ink draining amount is controlled in three levels (0, L1, L2). In this case, as shown in FIG. 17, the range of the time count value X ($T1<X\leqq T2$, $T2<X$) and ink draining amount L1, L2 ($0<L1<L2$) are preliminarily associated, and the ink draining amount is varied depending upon the range to which the time count value X belongs. By this arrangement, the ink draining amount is gradually increased to L1 and then L2 in association with an increase of the non-use period. It should be noted that when the time count value X is in a range of $0<X\leqq T1$, an ink draining period is not performed as the non-use period is short. In other words, the ink draining amount is 0.

As set forth above, with the third embodiment, since ink draining amount is varied in a plurality of levels depending upon the non-use period, the ink draining amount can be further reduced in comparison with the second embodiment.

(Fourth Embodiment)

When the significant amount of ink has already been reduced during the preceding printing operation (namely, when ink consuming amount upon printing is large), the ink amount b101 in FIG. 14A is sufficiently small. Associated with this, the remaining condensed ink amount b102 of FIG. 14B is also small. Accordingly, in FIG. 14C, fresh ink (newly supplied ink) is sufficiently supplied to the remaining condensed ink by a pit-in ink supply. Therefore, the density of the mixed ink will not be so high. It is thus not always necessary to make the ink draining amount as large as those in the first and second embodiments. Therefore, in the fourth embodiment, in addition to non-use period of the sub-tank, the ink consuming amount upon printing is taken into account in determining whether the ink draining process is to be performed or not and/or controlling the ink draining amount, thus achieving further reduction of the ink draining amount.

It should be noted that the ink consuming amount upon printing is associated with the degree of the ink condensation. When the ink consuming amount is large, condensation of ink will not significantly affect ink density after pit-in ink supply as the remaining ink amount is small, and on the other hand, when the ink consuming amount is small, condensation of ink will significantly affect ink density after pit-in ink supply as the remaining ink amount is large. On the other hand, the ink consuming amount upon printing can be acquired by counting ejected dots by means of a dot counter. The dot counter is designed to increase a dot count value Y each time the number of ejected dots increases. For example, the dot count value may be incremented by one at every occasion of ejection of one dot.

Figure 18:
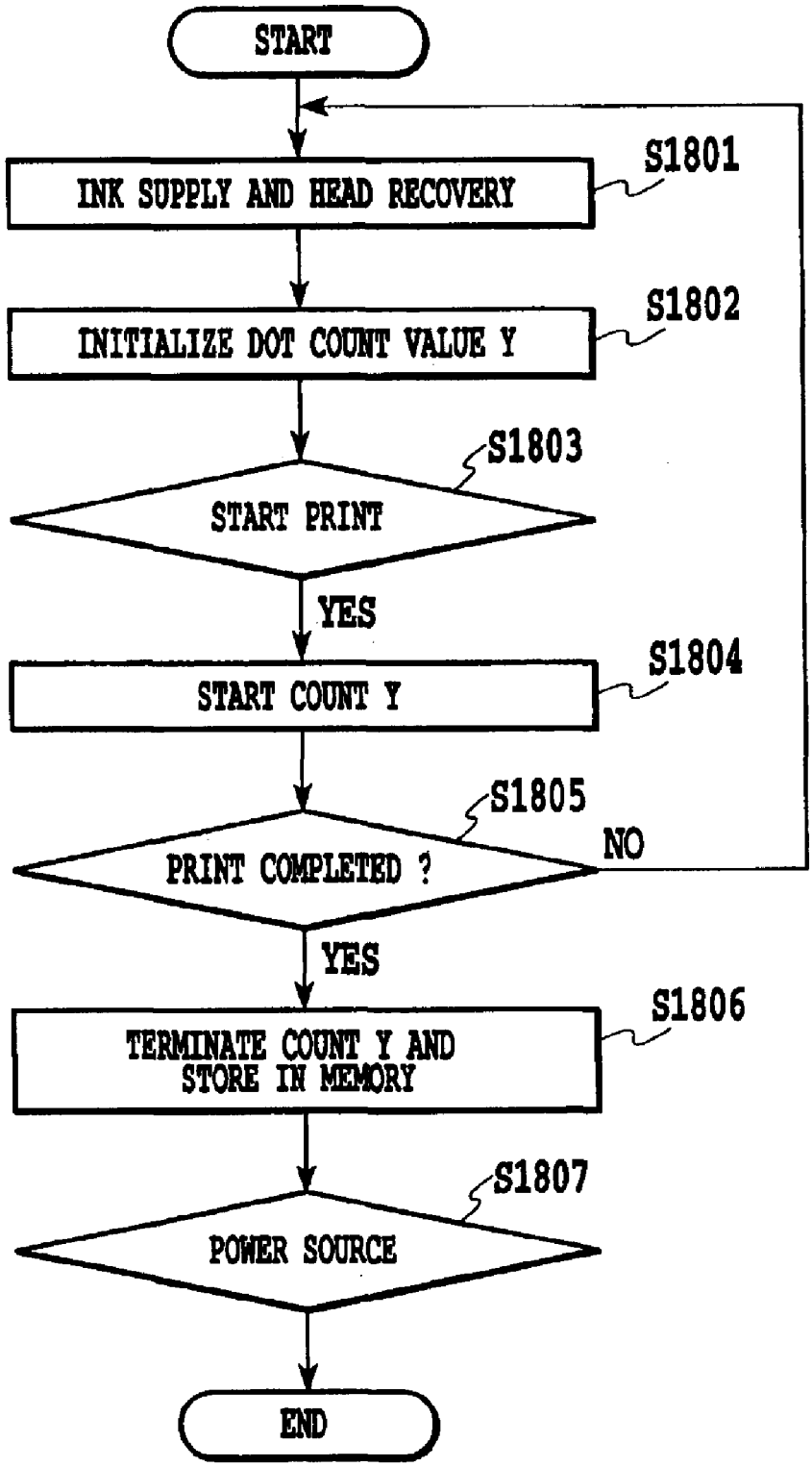
FIG. 18 is a flow chart explaining a sequence for obtaining a dot count value Y.

FIG. 18 is a chart showing the sequence for obtaining the dot count value. At first, at step S1801 of FIG. 18, ink is supplied from the main tank to the sub-tank by pit-in ink supply method. Subsequently, the recovery process for draining ink from the printing head is performed, with the suction operation, preparatory ejection and so on. Thereafter, at step S1802, the dot count value Y in the printer is initialized. When the printing is initiated at step S1803, the process is advanced to step S1804 to start counting by the dot counter. It should be noted that, in the shown embodiment, the particular point of time of starting the dot count is a time point when feeding of the printing paper to the printer is completed.

Next, the process is advanced to step S1805 to check whether the printing operation is to be terminated or not. Here, when data for a next print is not present, the printing operation is terminated. On the other hand, when not yet printed data is present, the process returns to step S1801 to repeat the foregoing processes until all data is printed and no data is present. When printing is completed, the process is advanced to step S1806 to terminate the dot count. Here, the count value Y is stored in the memory.

In this embodiment, whether the ink draining process is to be performed or not is controlled on the basis of the dot count value Y, and the non-use period count value X discussed in the second embodiment. In other words, while judgment at step S1503 of FIG. 15 as to whether the ink draining process is to be performed or not is made on the basis of the time count value X, a similar judgment as to whether the ink draining process is to be performed or not is made on the basis of the time count value X and the dot count value Y here in the fourth embodiment. In greater detail, using the time count value X and the dot count value Y, a value of X/Y is compared with a predetermined threshold value β, and when the value of X/Y is greater than or equal to β, on an assumption that the degree of ink condensation is large, it is determined to perform the ink draining process, and when the value of X/Y is smaller than β, on an assumption that degree of ink condensation is small, it is determined not to perform the ink draining process. In short, in the fourth embodiment, a process of the flowchart of FIG. 15 is carried out with step S1503 replaced with "X/Y>=β".

With the fourth embodiment set forth above, whether the ink draining process is performed or not and the ink draining amount are controlled on the basis of the non-use period of the sub-tank and the ink consuming amount in printing. Therefore, while reducing the problem associated with condensation of ink, the ink draining amount can be further restricted as compared with the second embodiment.

(Fifth Embodiment)

In advance of discussion for the fifth embodiment, common matters in the fifth to fifteenth embodiments will be discussed. In the fifth to fifteenth embodiments, discussion will be given for the case of a sub-tank having capacity to store 0.4 ml of ink. However, the ink capacity of the sub-tank is of course not limited to 0.4 ml. On the other hand, in the fifth to fifteenth embodiments, discussion will be given using "non-use period" as a period where the power source is held OFF between completion of printing at the preceding time and initiation of printing at the next time. However, the non-use period is not limited to the foregoing particular period but can be a period from turning OFF of the power source at the preceding time to initiation of printing at the next time, or a period from completion of printing at the preceding time to initiation of printing at the next time, for example. Further, in the fifth to fifteenth embodiments, discussion will be given for the case where the "non-use period" is managed by a number of days, but it can be managed by hours, minutes or seconds.

The fifth to eighth embodiments are common in terms that control as to whether the ink draining process is to be performed or not before pit-in ink supply for printing at the next time is done depending upon at least the non-use period (for example, number of days of non-use). Briefly speaking, a small recovery sequence and a medium recovery sequence are selectively performed at least depending upon the non-use period. Definitions of "small recovery sequence" and "medium recovery sequence" will be given later.

In the fifth embodiment, a period of time where the printer is left in the non-use state (left state) is calculated. When the non-use period is longer than or equal to a predetermined period, the ink draining process is performed for draining all (substantially all) of flowable ink in the sub-tank. On the other hand, when the non-use period is shorter than the predetermined period, the ink draining process is not performed. More particularly, when the non-use period is long, the ink draining process is performed before pit-in ink supply for the printing operation. On the other hand, when the non-use period is short, the ink draining process is not performed before pit-in ink supply for the printing operation. In short, based on the non-use period, control is performed for selectively performing medium recovery sequence and small recovery sequence.

Figure 20A:
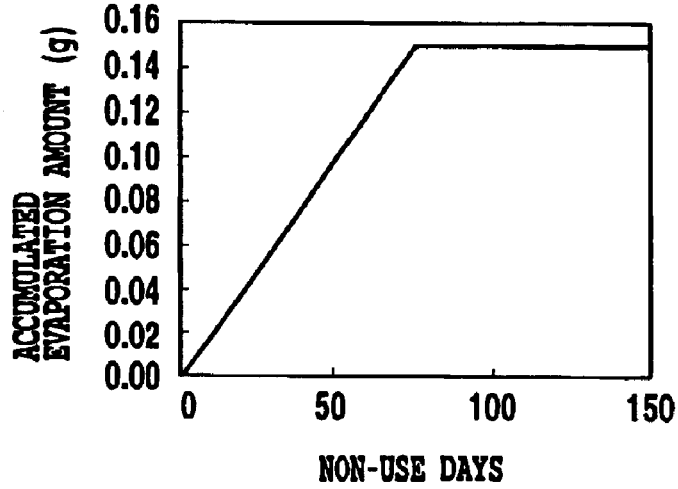
FIGS. 20A to 20C are graphic charts explaining extent of evaporation of remaining ink in the sub-tank and influence thereof as left in the condition where ink (200 μl of ink) in the sub-tank is left.
Figure 20B:
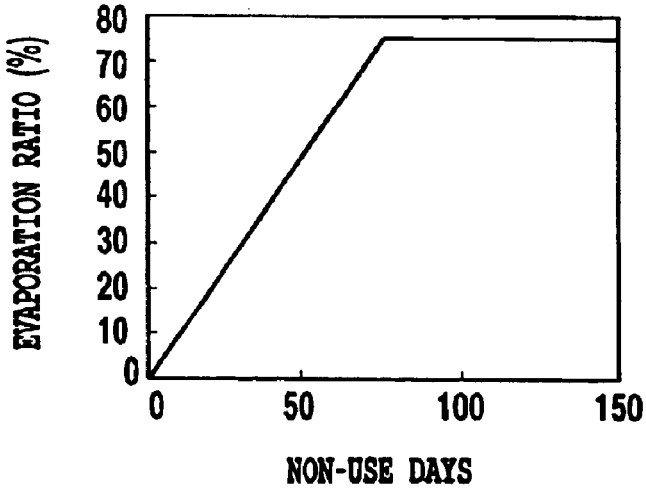
Figure 20C:
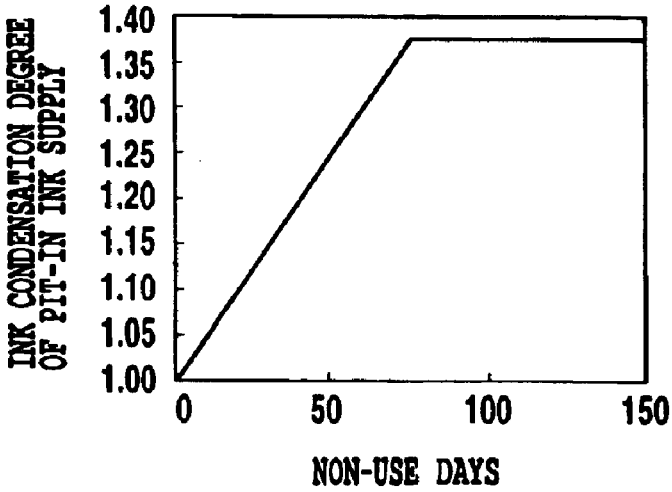

FIGS. 20A to 20C are graphic charts for explaining the degree of evaporation of remaining ink in the sub-tank and influence thereof in the case where ink in the sub-tank is left in a non-use state. In FIG. 20A, the horizontal axis represents non-use days and vertical axis is an accumulated evaporation amount G. The ink remaining amount in the sub-tank before start of being left unused is 0.2 ml (=200 μl) similarly to the prior art. In other words, while the ink capacity of the sub-tank for each color of ink to be filled is 0.4 ml, it is assumed that the non-use-state is started in the condition wherein ink is consumed to be about half and 0.2 ml of each color is left.

The fifth embodiment uses ink containing 5% by weight of coloring agent, 20% by weight of non-volatile solvent (7% by weight of ethylene glycol, 12% by weight of diethylene glycol, about 1% of surface active agent), and the remaining 75% by weight of volatile solvent (72.5% by weight of water, 2.5% by weight of isopropyl alcohol). Since the volatile component is 75% by weight, the evaporative amount becomes 200 μl×0.75=150 μl. Assuming that the evaporation rate is 2 μl/day similarly to the prior art, the volatile component is evaporated substantially completely within 75 days. That point is the inflection point in FIG. 20A. It should be noted that the values shown in FIGS. 20A to 20C are calculated values, and the inflection point is clear. In practice, however, evaporation becomes moderate before the inflection point to saturate with a smooth curve. For the purpose of disclosure, discussion will be given with reference to the graph of the calculated value.

In FIG. 20B, the horizontal axis represents non-use days and the vertical axis represents a ratio of evaporated ink weight relative to initially remaining ink weight (weight of remaining ink before start of the non-use state).

Figures 19A, 19B, 19C, 19D:
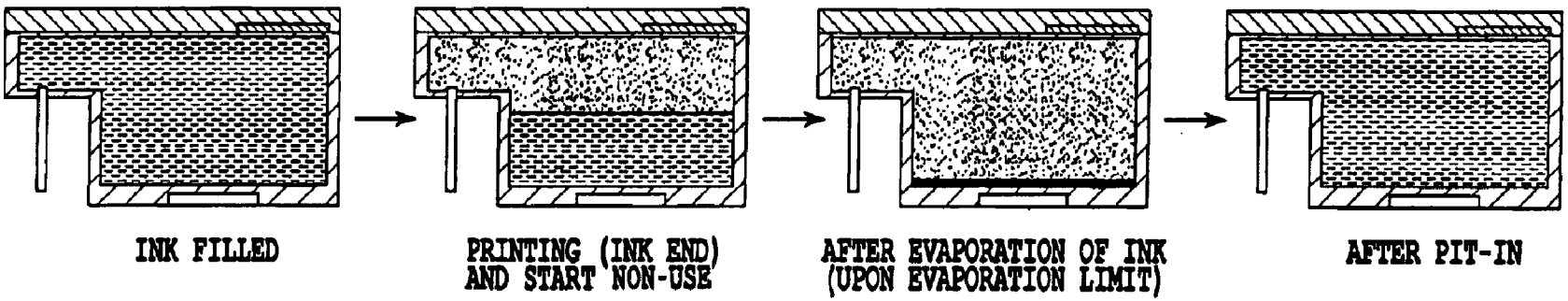
FIGS. 19A to 19D are schematic representations explaining a relationship between the sub-tank and a remaining ink amount in the sub-tank in time sequence (prior art)

Things explained heretofore are the same as those discussed in terms of the prior art, and the point of essentially complete condensation of ink in the sub-tank is the inflection point in FIG. 20C. Here, from the state of the sub-tank illustrated in FIG. 20C, when the user performs printing (namely printing after being left unused), in the prior art, ink is, at first, supplied into the sub-tank by the pit-in ink supply method. The resulting state is illustrated in FIG. 19D. While the supplied ink is fresh ink, the density of ink in the sub-tank becomes higher than that of fresh ink, since the remaining ink from the printing operation in the preceding time remains in a condensed condition. The calculated condensation degree is shown in FIG. 20C. The condensation degree of 1.1 times of ink density of fresh ink (namely, ratio of coloring agent derived by the amount of coloring agent/total ink amount, 5% in the shown embodiment) means that ink has 5.5% of the ink density of the coloring agent versus the initial density (5%) of the ink.

In FIG. 20C, the horizontal axis represents non-use days. For example, when pit-in ink supply is performed for printing after being left for 50 days from the state of the sub-tank of the remaining ink set forth above, fresh ink is supplied to the sub-tank and is admixed with the remaining condensed ink to form ink having a density of 1.25 times that of the initial ink density.

As a result of study made by the inventors, it has been found that, concerning ink used in the fifth embodiment, when the condensation degree of ink is smaller than or equal to 1.15 times, ΔE (color difference) in CIE1976 L*a*b color specification system is less than or equal to 5 and is preferable, and when the condensation degree of ink is smaller than or equal to 1.25 times, ΔE is about 10 which is at an allowable limit, and a greater condensation degree is not preferable. "An allowable limit" used here represents a limit value where the difference of color texture relative to a particular color can be perceived but is allowable for the case of ordinary photograph printing, mainly premised as the application of the printer of the present invention (photograph printer specialized for digital camera, for example). Of course, this value may be differentiated depending upon application of the printer.

In the present invention, even when the power source of the main body is held OFF, ASIC 500 is periodically actuated using an internal battery 515 to count up a period of time in which the power source of the printer is held OFF (namely the non-use period) and store it in EEPROM 509. Then, at the next printing, when the value of the non-use period stored in the EEPROM is greater than or equal to a predetermined value (here longer than or equal to 50 days), after initially draining all of flowable remaining condensed ink in the sub-tank, ink is supplied into the sub-tank by pit-in ink supply for performing printing after the predetermined recovery operation or the like. Therefore, it becomes possible to maintain a total ink condensation degree in the sub-tank after supplying ink by pit-in ink supply not exceeding 1.25 times, thus enabling to reduce a difference of color texture of the image in a printing operation in the next time after being left unused.

FIGS. 21A to 21E are schematic representations for explaining effects of the shown embodiment in relation to the prior art shown in FIGS. 19A to 19D. FIGS. 21A to 21C are similar to FIGS. 19A to 19C. However, as shown in FIG. 21D, in the shown embodiment, by detecting that the sub-tank is left for a predetermined period in the non-use state, a suction operation is performed to drain all of flowable remaining condensed ink in the sub-tank as much as possible after being left unused and before printing.

Suction for draining flowable remaining ink in the sub-tank is performed by applying negative pressure generated by a full stroke of a cylinder pump B304 to ejection nozzles B121 of the printing head B120 and maintaining the negative pressure while maintaining an atmosphere communication valve for communicating the cap B310 with atmosphere for a given period (here 20 seconds) in a closed condition for forced suction. The negative pressure to be generated may be variable depending upon the initial volume in the mechanism and stroke of the cylinder pump, and is preferred to be greater than or equal to 50 kPa for quickly draining ink in the sub-tank. Of course, the capacity of the cylinder pump is greater than the capacity of the sub-tank. Namely, the cylinder pump is designed for continuously applying negative pressure of 50 kPa or more for several dozen seconds for forced suction.

The sub-tank is communicated with atmosphere through the air suction opening, the vapor-liquid separation membrane and the air chamber, and is also communicated with atmosphere even by opening the needle B122 without connecting with the joint C105. By performing the suction set forth above in the state of communication with atmosphere, air is sucked from the air suction opening or the needle to suck ink from the sub-tank into the cylinder pump through the nozzles. Since ink is supplied in the sub-tank by performing pit-in ink supply as shown in FIG. 21E after draining ink in the sub-tank as shown in FIG. 21D, an increase of ink density due to ink remaining from printing in the preceding time can be prevented, thus enabling to perform printing in the state of substantially fresh ink even after being left unused.

It should be noted that, assuming that the ink amount to be contained in the sub-tank is V (ml), the ink remaining amount upon printing in the preceding time is v (ml), the evaporation speed is w (μl/day), and the number of non-use days is T (days), the ink amount to be supplied by pit-in ink supply in the next time becomes (V−v)+w·T. Therefore, the total ink density a" contained in ink at the preceding time may be expressed as follows, assuming that the initial ink density is a and remained ink density upon printing at the preceding time is also a:

$$a'' = \frac{((V-v)+wT)a+va}{V} = a\left(1+\frac{wT}{V}\right) \tag{1}$$

In other words, the ink condensation degree R" becomes a"/a=1+(wT/V), and in simplified process, it does not depend on the ink remaining amount upon printing at the preceding time. On the other hand, the number of days T where the ink condensation degree becomes greater than or equal to 1.25 times is determined by ((1.25−1)·V)/w. In the fifth embodiment, when the left period exceeds this T (days), a control is done to perform pit-in ink supply after draining ink in the sub-tank.

As set forth in the prior art, the evaporation speed w is the evaporation speed in an environmental condition where evaporation is most significant among operation environments of the printer. It should be noted that the evaporation speed experimentally derived under 30° C. of atmospheric temperature and 10% of relative humidity is used.

By performing control of the ink draining process depending upon the non-use period (for example, non-use days), there was no significant variation in ink density in the sub-tank after pit-in ink supply, and the density of the image is natural. Furthermore, even when the same image is printed continuously, printed outputs were without visually perceptive density difference between the printed images.

With the fifth embodiment set forth above, since whether the ink draining process before pit-in ink supply is to be performed or not is controlled depending upon the non-use period (for example, non-use days), it becomes possible to reduce influence of ink condensation while restricting the ink draining amount.

(Sixth Embodiment)

In the sixth embodiment, for determining whether the ink draining process is to be performed or not, consideration is given not only to the non-use days, but also to an amount of remaining ink (ink remaining amount) in the sub-tank at a point of time of completion of printing in the preceding time. In short, on the basis of the ink remaining amount in the sub-tank at the completion of printing and the non-use days, control as to whether the ink draining process is to be performed or not is performed before pit-in ink supply. Simply stated, on the basis of the ink remaining amount in the sub-tank after completion of printing at the preceding time and the non-use period, control is performed as to whether the medium recovery sequence is to be performed or the small recovery sequence is to be performed. It should be noted that "small recovery sequence" and "medium recovery sequence" will be defined later.

Figure 22A:
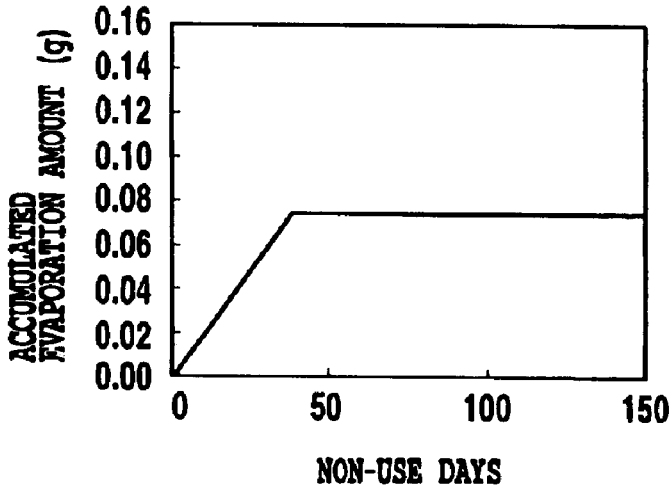
FIGS. 22A to 22C are graphic charts explaining extent of evaporation of remaining ink in the sub-tank and influence thereof as left in the condition where ink (100 μl of ink) in the sub-tank is left.
Figure 22B:
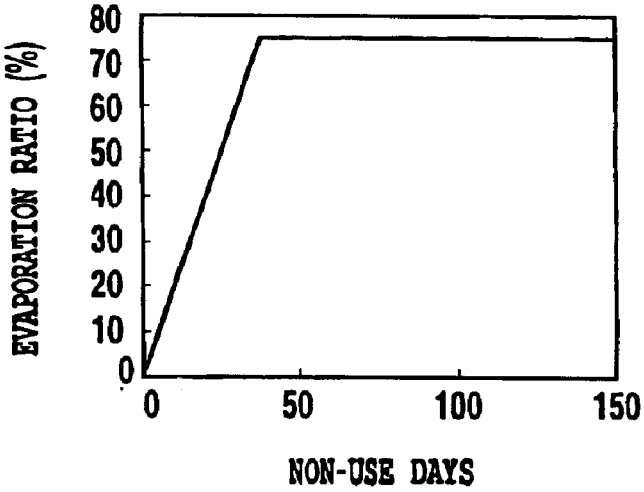
Figure 22C:
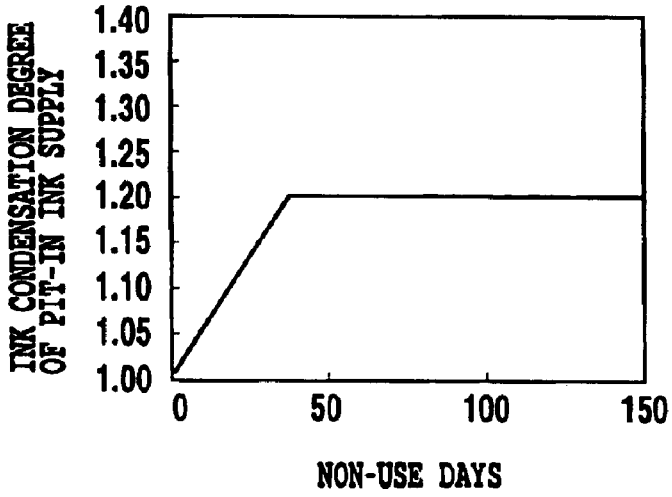

FIGS. 22A to 22C are graphic charts corresponding to FIGS. 20A to 20C of the case where the non-use state is started in the state where the ink remaining amount in the sub-tank is 100 μl. Incidentally, the ink remaining amount of FIGS. 20A to 20C is 200 ml. An accumulated evaporation amount of FIG. 22A is increased with the same gradient as FIG. 20A initially. However, since the ink remaining amount is smaller than that of the case of FIG. 20A, the evaporation limit is reached at a time point earlier than that of FIG. 20A. On the other hand, as shown FIG. 22B, since the initial remaining amount is smaller, the gradient of the evaporation ratio is greater than that of FIG. 20B to reach the evaporation limit at a time point (particularly about 30 days) earlier than 50 days.

The reason for the substantial difference of influence of evaporation depends upon the initial ink remaining amount, is the problem specific to the pit-in ink supply method using a small sub-tank, and is caused due to the small capacity of the sub-tank. It should be pointed out that, as shown in FIG. 22C, even when the evaporation limit is reached, and when fresh ink is supplied to such condensed ink, the ink condensation degree in total may not reach 1.25 times taken as threshold value in the fifth embodiment since evaporation stops. Therefore, no problem arises in terms of variation of color texture (density becoming higher) of the images due to condensation of ink. Accordingly, as in the fifth embodiment, even when the evaporation limit is reached, no problem will arise with the sixth embodiment if viscosity of the remaining condensed ink is relatively low (slightly higher than 100 mPas in the ink of the fifth embodiment).

However, for example when the solvent having high viscosity, such as glycerin, or when the solid component, such as urea or the like, is used, the viscosity of the remaining condensed ink that has reached the evaporation limit is greater than or equal to about 400 mPas. Then the viscosity becomes 200 times or more of the normal ink viscosity, thus causing difficulty in normal recovery.

The ink composition can be modified for various reasons, such as for solubility of the coloring agent to the solvent and presence/absence of the possibility of causing deterioration in the printing head. The sixth embodiment uses ink composed of 5% by weight of coloring agent, 20% by weight of non-volatile solvent (8% by weight of glycerin, 6% by weight of diethylene glycol, 5% by weight of urea, about 1% of surface active agent), and the remaining 75% by weight of volatile solvent (72.5% by weight of water, 2.5% by weight of isopropyl alcohol).

Therefore, the viscosity of the remaining condensed ink reaching the evaporation limit is different from the fifth embodiment. Specifically, the viscosity of the ink becomes greater than or equal to 400 mPas or more to reach two hundred times or more of the normal ink viscosity. Normal recovery becomes difficult for ink of such high density. However, in the case where the sub-tank is left unused for 30 days or more to reach the evaporation limit, if the ink draining process is performed to drain all of the ink in the sub-tank before pit-in ink supply as in the fifth embodiment, when the non-use state starts in the state where a relatively large amount of ink is remaining in the sub-tank (i.e., as in the example of FIGS. 20A to 20C), ink in the sub-tank is drained as left for 30 days or more to needlessly increase ink consuming amount.

Since the present invention is premised for use in a relatively small photograph printer or the like, the capacity of ink storage is naturally not large. Accordingly, when the ink consuming amount is large, the running cost per one sheet of printing becomes high. For this reason, in the sixth embodiment, in order to adapt to difference of the ink viscosity after being left due to difference of the ink remaining amount in the sub-tank after printing in the preceding time, the ink draining process before pit-in ink supply is controlled in consideration of not only the non-use period, but also the ink remaining amount in the sub-tank upon completion of printing of the preceding time. In other words, in the sixth embodiment, the ink remaining amount in the sub-tank at the completion of printing of the preceding time is stored in the EEPROM in the main body, and further, as discussed in the fifth embodiment, the non-use period (non-use days in this embodiment) is counted up and stored in the EEPROM. Then, on the basis of the ink remaining amount at the completion of printing of the preceding time and the non-use period, recovery sequences before printing in the next time are switched.

Particularly, on the basis of the ink remaining amount (v) at the completion of printing at the preceding time and the non-use days (T), the recovery sequences are switched as shown in the following table. In the table, "-" represents that the ink draining process (process to drain all of flowable ink in the sub-tank) is not performed before pit-in ink supply, and pit-in ink supply is performed and subsequently a normal recovery process (suction recovery operation and preparatory ejection operation) is performed. In other words, a "small recovery sequence" (defined later) is performed. On the other hand, "o" represents that the ink draining process is performed before pit-in ink supply, pit-in ink supply is performed, and subsequently a normal recovery process is performed. Namely, a "medium recovery sequence" (defined later) is performed.

TABLE 1

| Ink remaining Amount | Left days | | | | |
|---|---|---|---|---|---|
| | T < 25 | 25 ≦ T < 30 | 30 ≦ T < 35 | 35 ≦ T < 40 | 40 ° T |
| V < 100 μl | — | o | o | o | o |
| 100 ≦ V < 200 μl | — | — | o | o | o |
| 200 ≦ V < 300 μl | — | — | — | o | o |
| 300 ≦ V < 400 μl | — | — | — | — | o |

Here, discussion will be given for means for precisely detecting the ink amount remaining in the sub-tank after printing. At first, since the ink amount to be stored in the sub-tank and the ink amount to be drained by the recovery operation are fixed values, they are stored in ROM 504 or EEPROM 509. It should be noted that since there is some tolerance in the ink amount to be stored in the sub-tank or the ink amount to be drained by the recovery operation between apparatus bodies, precision in detection of the ink remaining amount can be further enhanced by correcting such tolerance.

Next, ASIC 500 has a function of integrating the ink ejection amount per one ink droplet ejected by an ejecting operation (hereinafter referred to as a dot counter). The ink remaining amount in the sub-tank can be derived by subtracting the ink amount drained by the recovery operation as well as an ink consuming amount derived by the number of ink droplets counted by the dot counter x the ejection amount in one droplet from the ink amount capable of being stored in the sub-tank. Here, since the capacity of the sub-tank is set at 0.4 ml, precision to 0.0001 ml is preferred as the precision in detection of the ink remaining amount. It should be noted that the ink amount of one ink droplet may slightly fluctuate per printing head, and precision can be further enhanced by correction taking such fluctuation into account.

Then, control of the recovery operation was performed depending upon the non-use period (for example, non-use days) and the ink remaining amount in the sub-tank at completion of printing at the preceding time. As a result, in addition to the effects achieved by the fifth embodiment, occurrence of ejection failure due to ink of increased viscosity could be eliminated or reduced even when ink of this embodiment was used, and furthermore the ink draining amount by the ink draining process would not become excessively large.

With the sixth embodiment set forth above, control of the recovery operation depending upon the non-use period (for example, non-use days) and the ink remaining amount in the sub-tank at completion of printing at the preceding time was performed. Therefore, problems associated with condensation of ink can be lessened by restricting the ink draining amount.

(Seventh Embodiment)

Flowable ink in the sub-tank as set forth in connection with the fifth embodiment does not include ink that cannot be drained due to not being supplied with air such as ink wetting a sponge of PP fibers of the sub-tank, or depositing or being trapped on a surface layer on the inner surface of a frame body and corner portions.

The amount of non-flowable ink depends on the structure of the sub-tank, and particularly on the density and diameter of fibers of the sponge in the sub-tank. In the seventh embodiment, when the sponge having a density of 0.4 g/cm$^3$ and formed with PP fibers of 6 deniers was used, the amount of non-flowable ink (hereinafter referred to as dead ink) in the sub-tank having a capacity for storing 0.4 ml of ink was 0.06 ml. Accordingly, in practice, remained ink cannot be drained completely after printing at the preceding time unlike that shown in FIG. 21D. As a result, accurately, the ink density of FIG. 21E is slightly higher than that of fresh ink. On the other hand, the evaporation amount wT does not increase infinitely depending upon non-use days, but increases according to an increase of non-use days until the evaporation limit is reached and evaporation is stopped after reaching the evaporation limit (accurately, the solvent component difficult to evaporate may continue to evaporate slightly). Taking the foregoing into account, the seventh embodiment controls the recovery operation more precisely and thereby enables avoidance of unnecessary consumption of ink, as will be discussed hereinafter.

In this seventh embodiment, the ink remaining amount in the sub-tank and the ink condensation degree in the sub-tank are constantly controlled. Cases to vary the ink remaining amount in the sub-tank include the following four different situations: (1) ink is supplied to the sub-tank by pit-in ink supply as an event, (2) ink is consumed by suction recovery, preparatory ejection or printing, (3) ink in the sub-tank is evaporated by being left unused and (4) the process for draining all of flowable ink in the sub-tank, which process is unique to the present invention (ink draining process), is performed. On the other hand, the condensation rate of ink in the sub-tank varies only in the cases of (1) and (3). Here, parameters used in calculations are defined as shown in the following table 2. It should be noted that while the fill-up amount of the sub-tank is defined as V and the ink remaining amount in the sub-tank is defined as v in the fifth embodiment, the ink remaining amount in the sub-tank is defined as V and the consumed amount (=sucked amount+ejected amount) is defined as v in the seventh embodiment.

TABLE 2

| | Parameter | Unit |
|---|---|---|
| Value before Event | Ink reamining amount in Sub-tank | V μl |
| | Ink Condensation Degree in Sub-tank | R Times |
| Evaporation Relationship upon Leaving | Left days | T Days |
| | Evaporation rate | 2.0 μl/day |
| Value related to Ink Composition | Rate of Non-Volatile Component | α — (ex. 0.25) |
| Value related to Ink Consumption | Ink Consumption Amount | v μl |
| Value related to Sub-Tank | Fill-up Amount | 400 μl |
| | Dead Ink Amount | 60 μl |

Here, the rate of the non-volatile component is a ratio of the non-volatile component (coloring agent+solvent difficult to evaporate) in ink. For example, in the fifth and sixth embodiments, the rate of non-volatile component is 25%=0.25.

After the events of (1) to (4), the ink remaining amount V in the sub-tank and the ink condensation degree R in the sub-tank may be expressed as shown in the following table 3. V and R in the relational expressions in the right column are the current ink remaining amounts in the sub-tank and the ink condensation degree in the sub-tank, and V and R in the center column are the ink remaining amounts in the sub-tank after respective events and the ink condensation degree in the sub-tank.

TABLE 3

| Event | Ink Remaining Amount in Sub-Tank | Ink Condensation Degree in Sub-Tank |
|---|---|---|
| After Pit-in Ink Supply | o<br>V = 400 μl | o<br>R = {(400 − V) + V × R}/400 |
| After Ink Consuming Operation | o<br>V = V − v | –<br>(not varied) |
| After being left (After Evaporation) | o<br>V = Max (V × (α · R), V − 2.0 · T) | o<br>V = R × [V/Max (V × (α × R), T − 2.0 · T)] |
| After Draining All | o<br>V = 60 μl | –<br>(not varied) |

Varied = "o"/Not Varied "–"

It is obvious that the ink remaining amount after pit-in ink supply is 400 μl upon being filled up, and that the ink remaining amount after draining the whole amount is 60 μl. The ink remaining amount after the ink consuming operation (after printing) becomes an amount subtracting the consumed ink amount v calculated using the dot counting function as discussed in connection with the sixth embodiment from the current ink remaining amount V (V−v). Concerning the ink remaining amount after being left unused, since the ink condensation degree before being left unused is R, the rate of non-volatile component before being left unused becomes α×R, and the value derived by multiplying the ink remaining amount V before being left unused by $\alpha \times R$ is the amount of the non-volatile component ($V \times \alpha \times R$) contained in the ink before being left unused. On the other hand, as ink is evaporated by 2.0 μl per day, the remaining amount after being left for T days becomes $V-2.0 \times T$. The greater one of these (namely, not smaller than the evaporation limit) is the ink remaining amount in the sub-tank, taking evaporation after being left into consideration.

On the other hand, concerning the ink condensation degree R, when the volume becomes half of the initial volume by evaporation, the condensation degree is doubled. Therefore, a reciprocal number of variation of volume is the ink condensation degree in the sub-tank, taking evaporation after being left unused into account. Furthermore, since when the current ink remaining amount in the sub-tank is V, the ink amount to be supplied by pit-in ink supply is 400−V, the ink condensation degree after pit-in ink supply may be a value derived by adding a product of the current ink amount in the sub-tank and the ink condensation degree to 400−V and then dividing by the fill-up amount of the sub-tank. In this process, by updating V and R before and after each event, the condition in the ink in the sub-tank is monitored constantly.

Figure 23:
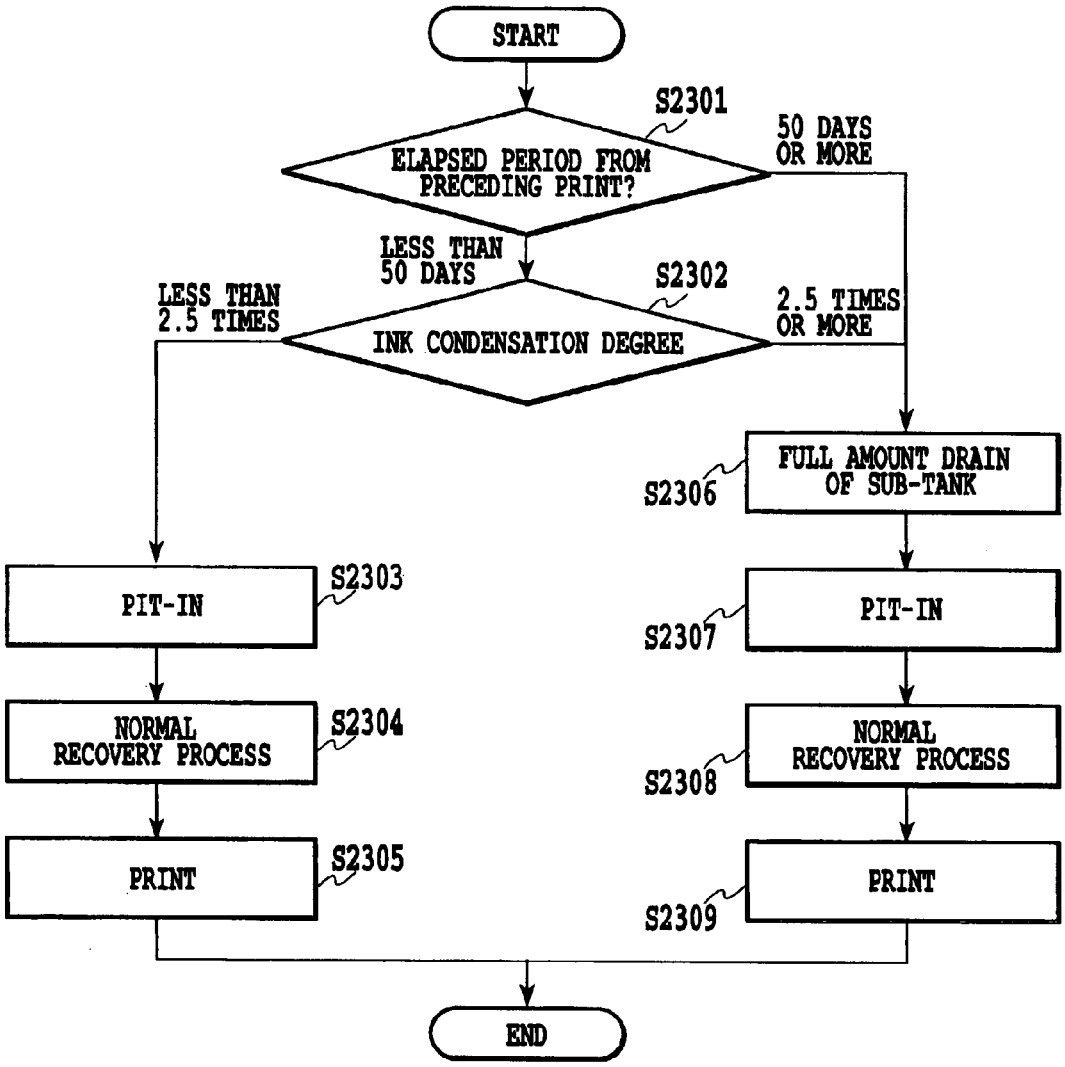
FIG. 23 is a flow chart explaining a sequence to perform an ink draining process of the seventh embodiment of the present invention.

Then, in the seventh embodiment, as shown in the flowchart of FIG. 23, similarly to the fifth embodiment, when the non-use period (elapsed time after completion of printing at the preceding time) is longer than or equal to the predetermined period (here longer than or equal to 50 days), all of flowable ink is drained (full amount drainage) among the remaining ink in the sub-tank, then pit-in ink supply is performed, and subsequently, the normal recovery process (suction operation) and the printing process are performed. In conjunction therewith, even when the non-use period is shorter than the predetermined period (here, shorter than 50 days), if the ink condensation degree in the sub-tank is greater than or equal to a predetermined value (here, 2.5 times or more), the same process is performed as the process in the case where the non-use period is longer than or equal to 50 days. On the other hand, when the non-use period is shorter than the predetermined period and the ink condensation degree is smaller than the predetermined value, pit-in ink supply is performed without performing full amount drainage for draining all of ink in the sub-tank, and subsequently, the normal recovery process (suction operation) and the printing process are performed. Briefly speaking, the small recovery sequence and the medium recovery sequence are selectively performed depending at least upon the non-use period and the ink condensation degree. The definitions of "small recovery sequence" and "medium recovery sequence" will be given later.

Figure 24:
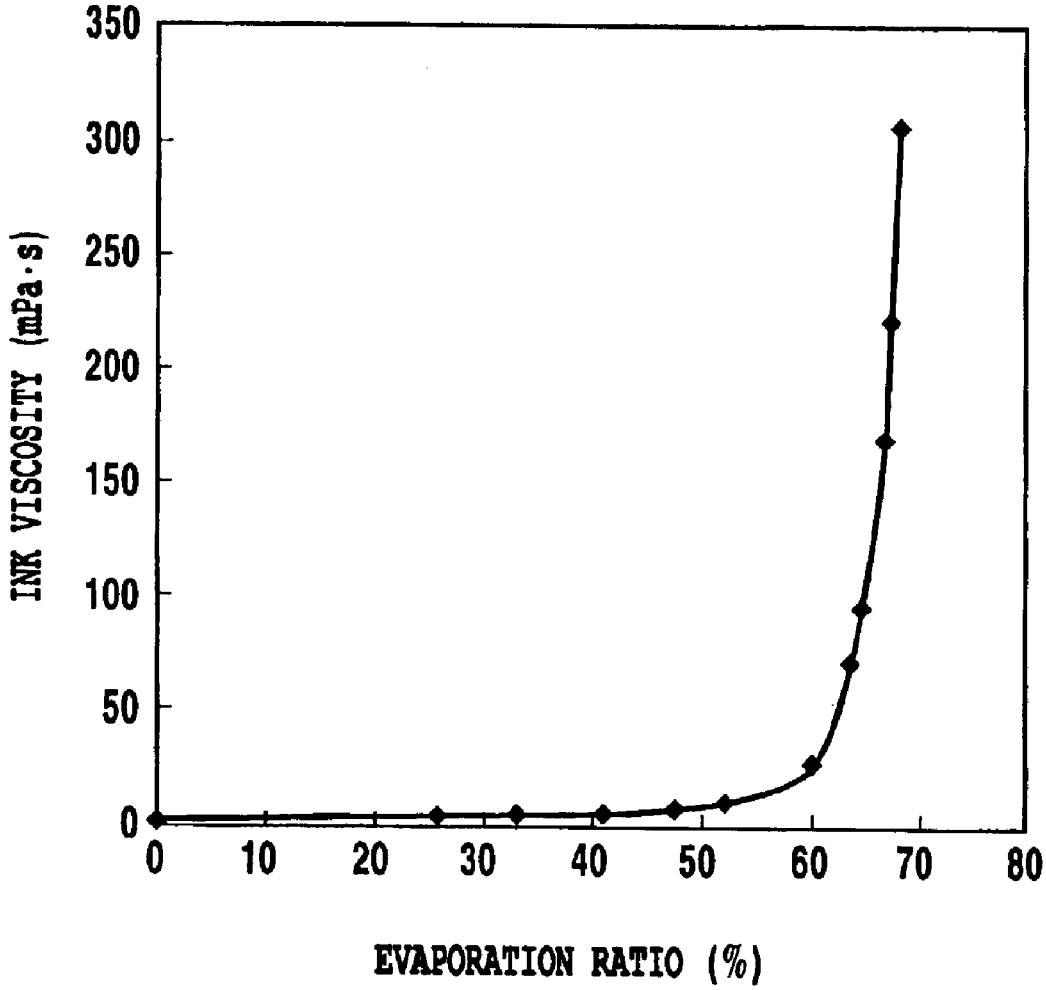
FIG. 24 is a graphic chart showing a relationship between an ink evaporation rate and viscosity to be used in the seventh embodiment of the present invention.

It should be noted that the ink used in the shown embodiment is similar to that used in the sixth embodiment. However, a relationship between evaporation ratio and the viscosity of ink is shown in FIG. 24. 2.5 times of the condensation ratio means that the volume becomes 40% of the initial volume. Therefore, it can be converted as 60% of the evaporation ratio. Ink viscosity is swiftly increased when the evaporation ratio exceeds 60%. In the seventh embodiment, 2.5 times of the condensation ratio is taken as the threshold value, and the foregoing ink draining process is performed even when the non-use period is shorter than the predetermined period if the condensation degree is greater than the predetermined value.

In this seventh embodiment, since the recovery method is controlled depending upon the viscosity of the ink (or the evaporation ratio correlated with the viscosity or ink condensation ratio), precise measurement can be taken to permit further reduction of the ink consuming amount.

As set forth above, on the basis of the non-use days, the ink remaining amount in the sub-tank at the completion of printing at the preceding time and the ink condensation degree in the sub-tank at the completion of printing at the preceding time, the ink condensation degree in the sub-tank of printing at the next time is calculated. Then, recovery control is differentiated depending upon the ink condensation degree and the non-use days to achieve effects achieved in the fifth and sixth embodiments. In addition, the ink consuming amount can be further reduced. As a result, it becomes possible to provide a printer which achieves a low running cost per sheet.

(Eighth Embodiment)

Figure 25:
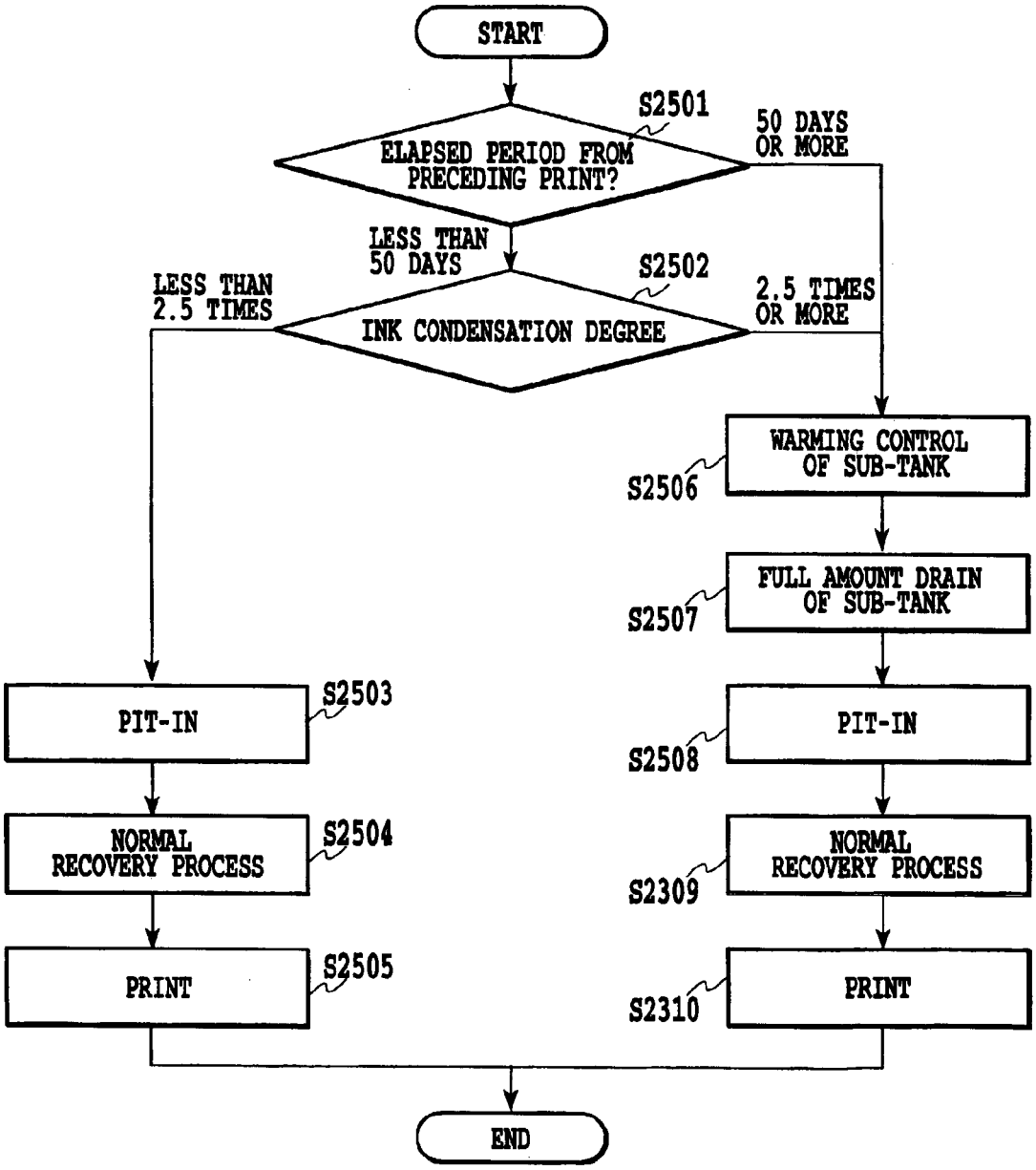
FIG. 25 is a flow chart explaining a sequence to perform an ink draining process of the eighth embodiment of the present invention.

The eighth embodiment is characterized by warming of the printing head prior to the ink draining process for draining ink from the sub-tank (for example, full amount drainage process), and the rest of the embodiment is similar to the first to seventh embodiments and discussion will be eliminated for avoiding redundant disclosure for simplification in order to facilitate clear understanding of the present invention. In the shown embodiment, as shown by the flowchart in FIG. 25, the ink draining process (full amount drainage process) in the first to seventh embodiments is performed in the condition where ink in the printing head and sub-tank is warmed by a warming process of the printing head.

In the printing head, a heater for ink ejection is provided. A current in a magnitude not to cause ejection of ink is applied to the heater (hereinafter referred to as "apply warming pulse") to warm ink around the nozzles of the printing head. The warming pulse preferably has an amplitude half or less of a pulse for generating a bubble. In the shown embodiment, the warming pulse is 0.3 μsec whereas the bubbling pulse is 0.7 μsec. When the warning pulse is applied for a long period, the apparatus can warm ink not only in the vicinity of the nozzles of the printing head, but also in the ink passage and further in the sub-tank. It should be noted that temperature control is performed by reading the output of a diode sensor or the like provided in the printing head.

By applying the warming pulse, control is performed so that the head temperature reaches 50° C. in the eighth embodiment. On the other hand, control is performed to maintain 50° C. as target temperature for 30 seconds after reaching the head temperature of 50° C. The ink temperature in the vicinity of the nozzles reaches substantially the target temperature after 30 seconds. Thus, while viscosity of ink upon reaching the evaporation limit in the fifth embodiment is 400 mPas at normal temperature (25° C.), the shown embodiment may lower viscosity of ink down to several dozen mPas.

By warming ink of increased viscosity by evaporation after being left unused, the ink viscosity can be lowered to facilitate full amount drainage of the ink in the sub-tank. By warming, reliability can be improved even when the ink has quite high viscosity at the evaporation limit (such as ink containing a large amount of glycerin).

(Ninth Embodiment)

In the first to eighth embodiments, discussion is given for performing the ink draining process (for example, full amount drainage process) before pit-in ink supply for the printing operation. However, in the ninth embodiment, in advance of the ink draining process, pit-in ink supply is performed in order to facilitate ink drainage. The reason to perform the ink draining process further before pit-in ink supply will be discussed hereinafter.

As discussed in connection with the first to eighth embodiments, by performing the ink draining process before pit-in ink supply for the printing operation, the remaining condensed ink in the sub-tank is basically drained. Accordingly, basically, the ink draining process sequence in the first to eighth embodiments will be sufficient. However, even when the ink draining process is performed, it is possible that the intended amount of the remaining condensed ink cannot be drained. For example, even when an attempt is made to drain the full amount of remaining condensed ink, it is possible that the full amount of ink cannot be drained. It is predicted that this is caused due to the following phenomenon.

Figure 26A:
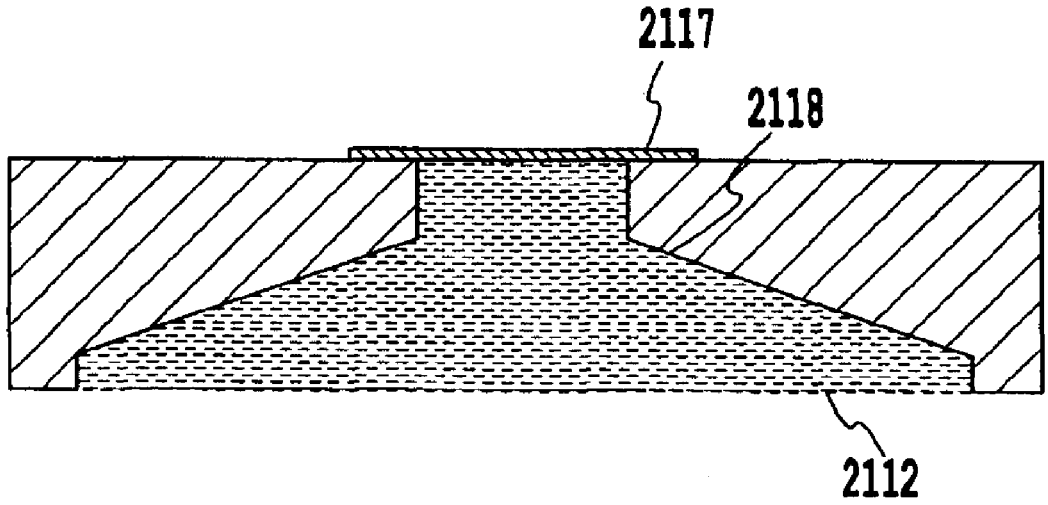
FIGS. 26A and 26B are schematic representations explaining a case where ink with increased viscosity remains after an ink drainage process.
Figure 26B:
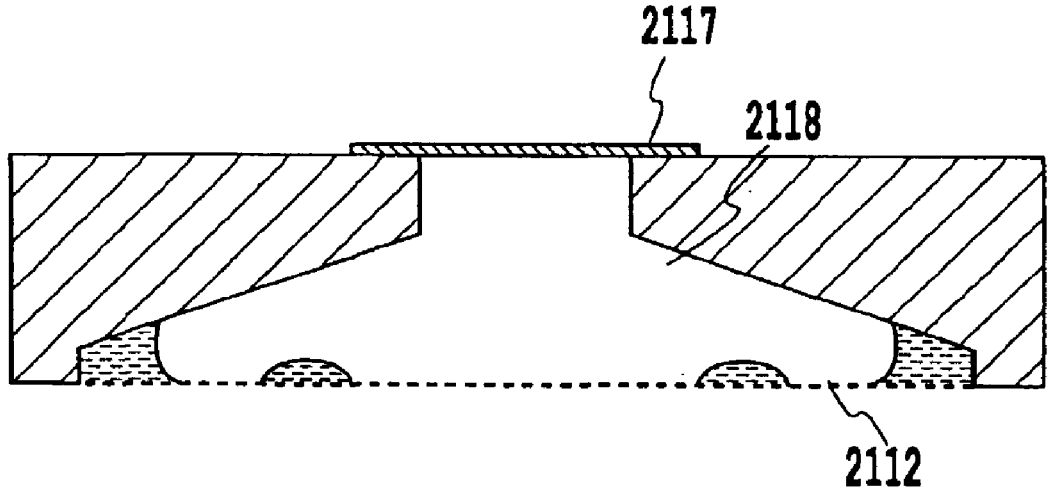

FIG. 26A is a detailed representation of the printing head illustrating the ink passage and the nozzle. The reference numeral 2117 denotes an SUS filter provided at an ink inlet opening from the sub-tank. Reference numeral 2118 denotes an ink passage and 2112 denotes a nozzle array. For example, it is assumed that ink with high viscosity is filled in the ink passage after being left unused as shown in FIG. 26A. Here, ink with increased viscosity is quite difficult to flow even when a strong ink draining process (for example, drawing ink at a large negative pressure for a long period) is performed. On the other hand, there are nozzles through which ink easily flows and nozzles through which it is difficult for ink to flow due to tolerance in nozzle diameters in production, tolerance in shapes or a little tolerance in evaporation ratios between respective nozzles. Once ink starts to flow in a nozzle, ink in the vicinity thereof flows to facilitate draining of ink through the nozzles therearound, whereas in the nozzle through which ink does not flow in a relatively initial stage, it is difficult to perform drainage. Diagrammatically illustrating, as shown in FIG. 26B, remaining condensed ink (ink with increased viscosity) may remain slightly. It should be noted that this phenomenon is caused with higher possibility at end portions of the nozzle array.

Even when fresh, non-evaporated ink is filled into the ink passage 2118 by performing pit-in ink supply and a subsequent normal recovery operation in the state where ink with increased viscosity remains, since the ink with increased viscosity cannot be dissolved quickly, ink with increased viscosity may reside in the vicinity of the ejection openings to possibly cause ejection failure. The reason why the ink with increased viscosity cannot be sucked by the normal recovery operation after pit-in ink supply is the difference of viscosity between non-evaporated ink and ink with increased viscosity. Since ink with increased viscosity is difficult to flow even by performing suction recovery, only non-evaporated ink with lower viscosity flows to be sucked through the nozzle.

As set forth above, in the pit-in ink supply method, increase of viscosity due to evaporation of ink is significant, even when the foregoing ink draining process is performed, ink with increased viscosity after being left unused for a long period of time cannot be drained, or even when the ink with increased viscosity can be drained, draining can be insufficient, thereby possibly causing ejection failure. Accordingly, it is desired to improve the draining performance of the remaining condensed ink (ink with increased viscosity) by the ink draining process.

Figure 27:
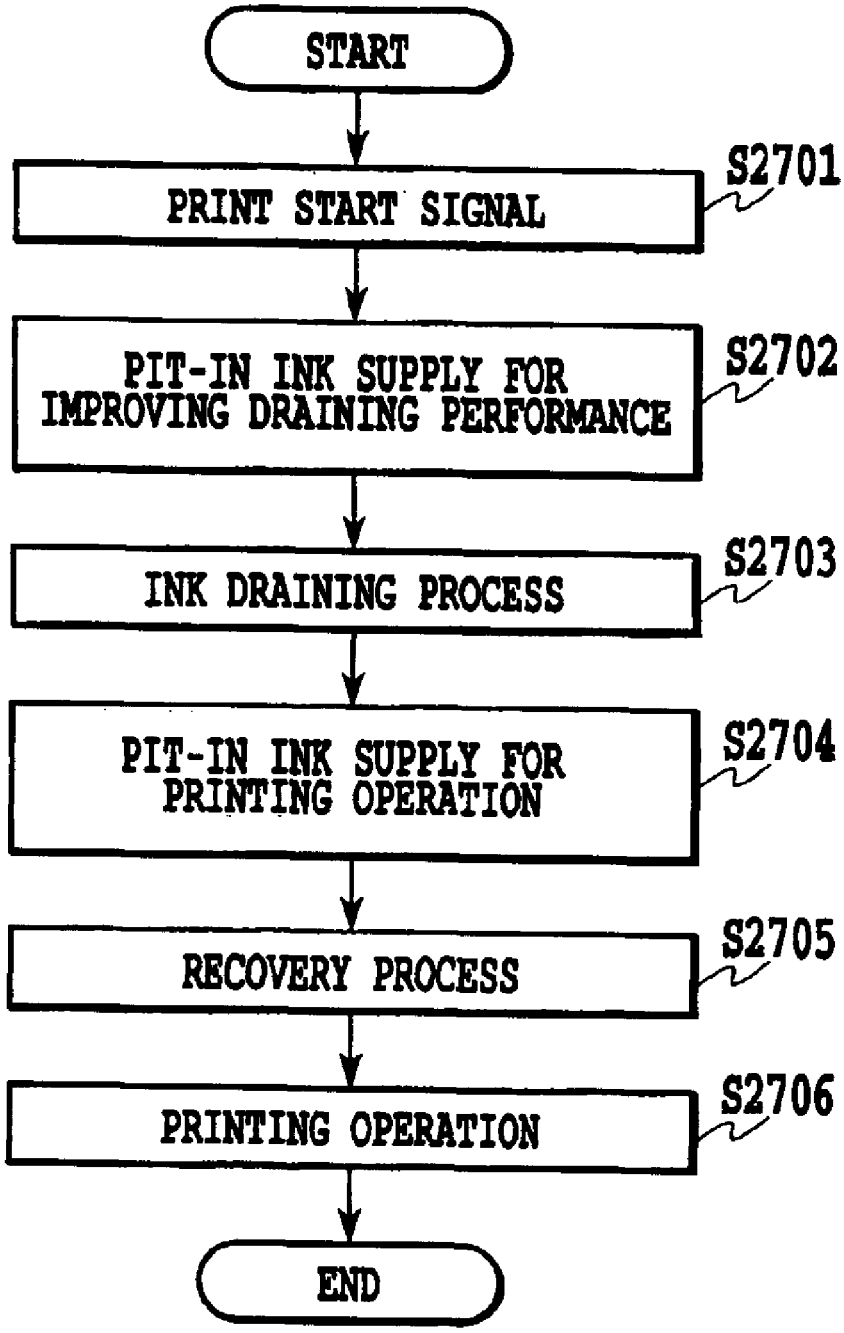
FIG. 27 is a flow chart explaining a sequence to perform an ink draining process of the ninth embodiment of the present invention.

Therefore, with the ninth embodiment, pit-in ink supply for facilitating the ink ejection process is performed before performing the ink draining process (for example, the full amount draining process) in advance of the pit-in ink supply process for the printing operation as shown in FIG. 27. Particularly, when the print start signal is received at step S2701 of the flowchart of FIG. 27, pit-in ink supply is performed for the purpose of improvement of draining performance of the ink with increased viscosity (remaining condensed ink) at step S2702. Next, at step S2703, the ink draining process (for example, the full amount draining process) for draining ink from the sub-tank is performed. Subsequently, the process is advanced to step S2704 to perform pit-in ink supply for the printing operation. Subsequently, at step S2705, the normal recovery process is performed, and at step 2706, the printing operation is started.

As set forth above, with the ninth embodiment, pit-in ink supply is performed before the ink draining process to increase solubility of the ink with increased viscosity by mixing fresh ink supplied in the pit-in ink supply so that ink with increased viscosity can be dissolved and thus conditioned to be easily drained during the ink draining process. Accordingly, the possibility of draining of the ink with increased viscosity by the ink draining process before pit-in ink supply for the printing operation becomes high. As a result, in comparison with the first to eighth embodiments, the possibility of occurrence of ejection failure can be reduced.

(Tenth Embodiment)

The tenth embodiment controls whether pit-in ink supply for improving ink draining performance and the ink draining process are to be performed in advance of pit-in ink supply for a next printing operation, at least depending upon the non-use period (for example, non-use days). This feature is common to the eleventh to fourteenth embodiments discussed later. Briefly, the small recovery sequence and medium recovery sequence are selectively performed at least depending upon the non-use period. Definitions of "small recovery sequence" and "medium recovery sequence" will be given later.

In the tenth embodiment, a period where the printer is left in the non-use state (non-use period) is calculated. When the non-use period is longer than or equal to the predetermined period, after performing first pit-in ink supply (pit-in ink supply for improving ink draining performance) to the sub-tank, the ink draining process for draining all (substantially all) of flowable ink in the sub-tank is performed. On the other hand, when the left period is shorter than the predetermined period, the first pit-in ink supply and the ink draining process are not performed. More particularly, when the non-use period is long, in advance of the second pit-in ink supply (pit-in ink supply for the printing operation), the first pit-in ink supply and ink draining process are performed. On the other hand, when the non-use period is short, the first pit-in ink supply and ink draining process are not performed before the second pit-in ink supply.

Figures 28A, 28B, 28C, 28D, 28E, 28F:
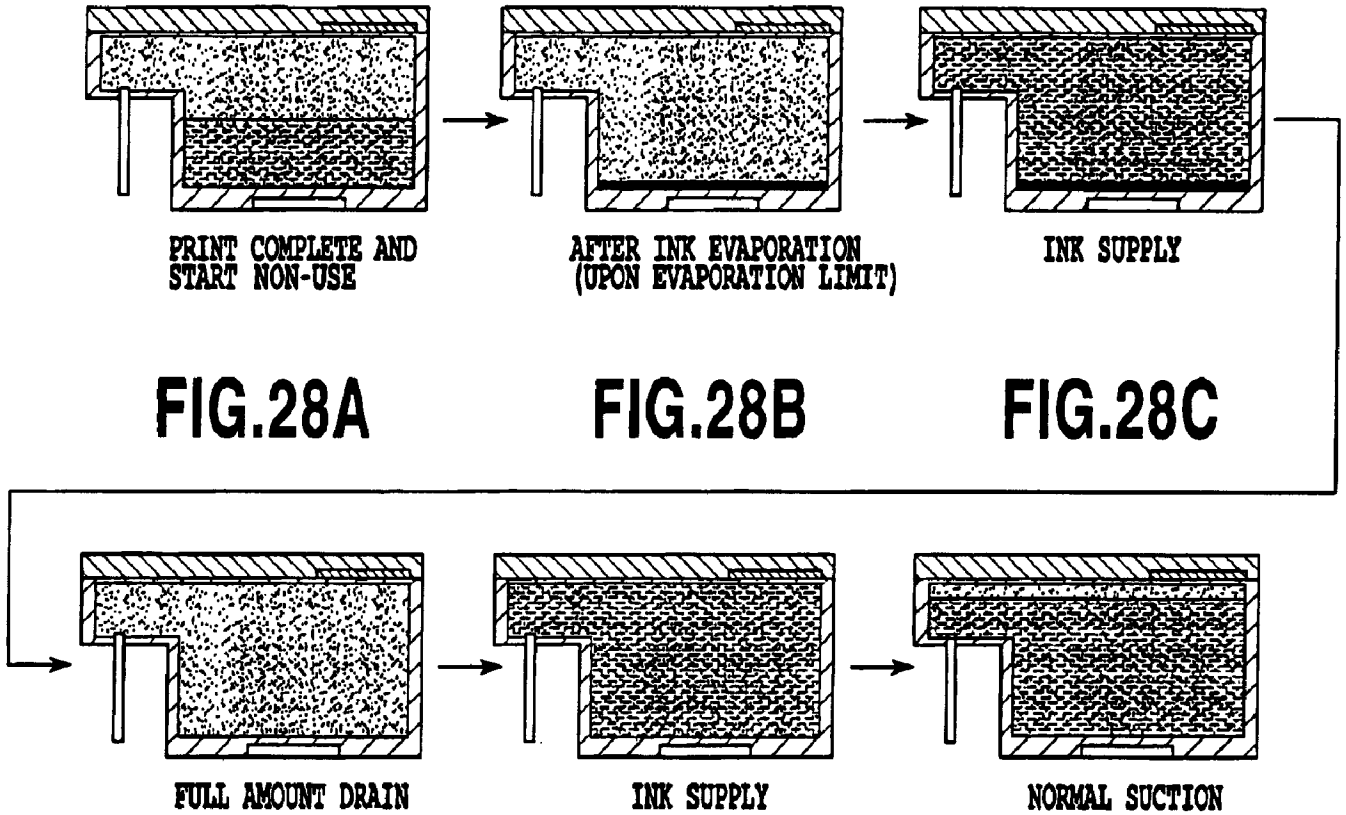
FIGS. 28A to 28F are schematic representations showing states of remaining ink in the sub-tank for explaining the tenth embodiment of the present invention.

FIGS. 28A to 28F are diagrammatic representations showing states of the remaining ink in the sub-tank. FIG. 28A shows that the ink remaining amount in the sub-tank at completion of printing at the preceding time and before being left is a minimum amount (here, 0.15 cc). An ink amount capable of being stored in the sub-tank is 0.4 cc, the maximum size of the printing paper is 4"×6" (4 inches×6 inches), and the ink amount to be used for printing is 0.2 cc (each color) at the maximum. The ink amount to be used for the recovery process (suction operation) to be performed as required upon printing is 0.04 cc. Assuming the ink amount to be used for the recovery process to be performed as required upon printing is 0.05 cc in consideration of fluctuation, the ink amount derived by subtracting the ink amount used for printing and the ink amount used for the recovery process from the ink amount 0.4 cc as the capacity of the sub-tank (i.e. 0.15 cc) becomes the minimum ink remaining amount in the sub-tank immediately after printing.

The tenth embodiment used ink containing 5% by weight of coloring agent, 20% by weight of non-volatile solvent (8% by weight of glycerin, 6% by weight of diethylene glycol, 5% by weight of urea and about 1% of surface active agent), and the remaining 75% by weight of volatile solvent (72.5% by weight of water, 2.5% by weight of isopropyl alcohol). Since the volatile component is 75% by weight, the evaporative amount becomes 150 μl×0.75=112.5 μl. Assuming that the evaporation speed is 2 μl/day similarly to the fifth embodiment, the volatile component is evaporated substantially completely within 56 days. In practice, evaporation becomes moderate before the inflection point to saturate with a smooth curve. At the evaporation limit, the viscosity of ink is quite high, as high as about 400 mPas. The state at the evaporation limit is shown in FIG. 28B.

Therefore, in this embodiment, before performing the ink draining process for draining ink with high viscosity in advance of pit-in ink supply (second pit-in ink supply) for the printing operation, a pit-in ink supply (first pit-in ink supply) is performed for improving the ink draining performance by supplying fresh ink to the sub-tank. In the sub-tank, ink with high viscosity and fresh ink are mixed to drain all of flowable ink in the sub-tank.

As shown in FIG. 28C, upon performing printing after being left unused, if the non-use period is longer than or equal to a predetermined period (here, longer than or equal to 60 days), ink is supplied by pit-in ink supply so as to fill up the sub-tank. Next, in the state shown in FIG. 28D, full amount suction of ink is performed. Discussion will be given for full amount suction in the sub-tank with reference to the general structure of the pit-in ink supply and recovery system of FIG. 4. After fitting the cap B310 on the printing head B120, the atmosphere communication valve (not shown) connected to the atmosphere communication opening B404 is closed to form an enclosed space in the cap B310. Then, the piston is moved in the direction of the arrow in the cylinder pump B304. Since ink with quite high viscosity (also referred to as ink of high viscosity or remaining condensed ink) in the head is present, the response of ink after application of pressure is low. In some cases, a flow of ink is not caused even when the piston is moved in a full stroke. At this time, negative pressure is quite large, as large as about 80 kPa. By continuing this condition for about several dozen seconds, even ink of high viscosity may be drained as long as ink does not firmly adhere.

Figure 29:
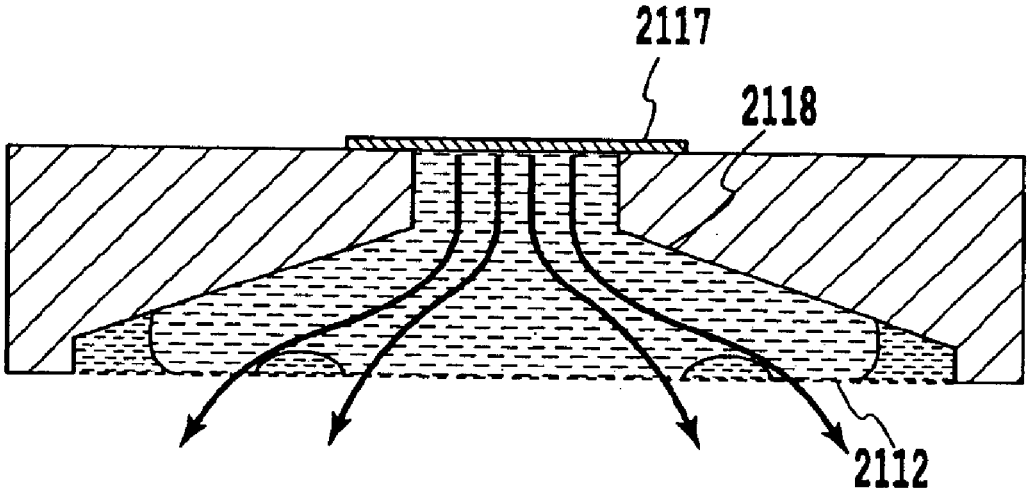
FIG. 29 is a schematic representation showing flow of ink in the case where pit-in ink supply is performed before an ink drainage process.

As set forth above, it is possible that ink of high viscosity partially remains without being drained. However, in the shown embodiment, since the pit-in ink supply to the sub-tank is performed before performing the ink draining process for removing the ink of high viscosity (remaining condensed ink) in the sub-tank, fresh ink supplied into the sub-tank by pit-in ink supply flows to the portion where the ink of high viscosity remains as shown by the arrows in FIG. 29. By this arrangement, ink of high viscosity is dissolved to a state to be easily drained. On the other hand, the ink amount to be drained flowing through the ink passage 2118 is larger than that in normal recovery process and, therefore, ink of high viscosity can be more effectively dissolved and drained. As set forth above, in the shown embodiment, by washing remaining condensed ink with fresh ink before the ink draining process for dissolving, remaining condensed ink can be easily drained during the ink draining process. As a result, when second pit-in ink supply is performed for filling up ink to the sub-tank again as shown in FIG. 28E and then the normal recovery process (suction operation) is performed as shown in FIG. 28F, ejection failure is not caused in the nozzles even after being left for a long period, and good quality of printing can be thus obtained.

It should be noted that, as a comparative example, from the condition shown in FIG. 28C, the normal recovery process of FIG. 28F (suction operation) was performed directly (skipping steps of FIGS. 28D and 28E) and subsequently printing was performed (this series of processes will be hereinafter referred to as a "small sequence"). In such case, since the viscosity of the ink is high, ink of high viscosity remained to make recovery impossible. It should be noted that the normal recovery process (suction operation) means suction recovery to be performed after filling ink in the sub-tank by the pit-in ink supply system, and is suction recovery for sucking 0.4 cc of ink of each color as set forth above. Concerning the normal recovery, discussion will be given with reference to the general structure of FIG. 4. After fitting the cap B310 on the printing head B120, the atmosphere communication valve (not shown) is closed to block atmosphere communication opening B304 to form the enclosed space within the cap B310. Then, ink is sucked from the nozzle by shifting the piston in the cylinder pump B304 in the direction of the arrow and suction is terminated by opening the atmosphere communication valve after about 1.5 sec. It is understood that in such suction, negative pressure for suction is small and the suction period is short to be insufficient for draining ink of high viscosity.

It should be noted that, as set forth above, the "small recovery sequence" is a sequence from the state shown in FIG. 28B to the state shown in FIG. 28F via the condition shown in FIG. 28C (skipping conditions of FIG. 28D and 28E). In short, the small recovery sequence is a recovery sequence to perform pit-in ink supply (second pit-in ink supply as shown in FIG. 28C for the next printing) for the sub-tank containing ink of high viscosity (remaining condensed ink) after being left (state shown in FIG. 28B, and subsequently performing the normal recovery process (FIG. 28F)). It should be noted that in the "small recovery sequence", the state shown in FIG. 28C corresponds to the second pit-in ink supply.

Furthermore, definitions for other sequences will be given. As set forth in the ninth embodiment, a sequence from the state shown in FIG. 28B to the condition shown in FIG. 28F via conditions of FIGS. 28C, 28D and 28E is referred to as the "large recovery sequence". In short, the "large recovery sequence" is a recovery sequence to perform pit-in ink supply for improving the ink draining performance (first pit-in ink supply shown in FIG. 28C) to the sub-tank in the state where ink of high viscosity (remaining condensed ink) is present after being left unused (condition shown in FIG. 28B), then perform the ink draining process (full amount draining) of FIG. 28D, thereafter perform pit-in ink supply for the next printing (second pit-in ink supply shown in FIG. 28E), and subsequently perform the normal recovery process (FIG. 28F). It should be noted that in a "large recovery sequence", FIG. 28C corresponds to the first pit-in ink supply and FIG. 28E corresponds to the second pit-in ink supply.

Also, definitions for still other sequences will be given: a sequence from the state shown in FIG. 28B to FIG. 28F via FIGS. 28D and 28E (skipping the step of FIG. 28C) is referred to as a "medium sequence". In short, the "medium sequence" is the recovery sequence to perform the ink draining process (full amount draining) of FIG. 28D for the sub-tank of the state where ink of high viscosity (remaining condensed ink) after being left unused is present (state shown in FIG. 28B), then perform pit-in ink supply (second pit-in ink supply shown in FIG. 28E) for the next printing, and subsequently perform the normal recovery process (FIG. 28F). In the "medium recovery sequence", FIG. 28E corresponds to the second pit-in ink supply.

Concerning measurement of the non-use period in the shown embodiment, even in the state where the power source of the main body is turned OFF, ASIC 500 is periodically actuated using the internal battery 515 to count UP the period of time to maintain the power source of the printer OFF (namely, the non-use period) and store in EEPROM 509. Then, upon the next printing, when the value of the the non-use period (count value) is longer than or equal to the predetermined period (here longer than or equal to 60 days), draining of all of flowable ink in the sub-tank is performed after supplying fresh ink in the sub-tank by pit-in ink supply, then refilling ink to the sub-tank by pit-in ink supply again, and subsequently performing the normal recovery operation (suction operation and so on) to perform printing.

On the other hand, during suction, the sub-tank is communicated with the atmosphere through an air suction opening via the vapor-liquid separation membrane and the air chamber and is also communicated with the atmosphere by placing the needle opened without piercing into a joint rubber. By performing suction under the atmosphere communicating state, air is sucked through the air suction opening or the needle, and then ink in the sub-tank is sucked into the cylinder pump through the nozzles. As set forth above, the evaporation speed is that in the most severe condition of evaporation among operational environments of the printer. Here, an evaporation speed that was preliminarily derived through experiments under environmental conditions of 30° C. of atmospheric temperature and 10% of relative humidity is taken as the evaporation speed.

Figure 30:
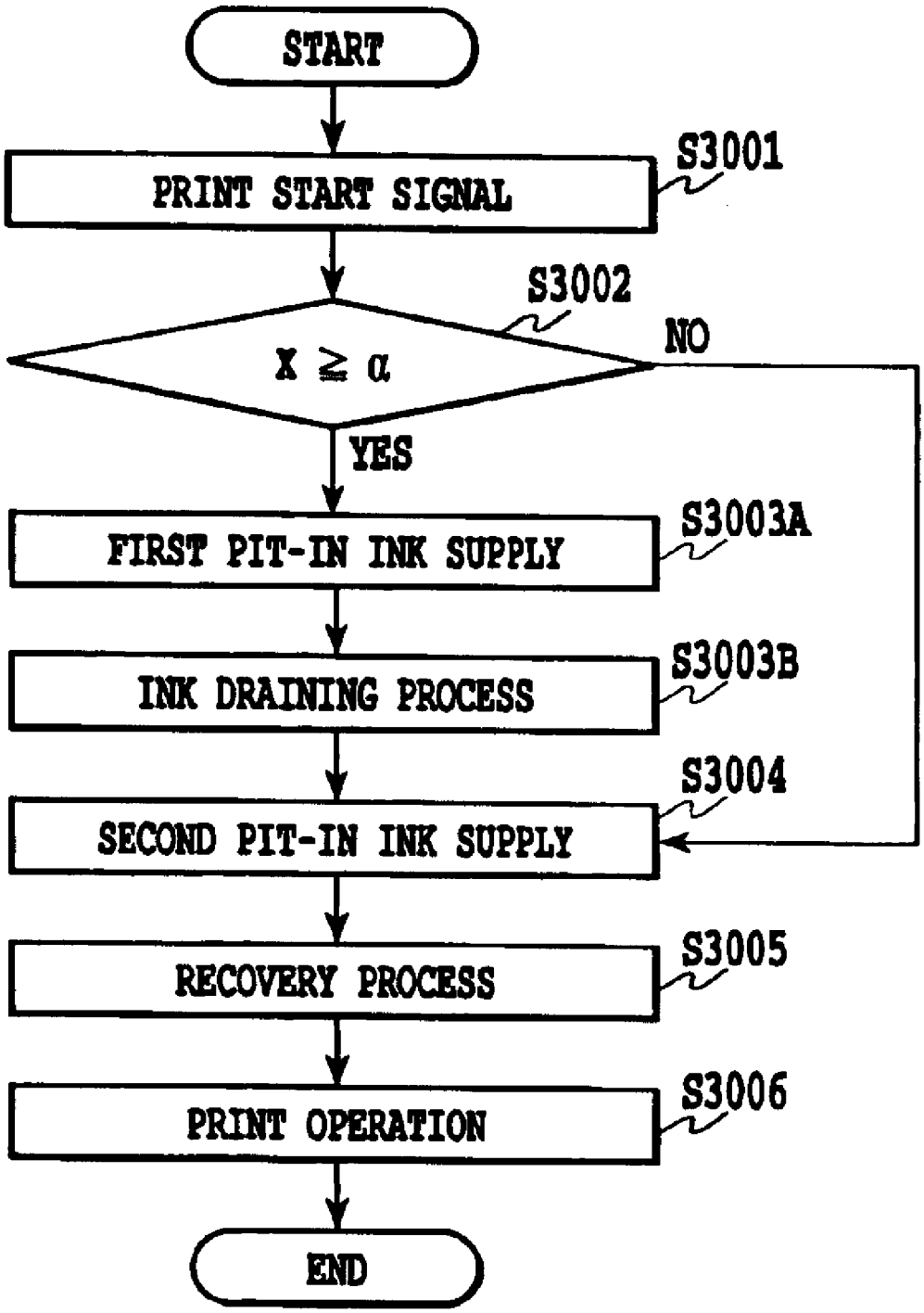
FIG. 30 is a flow chart explaining a sequence to perform an ink draining process of the tenth embodiment of the present invention.

Here, the ink draining process sequence of the tenth embodiment will be discussed with reference to FIG. 30. Briefly, in the tenth embodiment, control as to whether the small or large recovery sequence is to be performed is performed depending upon the non-use period. In FIG. 30, discussion will be given for the process taking a period of time of the next printing (upon reception of the next print start signal) as the time of judgment on whether pit-in ink supply for improving the ink draining performance and the ink draining process are to be performed or not.

Discussion will be given for the flowchart of FIG. 30. At first, when the print start signal is received at step S3001, judgment is made as to whether the time count value X is greater than or equal to the threshold value $\alpha$ at step S3002. When the value X is less than $\alpha$ at step S3002, the process is advanced to step S3004 without performing the first pit-in ink supply (step S3003A) and ink draining process (step S3003B). On the other hand, if the value X is greater than or equal to $\alpha$, the ink draining process is performed at step S3003B after performing the first pit-in ink supply at step S3003A (pit-in ink supply for improving the ink draining performance). Subsequently, the process is advanced to step S3004. The draining amount in the ink draining process can be the same as that in the ninth embodiment. After performing pit-in ink supply (second pit-in ink supply) for the printing operation at step S3004, the normal recovery operation (suction operation) is performed at step S3005. Then, printing operation is performed at step S3006. It should be noted that the flowchart shown in FIG. 30 may be modified to execute the process each time of reception of the print signal or to execute only upon reception of the first print start signal after turning ON of the power source.

With the foregoing tenth embodiment, control as to whether the first pit-in ink supply and the ink draining process are to be performed before the second pit-in ink supply or not is performed depending upon the non-use period (for example, non-use days). Therefore, it becomes possible to restrict the problem of condensation of ink (particularly, occurrence of ejection failure in the nozzles) while restricting the ink draining amount, and good quality images can be printed.

(Eleventh Embodiment)

In the eleventh embodiment, whether the first pit-in ink supply and ink draining process are to be executed or not is determined considering not only the non-use period, but also the amount of remaining ink (ink remaining amount) in the sub-tank at the completion of printing at the preceding time. In short, control as to whether the large recovery sequence or small recovery sequence is to be performed is performed on the basis of the ink remaining amount in the sub-tank at the completion of the printing at the preceding time and the non-use period.

A greater ink remaining amount in the sub-tank results in a longer period of time to reach the evaporation limit. When the ink remaining amount in the sub-tank is 400 μl, the time period to reach the evaporation limit is 150 days, when the ink remaining amount in the sub-tank is 300 μl, the time period to reach the evaporation limit is 112 days, when the ink remaining amount in the sub-tank is 200 μl, the time period to reach the evaporation limit is 75 days and when the ink remaining amount in the sub-tank is 150 μl (minimum remaining amount) as in the tenth embodiment, the time period to reach the evaporation limit is about 56 days. In other words, the period to reach the evaporation limit is significantly differentiated depending upon the ink remaining amount in the sub-tank. The reason why influence of evaporation is significantly differentiated depending upon the initial ink remaining amount is due to the small capacity of the sub-tank and thus is a problem specific to the pit-in ink supply system having a small sized sub-tank. Therefore, in the tenth embodiment, in consideration of the minimum ink remaining amount, all of ink in the sub-tank is drained after ink supply to the sub-tank for draining the ink of high viscosity when the non-use days are longer than or equal to 60 days to dissolve locally remaining ink of high viscosity by washing so as not to cause ejection failure of the nozzle at the next printing.

However, since the time period to reach the evaporation limit significantly differs depending upon the ink remaining amount in the sub-tank at the completion of printing at the preceding time, when the recovery sequence is determined without considering the ink remaining amount in the sub-tank at the completion of the printing at the preceding time, it is possible that the ink consuming amount becomes unnecessarily large. In other words, since the time period to reach the ink viscosity to cause necessity to perform the ink draining process is differentiated, it is necessary to consider the ink remaining amount in the sub-tank at the completion of printing at the preceding time in order to minimize the ink consuming amount associated with the ink draining process.

Since the present invention is premised for use in a relatively compact photograph printer, the capacity of ink is not satisfactorily large. Therefore, when the ink consuming amount is large, the running cost per print for one sheet becomes high. Therefore, in the eleventh embodiment, in order to adapt to the difference of the ink viscosity after being left unused depending upon the ink remaining amount in the sub-tank at the completion of printing at the preceding time, the recovery sequence is controlled in consideration of the non-use period and the ink remaining amount in the sub-tank at the completion of printing at the preceding time. In other words, in the eleventh embodiment, the ink remaining amount in the sub-tank at the completion of printing at the preceding time is stored in the EEPROM of the main body, and the non-use period is counted up and stored in the EEPROM as discussed in the tenth embodiment. Then, on the basis of the ink remaining amount in the sub-tank upon completion of printing at the preceding time and the non-use period, the recovery sequence before printing for the next printing is varied.

Particularly, on the basis of the ink remaining amount (v) at the completion of printing at the preceding time and the non-use days (T), the recovery sequence is varied as shown by the following table 4. In the table, "-" represents that the first pit-in ink supply (pit-in ink supply for improving the ink draining performance) and the ink draining process are not performed before the second pit-in ink supply (pit-in ink supply for the next printing), and the second pit-in ink supply is performed and subsequently the normal recovery process (suction recovery operation and preparatory ejection operation) are performed. In other words, the sequence corresponds to the "small recovery sequence". On the other hand, loll represents that all of flowable ink in the sub-tank is drained after the first pit-in ink supply, then the second pit-in ink supply is performed and subsequently, the normal recovery process is performed. In other words, the sequence corresponds to the "large recovery sequence".

TABLE 4

| Ink remaining Amount (V) | Left days T < 60 | 60 ≦ T < 75 | 75 ≦ T < 95 | 95 ≦ T < 115 | 115 ≦ T < 135 | 135 ≦ T |
|---|---|---|---|---|---|---|
| 150 ≦ V < 100 μl | — | o | o | o | o | o |
| 200 ≦ V < 250 μl | | | o | o | o | o |
| 250 ≦ V < 300 μl | — | — | — | o | o | o |
| 300 ≦ V < 350 μl | — | — | — | — | o | o |
| 350 ≦ V < 400 μl | — | — | — | — | — | o |

It should be noted that detection of the ink remaining amount in the sub-tank at the completion of printing can be done as discussed in connection with the sixth embodiment.

As set forth above, with the eleventh embodiment, control as to whether the first pit-in ink supply and the ink draining process are to be performed or not is carried out depending upon the non-use period (for example, non-use days) and the ink remaining amount in the sub-tank at the completion of printing at the preceding time. Therefore, in addition to the effect of the tenth embodiment, the ink consuming amount can be effectively reduced.

(Twelfth Embodiment)

The twelfth embodiment is characterized in that the ink condensation degree is considered in addition to the non-use days at making judgment on whether or not the first pit-in ink supply and the ink draining process are to be performed before the second pit-in ink supply, or not. It should be noted that the reason for considering the ink condensation degree is set forth in connection with the seventh embodiment. On the other hand, the method of calculation of the ink condensation degree is as discussed in connection with the seventh embodiment. In short, with the twelfth embodiment, control as to whether the large recovery sequence or small recovery sequence is to be performed is performed on the basis of the non-use period and the ink condensation degree.

(Thirteenth Embodiment)

The thirteenth embodiment is characterized by warming of the printing head before the ink draining process (for example, full amount draining process) of the ninth to twelfth embodiments. Since other construction is the same as the ninth to twelfth embodiments, discussion for such common components will be eliminated for avoiding redundant disclosure for simplification in order to facilitate clear understanding of the present invention. The warming process of the printing head is required to be performed before the ink draining process, and therefore the warming process can be performed after the first pit-in ink supply and before the ink draining process, or before the first pit-in ink supply.

The method of the warming process of the printing head is as discussed in connection with the eighth embodiment and can be done by application of the warming pulse. With this arrangement, full amount drainage of the ink in the sub-tank can be facilitated to improve reliability even when ink having quite high ink viscosity at the evaporation limit (such as ink containing a large amount of glycerin) is used.

For example, when ink containing 5% by weight of coloring agent, 20% by weight of non-volatile solvent (14% by weight of glycerin, 2% by weight of diethylene glycol, 3% by weight of urea and about 1% of surface active agent), and the remaining 75% by weight of volatile solvent (72.5% by weight of water, 2.5% by weight of isopropyl alcohol) is used as ink, the viscosity after evaporation of the water component is high as the ratio of glycerin is large to increase the viscosity up to the state of substantially nearly 100% of glycerin. Results of the recovering performance using such ink and varying the warming temperature are shown in the following table 5.

TABLE 5

| Warming Temperature (° C.) | Ink Viscosity (mPas) | Recovery Performance | Elevated Temperature Reaching Period (sec) |
|---|---|---|---|
| 25° C. (not warmed) | About 1000 | x | (Nil) |
| 30° C. | 560 | Δ | 2 seconds |
| 40° C. | 220 | o | 8 seconds |
| 50° C. | 90 | o | 15 seconds |
| 60° C. | 45 | o | 25 seconds |
| 80° C. | 18 | o | 45 seconds |

As can be clear from table 5, by warming ink of high viscosity after evaporation by the warming process, the viscosity of ink can be lowered to improve ink recovery performance. However, when an attempt is made to elevate the temperature to about 80° C. for example, a time period required to reach the warmed temperature becomes long, to make the waiting time period up to printing long. Therefore, the preferred warming temperature is about 50° C.

(Fourteenth Embodiment)

The fourteenth embodiment is characterized in that the ink amount to be supplied to the sub-tank by pit-in ink supply before the ink draining process (full amount drainage process) is taken as the amount necessary for recovery, instead of filling up the sub-tank. Since the other structure is similar to that in the ninth to thirteenth embodiments, discussion for such common components will be eliminated for avoiding redundant disclosure for simplification in order to facilitate clear understanding of the present invention. In particular, as a result of experiments, by washing the nozzles by full amount draining after pit-in ink supply of ink in an amount of 0.15 cc, a subsequent recovery process can be done without causing any problem. Therefore, it is set to supply 0.2 cc of ink for the purpose of providing margin.

Here, the pit-in ink supply operation for supplying a predetermined amount of ink smaller than a filling up amount, instead of filling up the sub-tank, will be discussed with reference to FIG. 4. At first, the needle B122 is inserted into rubber joint C105 to connect the negative pressure joint B302 and the air suction opening B123. Subsequently, the piston in the cylinder pump B304 is moved in the direction of the arrow. At the stroke of the piston corresponding to 0.2 cc×three colors=0.6 cc, the cylinder pump is situated in a waiting state. By such operation, the predetermined supply amount, i.e., 0.2 cc, cannot be supplied unless the time period for pit-in ink supply is expanded in relation to development of negative pressure in the sub-tank, thus making the waiting period to print longer. However, this significantly contributes to reduction of the ink consuming amount.

(Fifteenth Embodiment)

The fifteenth embodiment is characterized in that it provides a waiting period from completion of the first pit-in ink supply to starting of the ink draining process and thereby promoting dissolving of ink of high viscosity remaining in the sub-tank. Specifically, in performing a large recovery sequence, providing the waiting period at a point of time when the first pit-in ink supply is completed (condition of FIG. 28C), a greater amount of ink of high viscosity in the sub-tank is dissolved by fresh ink, thus improving recovery performance in the subsequent normal recovery process. On the other hand, it is also possible to provide the waiting period in the state shown in FIG. 28E. Particularly, since ink of high viscosity in the nozzle array portion is difficult to dissolve, providing the waiting period under the presence of fresh ink is effective for recovery. Furthermore, by providing a waiting period in both states of FIGS. 28C and 28E, reliability can be improved by further promoting dissolving of the ink of high viscosity. Of course, it is possible to combine providing of the waiting period and the warming process discussed in connection with the thirteenth embodiment.

(Sixteenth Embodiment)

The sixteenth embodiment is characterized in that it provides a temperature-humidity sensor in the main body of the apparatus, stores history or log data of temperature and humidity by the ASIC simultaneously with counting up of the non-use period, correcting the evaporation speed (or evaporation ratio α, evaporation amount) which is a parameter corresponding to the ink viscosity on the basis of environmental history, and thereby optimally reducing the ink draining amount associated with the ink draining process corresponding to ink viscosity. Since the other structure is similar to that in the fifth to fifteenth embodiments, discussion for such common components will be eliminated for avoiding redundant disclosure for simplification in order to facilitate clear understanding of the present invention.

In the fifth to fifteenth embodiments, the evaporation speed under a condition where evaporation is most significant (temperature being high and humidity being low) among use range of the printer is taken as the evaporation speed. However, in an actual environment, the evaporation is not so significant in many cases. Accordingly, in consideration of the evaporation speed (or evaporation ratio α, evaporation amount) under a condition where evaporation is most significant, if the ink draining amount associated with the ink draining process is determined, more ink than necessary may be consumed.

Therefore, in the sixteenth embodiment, the evaporation speed (or evaporation ratio α, evaporation amount) is corrected depending upon the environmental history or log data (history or log data of environmental conditions including temperature and humidity) in the non-use period of the main body of the apparatus to see the state of ink in the sub-tank more accurately. It should be noted that the process of temperature-humidity data may be the average of the values over the non-use period or may provide weightings depending upon the period of time, such as the start of being left unused, termination of being left unused or so forth. By correcting the evaporation speed (or evaporation ratio α, evaporation amount) on the basis of the history of non-use environment of the main body of the apparatus, the ink consuming amount can be further reduced.

(Seventeenth Embodiment)

The shown embodiment is characterized by selecting the recovery sequence to perform among a plurality of recovery sequences including the above-explained small recovery sequence, medium recovery sequence and large recovery sequence depending upon the non-use period. With this arrangement, in comparison with the fifth embodiment or tenth embodiment, the ink consuming amount required for the recovery sequence can be made closer to the minimum necessary amount.

(Eighteenth Embodiment)

The shown embodiment is characterized by selecting the recovery sequence to perform among a plurality of recovery sequences including the above-explained small recovery sequence, medium recovery sequence and large recovery sequence, depending upon the non-use period and the ink remaining amount at the completion of printing at the preceding time. With this arrangement, in comparison with the sixth embodiment or eleventh embodiment, the ink consuming amount required for the recovery sequence can be made closer to the minimum necessary amount.

(Nineteenth Embodiment)

The shown embodiment is characterized in that it selects the recovery sequence to be performed from among a plurality of recovery sequences including the above-explained small recovery sequence, medium recovery sequence and large recovery sequence, depending upon the non-use period and ink condensation degree. With this arrangement, in comparison with the seventh embodiment or twelfth embodiment, the ink consuming amount required for the recovery sequence can be made closer to the minimum necessary amount.

(Twentieth Embodiment)

In the foregoing first embodiment, the ink draining process is performed at a point of time before starting printing, whereas, in the twentieth embodiment, the ink draining process is performed at a point of time after completion of printing. It should be noted that the "point of time after completion of printing" means a point of time taking the turning OFF of the power source as a trigger, a point of time taking the reception of the print end signal indicating an end of printing as trigger, and a point of time similar to them.

In the twentieth embodiment, since the remaining ink in the sub-tank is drained after completion of printing, the sub-tank can be left in the state where a little amount of remaining ink is contained. Accordingly, even when printing is performed after being left unused for a long period of time, problems associated with condensation of ink is not caused. It should be noted that when printing is performed after the sub-tank is left unused (i.e., when the next printing operation is performed), in a normal way, as soon as the print start signal is received, pit-in ink supply (second pit-in ink supply) for the printing operation is performed, and subsequently, the printing is started after performing the normal recovery process.

(Twenty-First Embodiment)

In the twenty-first to twenty-fourth embodiments, ink draining to make the remaining ink amount in each color substantially equal to each other is performed in the ink draining process (first ink draining process) upon completion of the printing operation in order to make reproductivity of color high by reducing fluctuation of ink condensation ratios in respective colors of the sub-tanks after supplying ink in the sub-tanks, as a common feature. Hereinafter, the reason to perform the ink draining so that remaining ink amounts in respective colors become substantially equal to each other will be discussed.

A significant difference caused between remaining ink amounts in respective colors of sub-tanks in some types of images is undesirable for the reason set forth below. It should be appreciated that differentiating remaining ink amounts in respective colors depending upon some types of images means that when the image to be printed is, for example, a sky in fine weather, a large amount of cyan ink is consumed to make the remaining amount of cyan ink small and relatively large amounts of magenta and yellow inks remain.

Figures 5A, 5B, 5C, 5D, 5E, 5F, 5G:
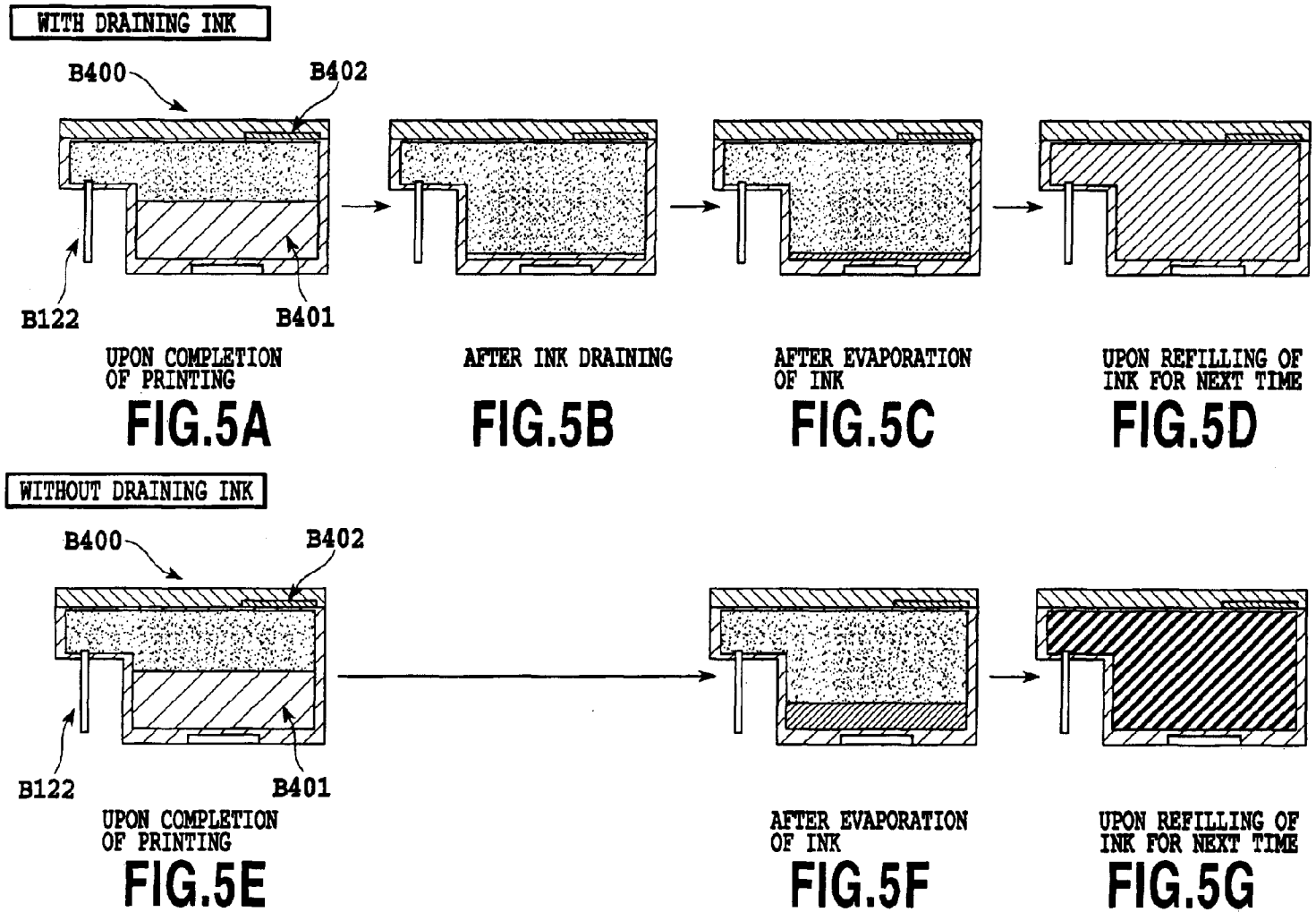
FIGS. 5A to 5G are schematic representations of condensation of ink in a sub-tank.

FIGS. 5A to 5G are schematic representations for explaining condition of remaining inks in a plurality of sub-tanks, where cases when draining of ink is performed before pit-in ink supply and when draining of ink is not performed are illustrated. FIG. 5A shows the ink remaining amount at the completion of printing, wherein an approximately medium amount of ink remains in the sponge, FIG. 5B illustrates a state where ink is drained by ink draining, FIG. 5C illustrates a state after evaporation of volatile components of ink in the sub-tank, and FIG. 5D shows a state where ink is filled for the next printing (state after pit-in ink supply).

While illustrated diagrammatically, in the state shown in FIG. 5B, ink cannot be drained completely—especially, ink coloring sponge (here ink wetting sponge fiber) is difficult to drain - even when ink is drained at the completion of printing at the preceding time. Therefore, even when ink is filled for the next printing as shown in FIG. 5D, it is inherent that the density of ink becomes higher than the initial ink density.

On the other hand, states in the case where ink draining is not performed are shown in FIGS. 5F and 5G, wherein FIG. 5F shows the state where the sub-tank is left for drying without performing ink draining and shows that the amount of remaining condensed ink is greater than that of FIG. 5C, and FIG. 5G shows a state where ink is filled for the next printing (state after pit-in ink supply) and the density of ink is higher than the initial ink density.

In either case, it is inherent that the density of the ink becomes higher than the initial ink density. While the foregoing discussion has been given for the phenomenon caused in the sub-tank of one color, in the case of a full color printing apparatus, at least three or more colors of inks are used and a corresponding number of sub-tanks are present. The states in case of sub-tanks for full color printing are diagrammatically illustrated in FIGS. 6A to 6I.

FIGS. 6A to 6I are diagrammatic representations showing the ink amounts in sub-tanks of three colors of Y, M and C, wherein FIG. 6A shows the state at the completion of printing (for example, by printing an image of a sky in fine weather as set forth above), wherein remaining amounts of Y and M inks are large and the remaining amount of C is extremely small.

FIGS. 6A, 6B, 6C and 6D show states in the case where ink draining is performed, wherein, even if remaining ink is attempted to be drained after the printing state of FIG. 6A, it is not possible to establish an ink drained state of equal level in three colors, as shown in FIG. 6B. This is the case where ink draining is performed by suction and is caused in the case where suction of three colors of Y, M and C color inks by a single cap. In other words, in the case of a simultaneous suction for three colors, when ink of one color is drained out, inks of other colors are difficult to be drained. The reason is that after draining out of, e.g., cyan ink, an air flow passage is formed to make negative pressure for drawing ink smaller (it should be noted that, as illustrated, even the cyan ink cannot be drained completely. Breakage of a meniscus or membrane of ink in ejection holes of the cyan printing head may form air passages in several nozzles. As a result, even cyan ink cannot be drained completely in all nozzles).

Then, as illustrated, when the sub-tanks are left for drying in the condition where draining of yellow ink is insufficient, the ink remaining state becomes as illustrated in FIG. 6B. When refilling of ink is performed in this condition, the condensation ratios of inks can be differentiated between respective colors as shown in FIG. 6D. When the balance of condensation ratios is lost, it results in not only causing the density of primary colors such as yellow (also magenta in the shown case) to become higher, but also causing a variation of color hues in secondary colors. In other words, in the shown example, while cyan has an ink density substantially equal to the initial ink density, the condensation ratio of yellow ink becomes higher, and, as a result, upon reproducing green color, the color of green can have a yellowish color taste or hue to cause local variation of color taste in the printed image and make an unnatural impression in the entire image significant.

In this case, the problem becomes more significant than the case where printing is performed with inks of other colors condensed in comparable degree as the yellow ink of the foregoing example. The reason is that when densities of all colors are high, while the density of the entire image becomes high, the color hue in respective portions of the image is substantially the same as the image printed with the inks of initial densities. When the balance of densities of inks of respective colors is lost as in the shown example, the color hue can be differentiated particularly in the portion of the image of secondary colors. Therefore, the image is not of simply increased density, and in the shown case, the image, particularly in the portion of the green color in the image, becomes yellowish, although a portion of the image of the blue color can be output in a substantially acceptable color. Thus, local variation of a color hue in the image is caused, and an unnatural taste or impression of the overall image becomes significant.

On the other hand, even in the case where draining of inks is not performed as illustrated in lower row of FIGS. 6E to 6I, substantially the same result is caused as the case of draining the ink. Specifically, when the remaining amounts of inks are left to dry as shown in FIG. 6F after completion of printing as shown in FIG. 6E, and subsequently inks are refilled for the next printing, densities of the condensed inks are significantly differentiated among three colors as shown in FIG. 6G. In the state of FIG. 6G, if suction is performed while capping three colors of nozzles in a lump, viscosities of the inks are differentiated in associating with the difference of densities of inks to result in different flow resistances in respective colors of inks. Therefore, it becomes impossible to drain the condensed inks uniformly as shown by FIG. 6H. Therefore, even when fresh inks are refilled as shown by FIG. 6I, the densities of the inks after refilling can be different to destroy balance.

Such a problem can be solved by performing capping and suction for each color of nozzles individually instead of capping and suction for nozzles of three colors in a lump. However, such a solution encounters a drawback in that the printing apparatus becomes bulky and complicated. In the alternative, even in suction for the nozzles of three colors in a lump, fluctuation of the ink remaining amounts after suction as shown by FIG. 6B or FIG. 6I can be reduced if suction is performed for a long period. However, it is not always possible to establish balance of remaining amounts of inks in three colors even when suction is performed for a long period. Furthermore, performing suction for a long period inherently makes the process time long. Such a problem in the balance of the condensation ratio has neither been recognized nor suggested in the prior art, and thus is new problem.

The twenty-first to twenty-fourth embodiments have been designed in view of the problems set forth above. It is therefore an object of the following embodiments to reduce fluctuation of the ink condensation ratio of respective sub-tanks after refilling of ink in the sub-tanks, resulting in natural color densities of an image with superior reproducibility, and preventing visually perceptive differences of densities between images even when the same image is printed repeatedly and sequentially.

It should be noted that, in these embodiments, in order to reduce the size of the printer portion, the size of output product of the printer is selected to be a card size instead of a so-called L-size frequently seen in analog silver halide photographs. The card size is a size of about 54 mm×86 mm, equivalent to the size of a name card. For example, upon printing at 1200×1200 dpi, in view of pixel size, the necessary size of droplets of ink may be about 4 to 5 pl. Therefore, the necessary ink amount for forming an image becomes about 0.055 cc. Assuming the recovery amount after refilling ink is 0.02 cc, for example, the necessary ink amount becomes 0.075 cc. The capacity of the sub-tank is set at 0.1 cc.

In the shown apparatus, in order to detect the ink amount residing in the sub-tank after printing at a high accuracy, an ink amount to be stored in the sub-tank and an ink amount to be drained by the suction recovery operation are stored as fixed values in ROM 504 or EEPROM 509. There is a little fluctuation in the ink amount to be filled in the sub-tank by each ink refilling operation and in the ink amount drained in each suction recovery operation per main body of the printing apparatus. Therefore, it is preferred to correct such fluctuation to improve accuracy in the detection of the ink residual amount.

EEPROM 509 has a memory region (hereinafter referred to as a dot counter) for integrating the ink amount ejected in the ejecting operation in units of 1 pl. By subtracting the ink amount drained by the recovery operation and ink amount counted by the dot counter from the ink amount to be stored in the sub-tank, the amount of residual ink in the sub-tank can be calculated. Here, since the capacity of the sub-tank is set at 0.1 cc, the precision in detection of the ink residual amount is preferably smaller than or equal to 0.0001 cc. It should be noted that there is a little fluctuation in the ink amount of the ink droplet per one shot per printing head, and that precision can be improved by correcting such fluctuation.

Figure 8:
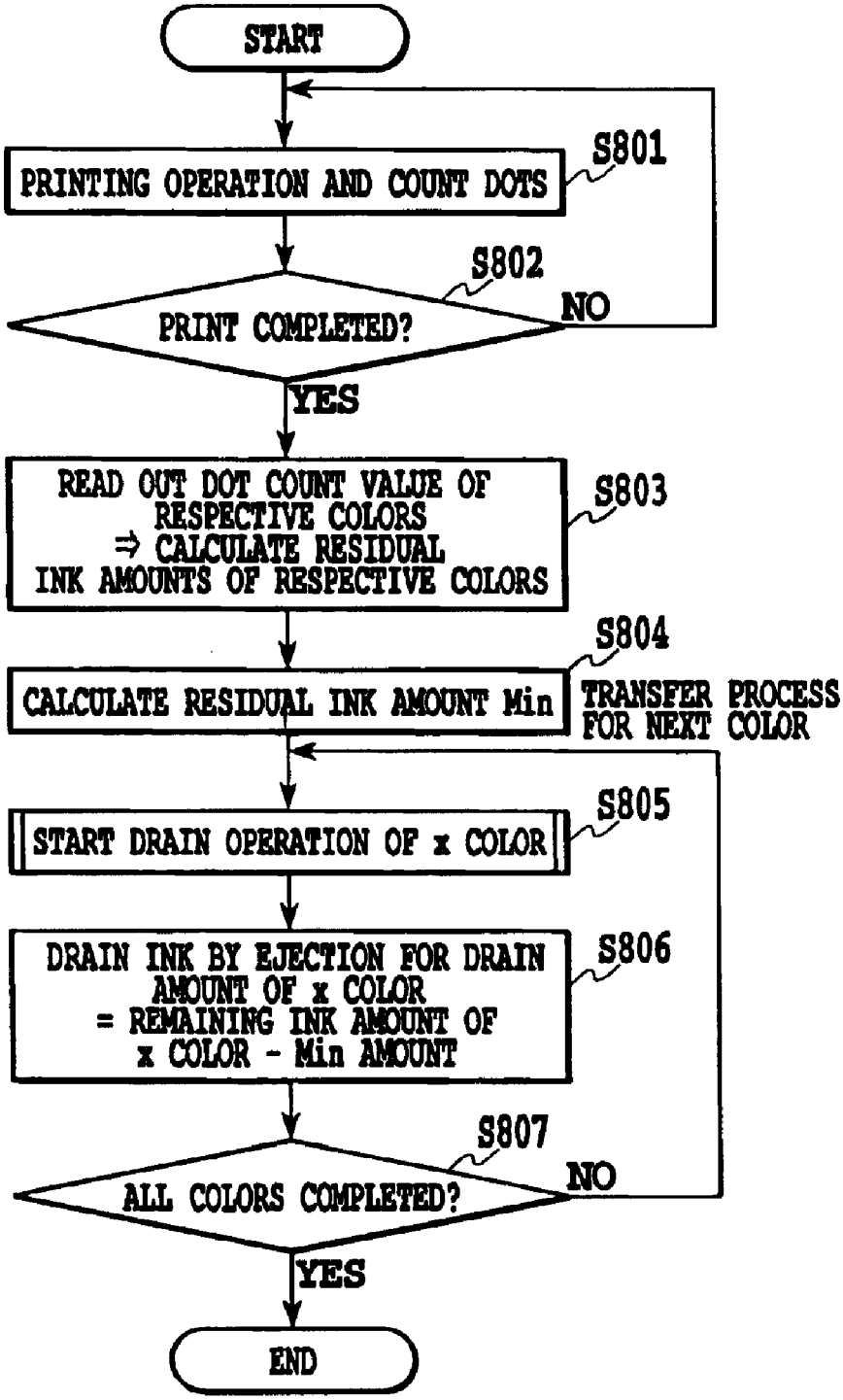
FIG. 8 is a flow chart explaining a sequence for performing a draining process according to the twenty-first embodiment of the present invention.

FIG. 8 shows a sequence of ink drainage in the twenty-first embodiment. After starting, at first, at step S801, simultaneously with the printing operation, the used amount of ink is integrated up to completion of the printing operation by the dot counter as counting means. After completion of printing at step S802, dot counter values Dc, Dm and Dy for respective colors of cyan, magenta and yellow are read out (step S803), and the residual ink amounts of respective colors are calculated based on the dot counter values. For example, when the capacity of the sub-tank is 0.1 cc, the ink amount to be filled in the sub-tank at a full state is 0.085 cc, subtracting the volume of the sponge and the volume of dead air. Next, after refilling ink at every time, the ink amount to be drained upon suction recovery is 0.02 cc. These values are stored in ROM 504 or EEPROM 509. In adjustment at the factory, if there is fluctuation between the main bodies, such fluctuation should be corrected. The residual ink amount Rc in the cyan sub-tank is derived from these values as Rc=0.085−0.02−Dc. In a similar manner, residual amounts Rm and Ry of magenta and yellow are also derived.

Next, at step S804, the Min value among residual amount of respective colors is calculated by Min=Min (Rc, Rm, Ry). As a first drainage process, draining of inks of respective colors is performed at step S805 and subsequent steps using the Min value and the residual amount values of respective colors. At first, concerning cyan, the draining amount is derived at step S806. Here, the draining amount corresponds to a difference between the residual amount of cyan ink and the Min value. Then, the first draining process is performed by draining ink in an amount corresponding to the derived drainage amount. Next, a similar process is repeated (step S807) until the process is performed for all colors. After drainage of inks of respective colors, the process is terminated.

It should be appreciated that while the draining process of the ink is described as being performed by ejection, suction drainage may be performed as required. It is also possible to perform both ejecting drainage and suction drainage.

Figures 9A, 9B, 9C, 9D, 9E, 9F:
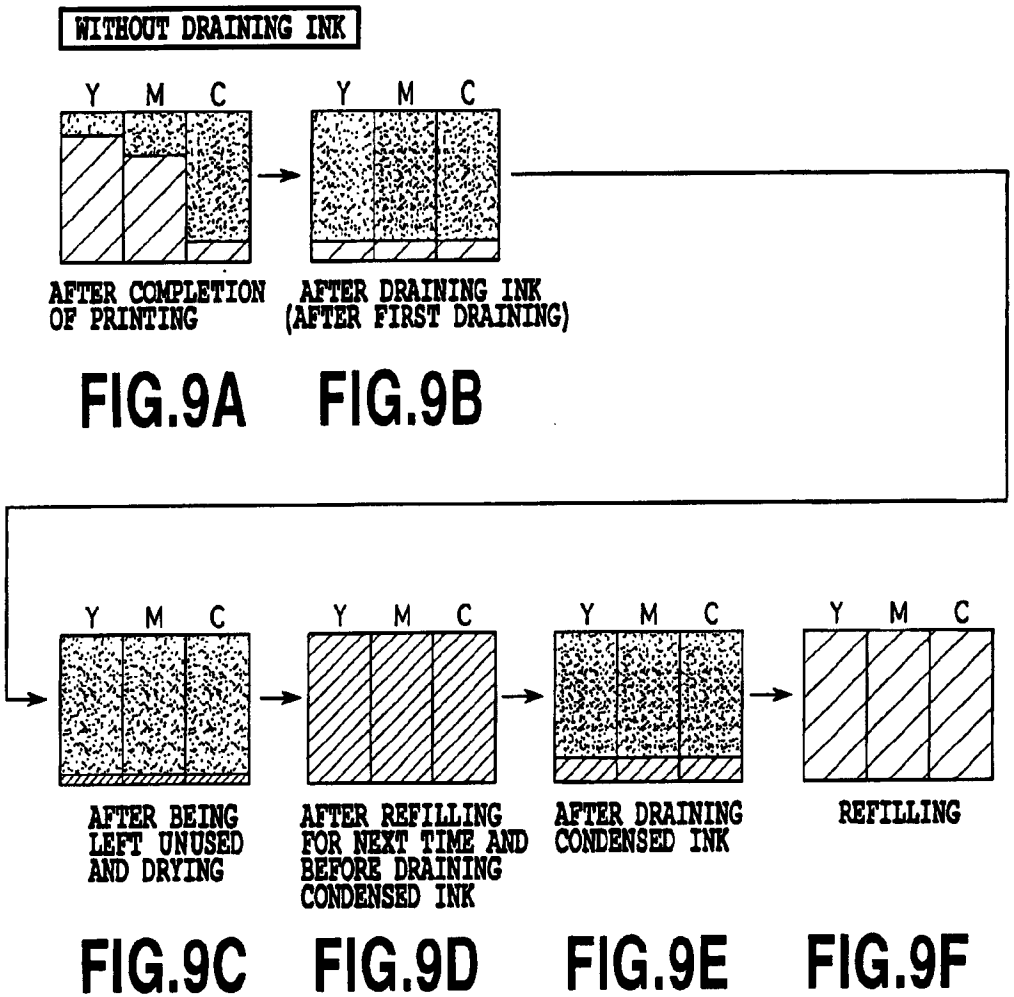
FIGS. 9A to 9F are schematic representations explaining fluctuation of density ratio in the twenty-first embodiment of the present invention.

States of residual ink in the sub-tank at this time are illustrated in FIGS. 9A to 9F. By comparing FIGS. 9A to 9F with FIGS. 6A to 6I, the effect of the shown embodiment will be understood. FIGS. 9A to 9F show application of the shown embodiment for the process in "not draining of ink" shown in FIGS. 6E to 6I, in which the process of FIG. 9B (first ink draining process) is added. By repeating the process of step S806 shown in the sequence of FIG. 8, the state of FIG. 9B is established. By this first ink draining process, even if fluctuation is caused in ink remaining amounts of respective colors in the sub-tanks after completion of printing, inks of respective colors are consumed up to an equal level to substantially eliminate fluctuation of ink remaining amounts of respective colors as shown by FIG. 9B, and thus, ink remaining amounts of respective colors can be balanced.

While the subsequent process is the same as set forth above (discussed with respect to FIGS. 6E to 6I), the states in the sub-tank are different from those of FIGS. 6E to 6I. After the process of FIG. 9B, the process is completed. Then, the printer is left in the non-use state. While the printer is left in the non-use state, ink is dried to condense the residual ink as in FIG. 9C. Then, the ink exchanging process is performed for condensation of ink in a sequence (not shown) in the next printing operation as shown FIGS. 9D and 9E, degrees of condensation in respective colors of inks are substantially the same, the viscosity of the inks may not be varied significantly to permit exchanging of inks while maintaining balance in densities. Finally, in a state of FIG. 9F immediately before printing, condensation degrees of respective colors in the condensed inks do not fluctuate significantly, and the condensation degrees per se are small.

Upon performing a durability test of the shown printer using such a sequence, not only ink densities after refilling of ink, but also ink condensation ratios in respective colors did not have significant difference between colors. As a result, the color hue of the image can be natural to achieve high reproducibility of color hue. Furthermore, even when the same image is printed continuously, it becomes possible to provide printed outputs having a color hue not fluctuating in a visually perceptible extent.

It should be noted that since the degree of evaporation of the ink is variable depending upon elapsed time, it is possible to perform the ink draining process after refilling of ink shown in FIG. 9E, only when the printing apparatus is left in the non-use state for several consecutive days, or as required. In the alternative, in the case of the printer causing little evaporation or not requiring highly accurate color reproduction of the image, such sequence may not be provided. In the mode not performing the ink draining process after refilling of ink as in FIG. 9E, the printing operation may be started after refilling ink at FIG. 9D. It should be noted that, in the case of this mode of implementation, the ink density in the sub-tank becomes higher than the initial ink density to result in a higher density of the printed image, but no problem in color hue is caused since the balance of density of respective colors is not lost. Therefore, reproductivity of the color hue is sufficiently acceptable.

(Twenty-Second Embodiment)

Figure 10:
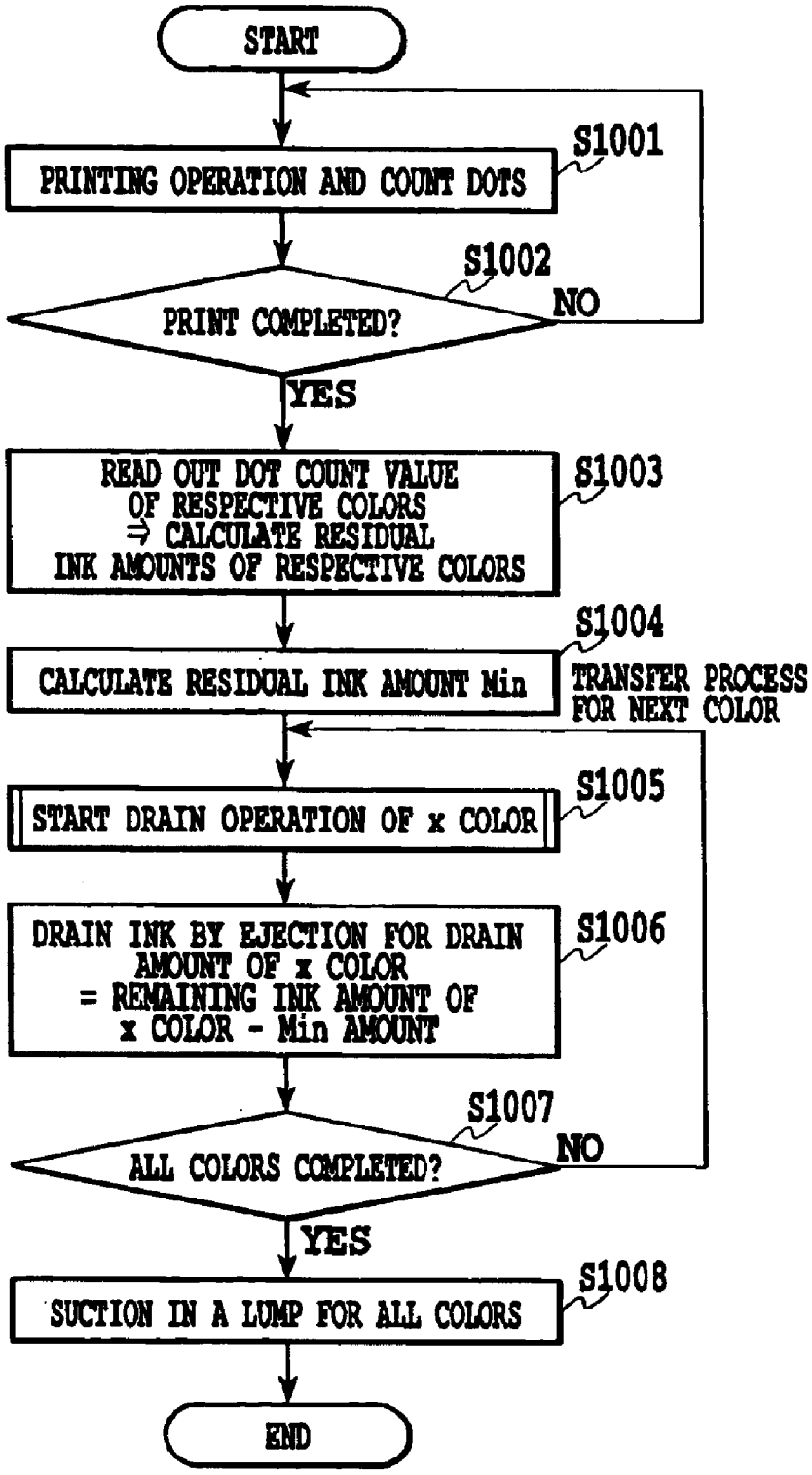
FIG. 10 is a flow chart explaining a sequence for performing a draining process according to the twenty-second embodiment of the present invention.
Figures 11A, 11B, 11C, 11D, 11E:
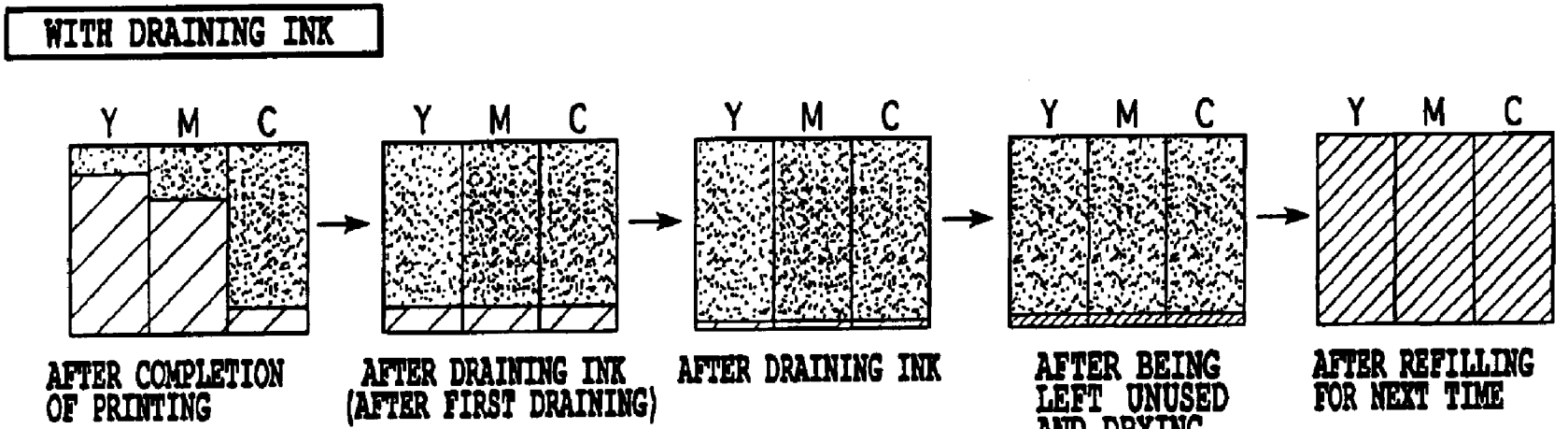
FIGS. 11A to 11E are schematic representations explaining fluctuation of density ratio in the twenty-second embodiment of the present invention.

The twenty-second embodiment is characterized in that a sequence of ink drainage is as shown by the flowchart of FIG. 10. By performing ink drainage using the shown sequence, the residing state of ink in the sub-tank as shown in FIGS. 11A to 11E is realized. FIGS. 11A to 11E show the residing state of ink in the sub-tank when the shown embodiment is applied to the process of "ink drained" in FIGS. 6A to 6D.

FIG. 10 adds the suction process in a lump for all colors at step S1008 for the process shown in FIGS. 9A to 9F. The sequence of the shown embodiment in FIG. 10 is differentiated from FIGS. 9A to 9F in this step S1008 and is the same for the rest. In the process of FIG. 10, after completing the ink draining process of each color (first ink draining) for all colors at step S1007 (FIG. 11C), "suction in a lump" as the second ink draining process is performed at step S1008 (FIG. 6B) for draining out residual ink in the sub-tank as much as possible. Here, "suction in a lump" means the process for sucking inks in respective sub-tanks simultaneously and in amounts equal to each other.

It should be noted that the second ink draining process may be performed following the first ink draining process, or, in the alternative, may be performed at a point of time after completion of the first ink draining process but before the next printing operation.

Even in the twenty-second embodiment, similarly to the twenty-first embodiment, after refilling of ink for the next printing operation, ink condensation ratios may have little difference between respective colors, and the color hue of the image can be natural, and reproducibility of color hue is superior. Therefore, it has been confirmed that even when the same image is printed sequentially, printed outputs having color hues not fluctuating in a visually perceptible extent can be obtained.

It should be appreciated that since the shown embodiment does not require exchanging of ink before the next printing as required in the twenty-first embodiment, the ink consuming amount can be reduced as compared with the twenty-first embodiment.

(Twenty-Third Embodiment)

While a sequence flowchart of this embodiment is not illustrated, the timing of step S805 and subsequent processes of FIG. 8 or the timing of step S1005 and subsequent processes of FIG. 10 are differentiated. In the foregoing embodiments, step S805 and subsequent processes are performed immediately after completion of printing. In contrast to this, in this embodiment, step S805 and subsequent processes are performed at a point of time of turning OFF of the printer. In the alternative, it is also possible to perform step S805 and subsequent processes at a point of time of automatic turning OFF on the camera side. In either case, since the draining process at step S805 and subsequent steps is performed upon detection of turning OFF of the power source, it becomes possible to shorten a process period from completion of the preceding printing to starting of the current printing. Therefore, it becomes possible to perform the next printing operation without keeping the user waiting for a long period.

(Twenty-Fourth Embodiment)

Figure 12:
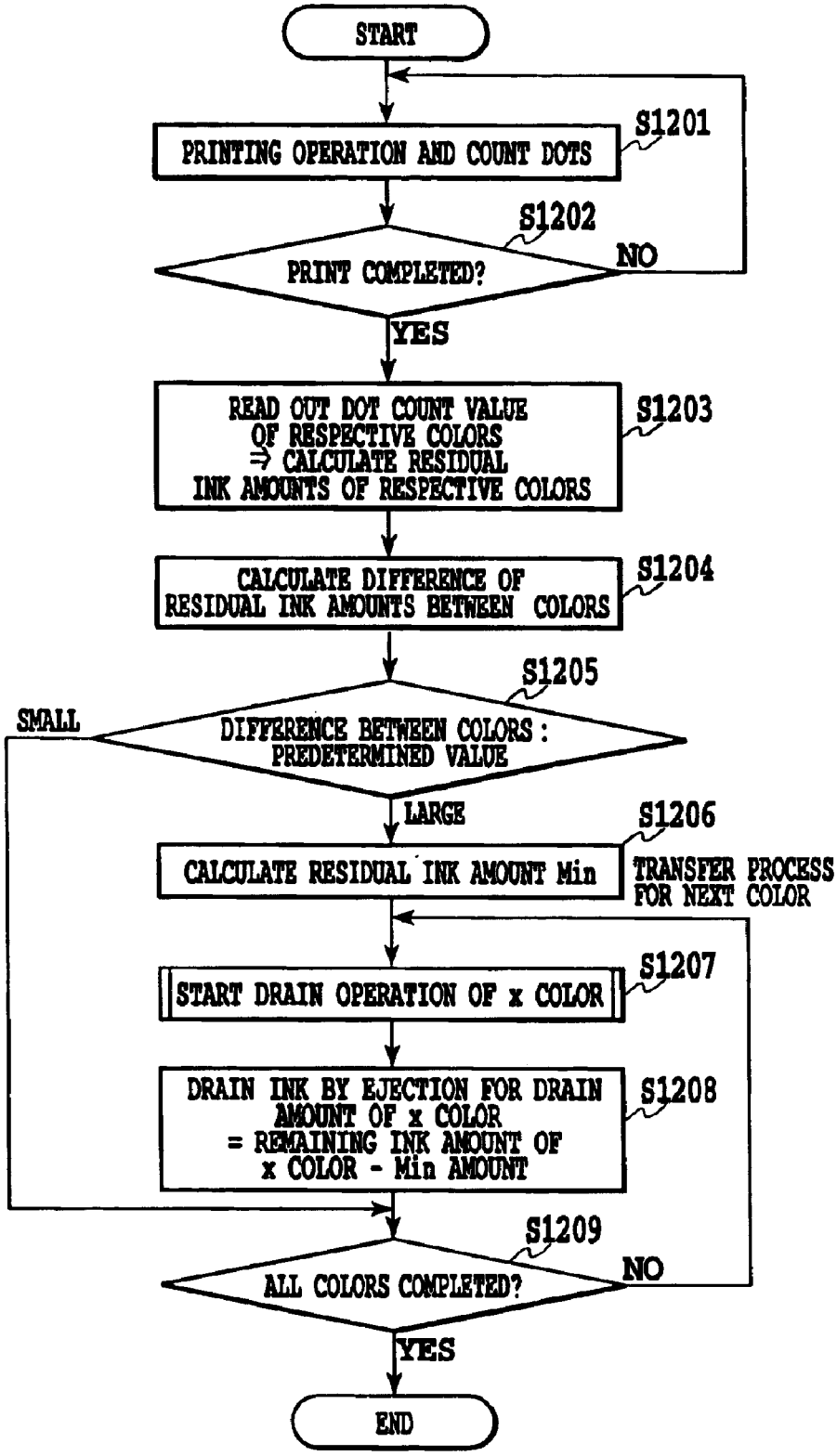
FIG. 12 is a flow chart explaining a sequence for performing a draining process according to the twenty-fourth embodiment of the present invention.
Figure 13:
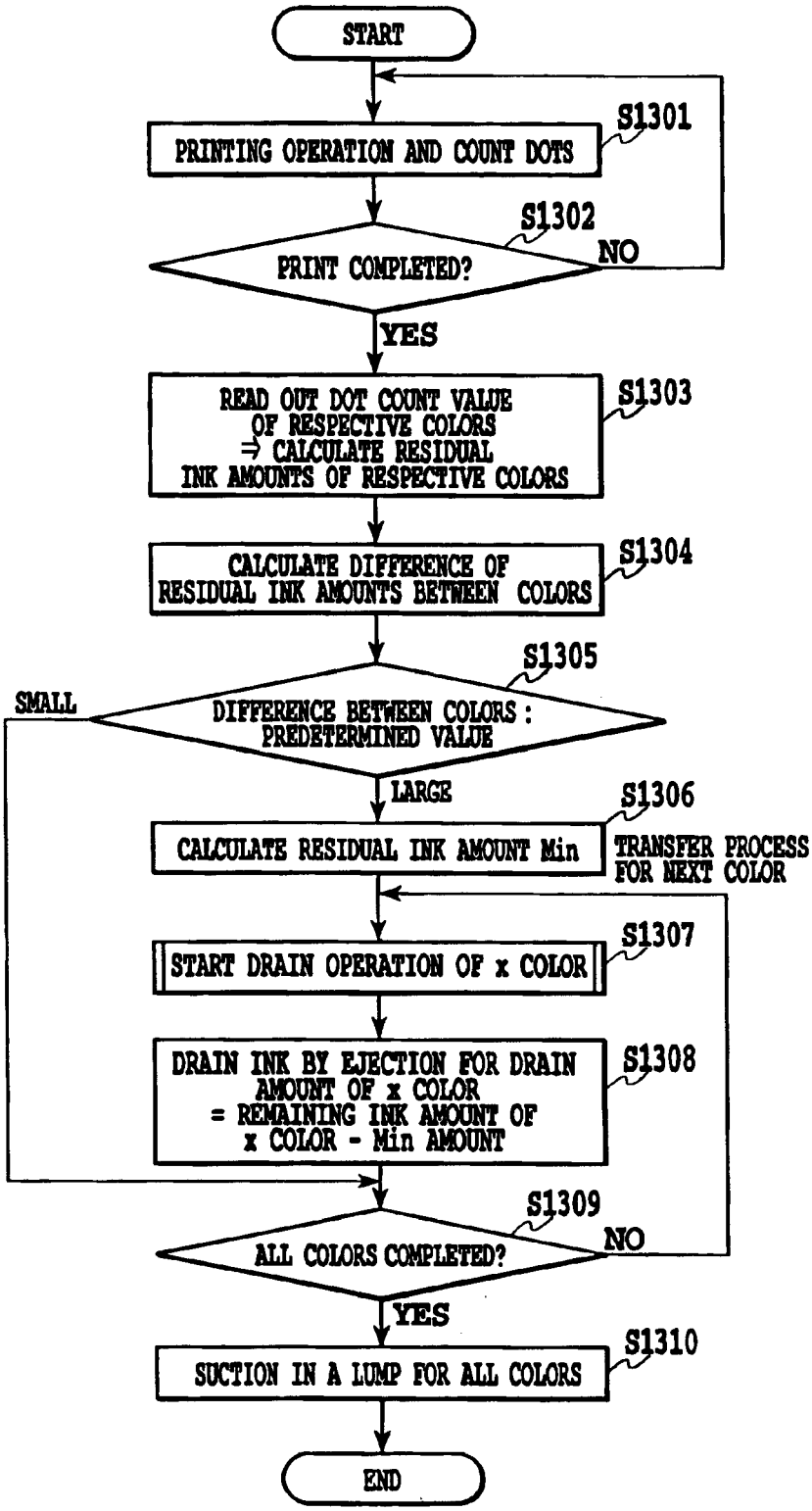
FIG. 13 is a flow chart explaining sequence for performing draining process according to the twenty-fourth embodiment of the present invention.

In this embodiment, the judgment process for comparison with a predetermined amount is added between steps S803 and S804 of FIG. 8 or between steps S1003 and S1004 of FIG. 10, as shown in FIGS. 12 and 13.

In the shown embodiment, after calculation of the residual ink amounts of respective colors, a difference of the residual ink amounts between respective colors of sub-tanks is derived. If the difference is not excessively large (i.e., the difference of the residual ink amounts between the sub-tanks is smaller than or equal to the predetermined value), the process is terminated without performing the first ink draining process. When the difference of the residual ink amounts of respective colors is small, condensation ratios of inks between colors are not differentiated significantly. Therefore, it is unnecessary to equalize the ink remaining amounts between respective colors. In this case, the first ink draining process to be performed for adjusting ink remaining amounts between respective colors to be substantially equal to each other is eliminated. The predetermined value as a threshold value for making judgment on large or small differences of ink remaining amounts between the colors is set preliminarily, and is set at 0.01 cc in the shown embodiment. Here, since the capacity of the sub-tank is 0.1 cc, if the difference is Up to 0.01 cc of one tenth of the sub-tank capacity, no significant difference is caused in condensation ratios of respective colors. Therefore, the ink draining process is not performed for strictly equalizing the ink remaining amount. The predetermined value used herein may be appropriately varied depending upon the degree of evaporation and application of the printer. In the twenty-fourth embodiment, when the difference of ink remaining amounts of respective colors is small, the ink draining process for equalizing the ink remaining amount (first ink ejection) is not performed, so that the ink consuming amount can be made smaller than those of the twenty-first to twenty-third embodiments. Also, it becomes possible to shorten a process time from completion of the preceding printing to starting of the current printing.

(Other Embodiments)

In the foregoing twenty-first to twenty-fourth embodiments, the ink draining process is performed after completion of the printing operation so that amounts of remaining condensed inks are the same in respective colors. However, it is also possible to perform the ink draining process at a point of time before starting printing.

On the other hand, as long as it is possible to combine, the first to twenty-fourth embodiments may be implemented in combinations.

With the present invention set forth above, in the ink-jet printing apparatus using the pit-in supply method, problems associated with condensation of ink can be reduced or eliminated.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. An ink-jet printing apparatus, comprising:

a main tank storing ink;

a sub-tank separable and connectable with said main tank through an ink supply passage;

a printing head for ejecting ink supplied from said sub-tank;

printing means for performing printing by ejecting ink from said printing head to a printing medium, while said sub-tank and said printing head are scanning across the printing medium, said sub-tank being separated from said main tank during the scanning;

ink draining means for performing an ink draining process for draining at least a part of ink remaining in said sub-tank within a period after completion of printing at a preceding time and before starting printing at a next time; and ink supply means for supplying ink from said main tank to said sub-tank through the ink supply passage within the period and after completion of the ink draining process, wherein said ink supply means supplies to said sub-tank the same type of ink as the ink drained by said ink draining means.

2. The ink-jet printing apparatus as claimed in claim 1, further comprising:

measuring means for measuring any one of (A) a period after completion of printing at the preceding time and before starting printing at the next time and while a power source is turned OFF, (B) a period from turning OFF of the power source at the preceding time to reception of a print start signal for starting printing at the next time, (C) a period from completion of printing at the preceding time to reception of a print start signal for starting printing at the next time, and (D) a period after completion of a recovery process at the preceding time to reception of the print start signal for starting printing at the next time; and control means for controlling whether the ink draining process by said ink draining means is to be performed or not on the basis of a period measured by said measuring means.

3. The ink-jet printing apparatus as claimed in claim 2, wherein said control means controls said ink draining means perform the ink draining process when the measured period is longer than or equal to a predetermined period and controls said ink draining means to not perform the ink draining process when the measured period is shorter than the predetermined period.

4. The ink-jet printing apparatus as claimed in claim 1, further comprising:

measuring means for measuring any one of (A) a period after completion of printing at the preceding time and before starting printing at the next time and while a power source is turned OFF, (B) a period from turning OFF of the power source at the preceding time to reception of a print start signal for starting printing at the next time, (C) a period from completion of printing at the preceding time to reception of the print start signal for starting printing at the next time, and (D) a period after completion of a recovery process at the preceding time to reception of the print start signal for starting printing at the next time;

calculating means for calculating a value corresponding to an amount of remaining ink in said sub-tank at completion of printing at the preceding time; and control means for controlling whether the ink draining process by said ink draining means is to be performed or not on the basis of a period measured by said measuring means and the value corresponding to the remaining ink amount calculated by said calculating means.

5. The ink-jet printing apparatus as claimed in claim 1, further comprising:

measuring means for measuring any one of (A) a period after completion of printing at the preceding time and before starting printing at the next time and while a power source is turned OFF, (B) a period from turning OFF of the power source at the preceding time to reception of a print start signal for starting printing at the next time, (C) a period from completion of printing at the preceding time to reception of the print start signal for starting printing at the next time, and (D) a period after completion of a recovery process at the preceding time to reception of the print start signal for starting printing at the next time;

first calculating means for calculating a first value corresponding to an amount of remaining ink in said sub-tank at completion of printing at the preceding time;

second calculating means for calculating a second value corresponding to a viscosity of the remaining ink in said sub-tank at completion of printing at the preceding time;

third calculating means for calculating a third value corresponding a viscosity of current ink on the basis of the measured period, the calculated first value corresponding to the remaining ink amount and the calculated second value corresponding to ink viscosity; and control means for controlling whether the ink draining process by said ink draining means is to be performed or not on the basis of the third value corresponding to the viscosity of the current ink.

6. The ink-jet printing apparatus as claimed in claim 5, further comprising:

detecting means for detecting temperature and humidity;

storage means for storing a history of temperature and humidity during the period; and correcting means for correcting the third value corresponding to the viscosity of the current ink on the basis of the history.

7. The ink-jet printing apparatus as claimed in claim 1, wherein ink supply is performed by said ink supply means to said sub-tank containing the remaining ink before the ink draining process by said ink draining means during the period after completion of printing at the preceding time and before starting printing at the next time.

8. The ink-jet printing apparatus as claimed in claim 7, further comprising:

measuring means for measuring any one of (A) a period after completion of printing at the preceding time and before starting printing at the next time and while a power source is turned OFF, (B) a period from turning OFF of the power source at the preceding time to reception of a print start signal for starting printing at the next time, (C) a period from completion of printing at the preceding time to reception of the print start signal for starting printing at the next time, and (D) a period after completion of a recovery process at the preceding time to reception of the print start signal for starting printing at the next time; and control means for controlling said ink draining means to perform the ink draining process after performing of ink supply when a measured period is longer than or equal to a predetermined period and controlling not to perform the ink supply and the ink draining process when the measured period is shorter than the predetermined period.

9. The ink-jet printing apparatus as claimed in claim 7, further comprising:

measuring means for measuring any one of (A) a period after completion of printing at the preceding time and before starting printing at the next time and while a power source is turned OFF, (B) a period from turning OFF of the power source at the preceding time to reception of a print start signal for starting printing at the next time, (C) a period from completion of printing at the preceding time to reception of the print start signal for starting printing at the next time, and (D) a period after completion of a recovery process at a preceding time to reception of the print start signal for starting printing at the next time;

calculating means for calculating a value corresponding to an amount of remaining ink in said sub-tank at completion of printing at the preceding time; and control means for controlling whether said ink draining means is to perform the ink draining process after performing of the ink supply or whether both of the ink supply before the ink draining process and the ink draining process are not to be performed on the basis of a period measured by said measuring means and the value corresponding to the remaining ink amount calculated by said calculating means.

10. The ink-jet printing apparatus as claimed in claim 1, further comprising:

measuring means for measuring any one of (A) a period after completion of printing at the preceding time and before starting printing at the next time and while a power source is turned OFF, (B) a period from turning OFF of the power source at the preceding time to reception of a print start signal for starting printing at the next time, (C) a period from completion of printing at the preceding time to reception of the print start signal for starting printing at the next time, and (D) a period after completion of a recovery process at the preceding time to reception of the print start signal for starting printing at the next time;

first calculating means for calculating a first value corresponding to an amount of remaining ink in said sub-tank at completion of printing at the preceding time;

second calculating means for calculating a second value corresponding to a viscosity of the remaining ink in said sub-tank after completion of printing at the preceding time;

third calculating means for calculating a third value corresponding to a viscosity of current ink on the basis of the measured period, the calculated first value corresponding to the remaining ink amount and the calculated second value corresponding to the ink viscosity; and control means for controlling whether said ink draining means is to perform the ink draining process after performing of the ink supply or whether both of the ink supply before the ink draining process and the ink draining process are to be performed on the basis of the third value corresponding to the viscosity of the current ink.

11. The ink-jet printing apparatus as claimed in claim 1, wherein said ink draining means drains substantially all of flowable ink in said sub-tank.

12. The ink-jet printing apparatus as claimed in claim 1, further comprising means for performing a warming process for elevating a temperature of the ink in said printing head and the ink in said sub-tank before the ink draining process is performed by said ink draining means.

13. The ink-jet printing apparatus as claimed in claim 1, wherein the ink draining process is performed by said ink draining means at one of a point of time taking turning OFF of a power source as a trigger, a point of time taking reception of a print start signal for starting a next printing as a trigger, and a point of time of reception of the print start signal for starting a first print after turning ON of the power source as a trigger.

14. The ink-jet printing apparatus as claimed in claim 1, wherein the ink draining process is performed by said ink draining means at one of a point of time taking turning OFF of a power source as a trigger and a point of time taking reception of a print end signal indicating an end of printing as a trigger.

15. An ink-jet printing apparatus as claimed in claim 1, further comprising:

a plurality of sub-tanks:

calculating means for calculating a remaining ink amount in each sub-tank upon completion of a printing operation; and draining control means for controlling draining of ink from each sub-tank by the ink draining process on the basis of results of calculation by said calculating means so that remaining ink amounts in said plurality of sub-tanks are substantially equal with each other.

16. The ink-jet printing apparatus as claimed in claim 15, wherein said draining control means controls draining of ink from each sub-tank so that remaining ink amounts in respective sub-tanks become substantially equal to a minimum amount among remaining ink amounts calculated by said calculating means.

17. The ink-jet printing apparatus as claimed in claim 16, further comprising a plurality of main tanks for storing inks colors which are different from each other.

18. The ink-jet printing apparatus as claimed in claim 15, further comprising:

comparing means for comparing mutual differences of remaining ink amounts in respective sub-tanks calculated by said calculating means with a predetermined value, wherein said draining control means controls draining depending upon a result of comparison by said comparing means.

19. The ink-jet printing apparatus as claimed in claim 18, wherein said draining control means controls draining of inks from respective sub-tanks so that remaining ink amounts in said plurality of sub-tanks become substantially equal with each other when the difference is greater than the predetermined value.

20. The ink-jet printing apparatus as claimed in claim 15, further comprising second draining control means for draining remaining inks in said plurality of sub-tanks to an amount equal to each other after draining by said draining control means and before starting of a next printing operation.

21. The ink-jet printing apparatus as claimed in claim 15, further comprising negative pressure generating means for holding ink in each sub-tank, said negative pressure generating means comprising a porous body including a foamed body or a fibrous body.

* * * * *

UNITED STATES PATENT AND TRADEMARK OFFICE

CERTIFICATE OF CORRECTION

PATENT NO. : 7,021,731 B2
APPLICATION NO. : 10/619212
DATED : April 4, 2006
INVENTOR(S) : Yoshito Mizoguchi et al.

It is certified that error appears in the above-identified patent and that said Letters Patent is hereby corrected as shown below:

COLUMN 6:
Line 42, “A001” should read --A001.--.

COLUMN 7:
Line 37, “BIOS” should read --B105--.

COLUMN 10:
Line 25, “is” should be deleted.

COLUMN 22:
Line 47, “40° T” should read --40≤T--.

COLUMN 26:
Line 33, “warning” should read --warming--.

COLUMN 33:
Line 21, “loll” should read --o--.

COLUMN 37:
Line 4, “is” should read --are--.

COLUMN 41:
Line 1, “as shown” should read --as shown in--.

COLUMN 42:
Line 53, “Up” should read --up--.

UNITED STATES PATENT AND TRADEMARK OFFICE

CERTIFICATE OF CORRECTION

PATENT NO. : 7,021,731 B2
APPLICATION NO. : 10/619212
DATED : April 4, 2006
INVENTOR(S) : Yoshito Mizoguchi et al.

It is certified that error appears in the above-identified patent and that said Letters Patent is hereby corrected as shown below:

COLUMN 44:
Line 1, "perform" should read --to perform--.
Line 51, "corresponding" should read --corresponding to--.

Signed and Sealed this

Twenty-sixth Day of June, 2007

JON W. DUDAS
*Director of the United States Patent and Trademark Office*